US011143996B2

(12) United States Patent
Seki

(10) Patent No.: US 11,143,996 B2
(45) Date of Patent: Oct. 12, 2021

(54) HEATING DEVICE, FIXING DEVICE AND IMAGE FORMING APPARATUS

(71) Applicant: Takayuki Seki, Kanagawa (JP)

(72) Inventor: Takayuki Seki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/106,583

(22) Filed: Nov. 30, 2020

(65) Prior Publication Data

US 2021/0181661 A1 Jun. 17, 2021

(30) Foreign Application Priority Data

Dec. 13, 2019 (JP) ..... JP2019-225434
Mar. 19, 2020 (JP) ..... JP2020-049183

(51) Int. Cl.
*G03G 15/20* (2006.01)

(52) U.S. Cl.
CPC ..... *G03G 15/2053* (2013.01); *G03G 15/2042* (2013.01); *G03G 15/2064* (2013.01); *G03G 2215/2016* (2013.01); *G03G 2215/2035* (2013.01)

(58) Field of Classification Search
CPC ..... G03G 15/2014; G03G 15/2042; G03G 15/2053; G03G 2215/2016; G03G 2215/2035
USPC ..... 399/69, 329; 219/216
See application file for complete search history.

(56) References Cited

U.S. PATENT DOCUMENTS 9,354,570 B2 * 5/2016 Arimoto ..... G03G 15/2053
10,095,165 B2 * 10/2018 Ogawa ..... G03G 15/2053
10,281,857 B1 * 5/2019 Aikawa ..... G03G 15/2064
10,514,639 B2 * 12/2019 Kawasaki ..... G03G 15/2042
2003/0029853 A1 * 2/2003 Izawa ..... G03G 15/205 219/216
2013/0322897 A1 * 12/2013 Yago ..... G03G 15/205 399/33

(Continued)

FOREIGN PATENT DOCUMENTS

JP 2005-114959 4/2005
JP 2005-209493 8/2005

(Continued)

OTHER PUBLICATIONS

U.S. Appl. No. 17/087,961, filed Nov. 30, 2020, Takayuki Seki.

*Primary Examiner* — Robert B Beatty
(74) *Attorney, Agent, or Firm* — Harness, Dickey & Pierce, P.L.C.

(57) ABSTRACT

A heating device includes an endless belt, an opposed rotator, a heater, and a heat transfer portion. The opposed rotator is configured to contact the endless belt to form a nip between the endless belt and the opposed rotator. The heater includes a plurality of resistive heat generators configured to heat the endless belt. The heater is configured to generate a larger amount of heat on a first side of the heater than a second side of the heater in a longitudinal direction of the heater. The first side is opposite to the second side with respect to a center position of a heating span of all the plurality of energized resistive heat generators in the longitudinal direction of the heater. The heat transfer portion is disposed on the first side to release heat from the heating span.

18 Claims, 40 Drawing Sheets

(56) References Cited

U.S. PATENT DOCUMENTS

| | | | | |
|---|---|---|---|---|
| 2016/0238975 | A1 | 8/2016 | Seki et al. | |
| 2017/0185020 | A1 | 6/2017 | Seki et al. | |
| 2017/0185021 | A1 | 6/2017 | Seki et al. | |
| 2017/0255147 | A1 | 9/2017 | Seki et al. | |
| 2017/0364000 | A1 | 12/2017 | Seki et al. | |
| 2018/0173138 | A1 | 6/2018 | Seki et al. | |
| 2019/0113868 | A1* | 4/2019 | Akizuki | G03G 15/2028 |
| 2020/0174408 | A1 | 6/2020 | Furuichi et al. | |
| 2020/0209791 | A1 | 7/2020 | Seki | |
| 2020/0249604 | A1 | 8/2020 | Adachi et al. | |
| 2020/0285179 | A1 | 9/2020 | Seki | |
| 2020/0292973 | A1 | 9/2020 | Furuichi et al. | |
| 2021/0041810 | A1* | 2/2021 | Furuichi | G03G 21/206 |
| 2021/0041832 | A1* | 2/2021 | Furuichi | G03G 15/2017 |

FOREIGN PATENT DOCUMENTS

| | | | | |
|---|---|---|---|---|
| JP | 2010-250228 | | 11/2010 | |
| JP | 2011151003 | A * | 8/2011 | H05B 3/0095 |
| JP | 2012-252127 | | 12/2012 | |
| JP | 2016-062024 | | 4/2016 | |
| JP | 2016-114914 | | 6/2016 | |
| JP | 2017-173581 | | 9/2017 | |
| JP | 2017-191149 | | 10/2017 | |
| JP | 2018-032631 | | 3/2018 | |

* cited by examiner

| | FIRST BLOCK | SECOND BLOCK | THIRD BLOCK | FOURTH BLOCK | FIFTH BLOCK | SIXTH BLOCK | SEV-ENTH BLOCK |
|---|---|---|---|---|---|---|---|
| HEAT GENERATION AMOUNT OF FIRST POWER SUPPLY LINE 62A | 10000 | 6400 | 3600 | 1600 | 400 | — | — |
| HEAT GENERATION AMOUNT OF SECOND POWER SUPPLY LINE 62B | — | 25 | 225 | 1225 | 3025 | 5625 | 9025 |
| HEAT GENERATION AMOUNT OF FOURTH POWER SUPPLY LINE 62D | 25 | 25 | 25 | 25 | 25 | 25 | — |
| TOTAL HEAT GENERATION AMOUNT | 10025 | 6450 | 3850 | 2850 | 3450 | 5650 | 9025 |

| | FIRST BLOCK | SECOND BLOCK | THIRD BLOCK | FOURTH BLOCK | FIFTH BLOCK | SIXTH BLOCK | SEV-ENTH BLOCK |
|---|---|---|---|---|---|---|---|
| HEAT GENERATION AMOUNT OF FIRST POWER SUPPLY LINE 62A | 10000 | 6400 | 3600 | 1600 | 400 | — | — |
| HEAT GENERATION AMOUNT OF SECOND POWER SUPPLY LINE 62B | — | 400 | 1600 | 3600 | 6400 | 10000 | 14400 |
| HEAT GENERATION AMOUNT OF FOURTH POWER SUPPLY LINE 62D | 400 | 400 | 400 | 400 | 400 | 400 | — |
| TOTAL HEAT GENERATION AMOUNT | 10400 | 7200 | 5600 | 5600 | 7200 | 10400 | 14400 |

| | FIRST BLOCK | SECOND BLOCK | THIRD BLOCK | FOURTH BLOCK | FIFTH BLOCK | SIXTH BLOCK | SEV-ENTH BLOCK |
|---|---|---|---|---|---|---|---|
| HEAT GENERATION AMOUNT OF FIRST POWER SUPPLY LINE 62A | 10000 | 6400 | 3600 | 1600 | 400 | — | — |
| HEAT GENERATION AMOUNT OF SECOND POWER SUPPLY LINE 62B | — | 25 | 225 | 1225 | 3025 | 5625 | 9025 |
| HEAT GENERATION AMOUNT OF FOURTH POWER SUPPLY LINE 62D | 25 | 25 | 25 | 25 | 25 | 25 | — |
| HEAT GENERATION AMOUNT OF FIFTH POWER SUPPLY LINE 62E | 10000 | 10000 | 10000 | 10000 | 10000 | 10000 | 10000 |
| TOTAL HEAT GENERATION AMOUNT | 20025 | 16450 | 13850 | 12850 | 13450 | 15650 | 19025 |

| | FIRST BLOCK | SECOND BLOCK | THIRD BLOCK | FOURTH BLOCK | FIFTH BLOCK | SIXTH BLOCK | SEV-ENTH BLOCK |
|---|---|---|---|---|---|---|---|
| HEAT GENERATION AMOUNT OF FIRST POWER SUPPLY LINE 62A | 10000 | 6400 | 3600 | 1600 | 400 | — | — |
| HEAT GENERATION AMOUNT OF SECOND POWER SUPPLY LINE 62B | — | 400 | 1600 | 3600 | 6400 | 10000 | 14400 |
| HEAT GENERATION AMOUNT OF FOURTH POWER SUPPLY LINE 62D | 400 | 400 | 400 | 400 | 400 | 400 | — |
| HEAT GENERATION AMOUNT OF FIFTH POWER SUPPLY LINE 62E | 19600 | 19600 | 19600 | 19600 | 19600 | 19600 | 19600 |
| TOTAL HEAT GENERATION AMOUNT | 30000 | 26800 | 25200 | 25200 | 26800 | 30000 | 34000 |

| | FIRST BLOCK | SECOND BLOCK | THIRD BLOCK | FOURTH BLOCK | FIFTH BLOCK |
|---|---|---|---|---|---|
| HEAT GENERATION AMOUNT OF FIRST POWER SUPPLY LINE 62A | 10000 | 6400 | 3600 | 1600 | 400 |
| HEAT GENERATION AMOUNT OF SECOND POWER SUPPLY LINE 62B | 400 | 1600 | 3600 | 6400 | 10000 |
| TOTAL HEAT GENERATION AMOUNT | 10400 | 8000 | 7200 | 8000 | 10400 |

| | FIRST BLOCK | SECOND BLOCK | THIRD BLOCK | FOURTH BLOCK | FIFTH BLOCK |
|---|---|---|---|---|---|
| HEAT GENERATION AMOUNT OF FIRST POWER SUPPLY LINE 62A | 10000 | 6400 | 3600 | 1600 | 400 |
| HEAT GENERATION AMOUNT OF SECOND POWER SUPPLY LINE 62B | — | 400 | 1600 | 3600 | 6400 |
| TOTAL HEAT GENERATION AMOUNT | 10000 | 6800 | 5200 | 5200 | 6800 |

| | FIRST BLOCK | SECOND BLOCK | THIRD BLOCK | FOURTH BLOCK | FIFTH BLOCK |
|---|---|---|---|---|---|
| HEAT GENERATION AMOUNT OF FIRST POWER SUPPLY LINE 62A | 6400 | 3600 | 1600 | 400 | — |
| HEAT GENERATION AMOUNT OF SECOND POWER SUPPLY LINE 62B | 400 | 1600 | 3600 | 6400 | 10000 |
| TOTAL HEAT GENERATION AMOUNT | 6800 | 5200 | 5200 | 6800 | 10000 |

| | FIRST BLOCK | SECOND BLOCK | THIRD BLOCK | FOURTH BLOCK | FIFTH BLOCK |
|---|---|---|---|---|---|
| HEAT GENERATION AMOUNT OF FIRST POWER SUPPLY LINE 62A | 10000 | 6400 | 3600 | 1600 | 400 |
| HEAT GENERATION AMOUNT OF SECOND POWER SUPPLY LINE 62B | 10000 | 6400 | 3600 | 1600 | 400 |
| TOTAL HEAT GENERATION AMOUNT | 20000 | 12800 | 7200 | 3200 | 800 |

HEATING DEVICE, FIXING DEVICE AND IMAGE FORMING APPARATUS

CROSS-REFERENCE TO RELATED APPLICATIONS

This patent application is based on and claims priority pursuant to 35 U.S.C. § 119 to Japanese Patent Applications No. 2019-225434 filed on Dec. 13, 2019 and No. 2020-049183 filed on Mar. 19, 2020 in the Japan Patent Office, the entire disclosure of which is hereby incorporated by reference herein.

BACKGROUND

Technical Field

Embodiments of the present disclosure generally relate to a heating device, a fixing device, and an image forming apparatus. In particular, the embodiments of the present disclosure relate to a heating device, a fixing device with the heating device for fixing a toner image on a recording medium, and an image forming apparatus with the fixing device for forming an image on a recording medium.

Background Art

The image forming apparatuses often include a heating device. One example of the heating device is the fixing device that fixes toner onto a recording medium under heat. Another example of the heating device is a drying device that dries ink on a recording medium.

SUMMARY

This specification describes an improved heating device that includes an endless belt, an opposed rotator, a heater, and a heat transfer portion. The opposed rotator is configured to contact the endless belt to form a nip between the endless belt and the opposed rotator. The heater includes a plurality of resistive heat generators configured to heat the endless belt. The heater is configured to generate a larger amount of heat on a first side of the heater than a second side of the heater in a longitudinal direction of the heater. The first side is opposite to the second side with respect to a center position of a heating span of all the plurality of energized resistive heat generators in the longitudinal direction of the heater. The heat transfer portion is disposed on the first side to release heat from the heating span.

This specification further describes an improved heating device that includes an endless belt, an opposed rotator, a heater, and a heat transfer portion. The opposed rotator is configured to contact the endless belt to form a nip between the endless belt and the opposed rotator. The heater is configured to heat the endless belt. The heater includes a first heat generator group, a second heat generator group, a first electrode, a second electrode, and a third electrode. The first heat generator group includes at least one resistive heat generator. The second heat generator group includes resistive heat generators outside the first heat generator group at both end portions of the heater in a longitudinal direction of the heater. The first electrode is coupled to the first heat generator group. The second electrode is coupled to the first heat generator group and the second heat generator group. The third electrode is coupled to the second heat generator group. The heat transfer portion is disposed on an opposite side of the first electrode with respect to a center position of a heating span of all the resistive heat generators energized in the longitudinal direction of the heater.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
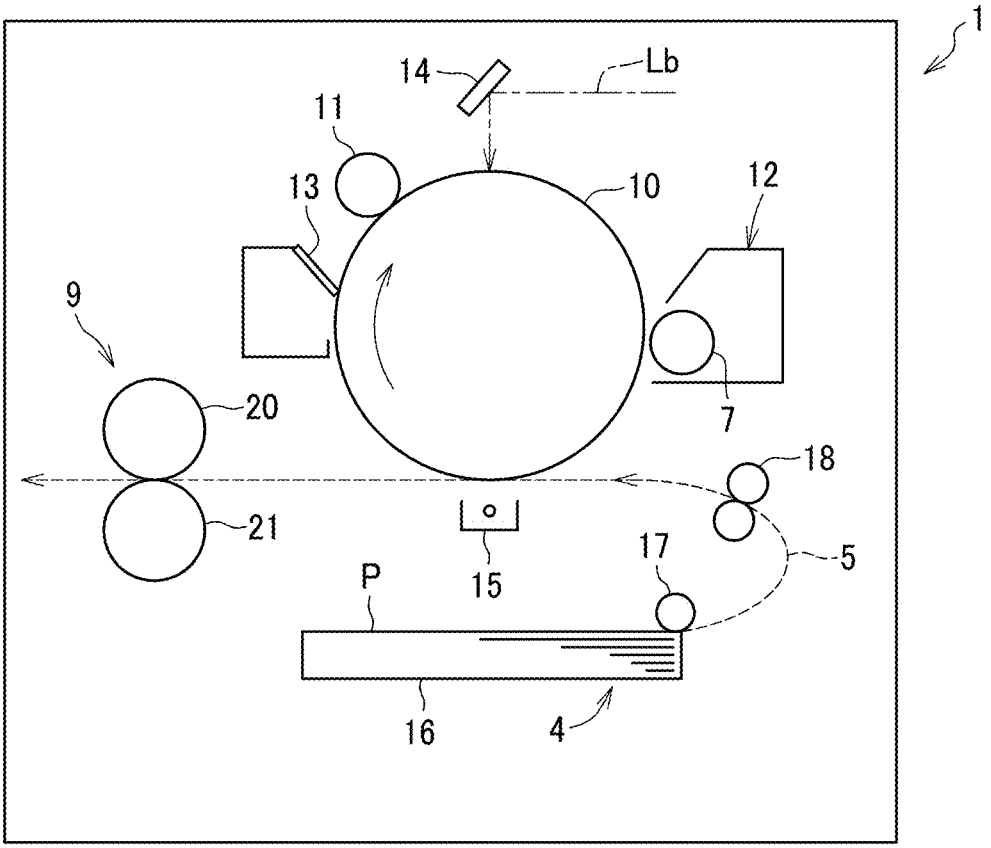
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure, and all of the components or elements described in the embodiments of this disclosure are not necessarily indispensable.

Referring to the drawings, embodiments of the present disclosure are described below. Identical reference numerals are assigned to identical components or equivalents and a description of those components is simplified or omitted. In the following description of each embodiment, a fixing device that fixes a toner image onto a sheet by heat is described as an example of a heating device.

As illustrated in FIG. 1, a monochrome image forming apparatus 1 includes a photoconductor drum 10. The photoconductor drum 10 is a drum-shaped rotator that bears toner as a developer of a toner image on an outer circumferential surface of the photoconductor drum 10 and rotates in a direction indicated by arrow in FIG. 1. Around the photoconductor drum 10, the image forming apparatus 1 includes a charging roller 11 to uniformly charge the surface of the photoconductor drum 10, a developing device 12 including a developing roller 7 to supply toner to the surface of the photoconductor drum 10, and a cleaning blade 13 to clean the surface of the photoconductor drum 10.

An exposure device is disposed above the photoconductor drum 10. The exposure device irradiates the surface of the photoconductor drum 10 with a laser light Lb based on image data via a mirror 14.

The image forming apparatus 1 includes a transfer device 15 including a transfer charger opposite the photoconductor drum 10. The transfer device 15 transfers a toner image on the surface of the photoconductor drum 10 to a sheet P.

A sheet feeder 4 is disposed in a lower portion of the image forming apparatus 1. The sheet feeder 4 includes a sheet tray 16, which contains sheets P as recording media, and a sheet feeding roller 17 to feed the sheets P from the sheet tray 16 to a conveyance path 5. Downstream from the sheet feeding roller 17 in a sheet conveyance direction, registration rollers 18 are disposed.

A fixing device 9 includes a fixing belt 20 heated by a heater described below and a pressure roller 21 to press the fixing belt 20.

Next, a description is given of a basic operation of the image forming apparatus 1 with reference to FIG. 1.

At the beginning of a print operation (i.e. an image forming operation), the photoconductor drum 10 rotates, and the charging roller 11 charges the surface of the photoconductor drum 10. Based on image data, the laser light L is emitted from the exposure device to the charged surface of the photoconductor drum 10, so that the electric potential at the emitted portions on the surface of the photoconductor drum 10 decreases to form an electrostatic latent image. The developing device 12 supplies toner to the electrostatic latent image formed on the surface of photoconductor drum 10 to visualize the electrostatic latent image into a toner image, that is, a developer image. The transfer device 15 transfers the toner image onto the sheet P, and the cleaning blade 13 removes the toner remaining on the photoconductor drum 10.

As the image forming operation starts, the sheet feeding roller 17 of the sheet feeder 4 disposed in the lower portion of the image forming apparatus 1 is driven and rotated to feed a sheet P from the sheet tray 16 toward the registration rollers 18 through the conveyance path 5.

The registration rollers 18 are controlled to convey the sheet P fed to the conveyance path 5 to an image transfer position at which the transfer device 15 faces the photoconductor drum 10 at a timing at which the sheet P meets the toner image formed on the surface of the photoconductor drum 10, and the transfer charger in the transfer device 15 applied a transfer bias transfers the toner image onto the sheet P at the image transfer position.

The sheet P bearing the toner image is conveyed to the fixing device 9 in which a fixing belt 20 and a pressure roller 21 fix the toner image onto the sheet P under heat and pressure. The sheet P bearing the fixed toner image thereon is separated from the fixing belt 20, conveyed by a conveyance roller pair disposed downstream from the fixing device 9, and ejected to an output tray disposed outside the image forming apparatus 1.

Next, a configuration of the fixing device 9 is described.

Figure 2:
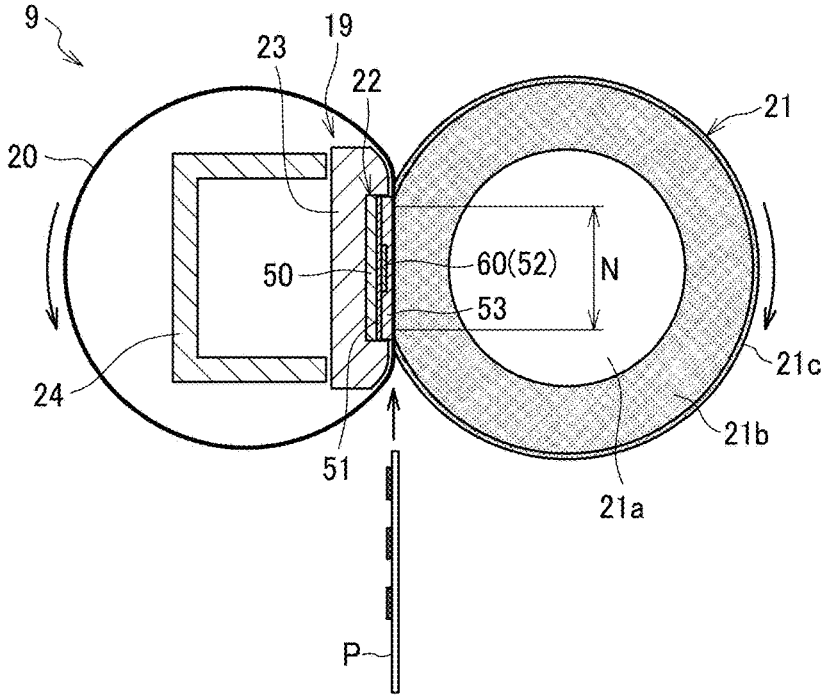
FIG. 2 is a schematic cross-sectional view of a fixing device incorporated in the image forming apparatus depicted in FIG. 1.

As illustrated in FIG. 2, the fixing device 9 according to the present embodiment includes a fixing belt 20 as a fixing rotator, a pressure roller 21 as an opposed rotator and a pressure rotator to contact an outer circumferential surface of the fixing belt 20 and form a nip N, and a heating unit 19 to heat the fixing belt 20. The heating unit 19 includes a laminated heater 22 as a heater, a heater holder 23 as a holder to hold the heater 22, and a stay 24 as a supporter to support the heater holder 23.

The fixing belt 20 is formed as an endless belt and includes, for example, a tubular base made of polyimide (PI), the tubular base having an outer diameter of 25 mm and a thickness of from 40 to 120 μm. The fixing belt 20 further includes a release layer serving as an outermost surface layer. The release layer is made of fluororesin, such as tetrafluoroethylene-perfluoroalkylvinylether copolymer (PFA) and polytetrafluoroethylene (PTFE), and has a thickness in a range of from 5 μm to 50 μm to enhance durability of the fixing belt 20 and facilitate separation of the sheet P and a foreign substance from the fixing belt 20. Optionally, an elastic layer that is made of rubber or the like and has a thickness in a range of from 50 micrometers to 500 micrometers may be interposed between the base and the release layer. The base of the fixing belt 20 may be made of heat-resistant resin such as polyetheretherketone (PEEK) or metal such as nickel (Ni) and steel use stainless (SUS), instead of polyimide. An inner circumferential surface of the fixing belt 20 may be coated with polyimide, PTFE, or the like to produce a slide layer.

A detailed description is now given of a construction of the pressure roller 21. The pressure roller 21 has an outer diameter of 25 mm, for example. The pressure roller 21 includes a cored bar 21*a*, an elastic layer 21*b*, and a release layer 21*c*. The cored bar 21*a* is solid and made of metal such as iron. The elastic layer 21*b* coats the cored bar 21*a*. The release layer 21*c* coats an outer surface of the elastic layer 21*b*. The elastic layer 21*b* is made of silicone rubber and has a thickness of 3.5 mm, for example. In order to facilitate separation of the sheet P and the foreign substance from the pressure roller 21, the release layer 21*c* that is made of fluororesin and has a thickness of about 40 micrometers, for example, is preferably disposed on the outer surface of the elastic layer 21*b*.

A spring serving as a biasing member causes the fixing belt 20 and the pressure roller 21 to press against each other. Thus, the fixing nip N is formed between the fixing belt 20 and the pressure roller 21. As a driving force is transmitted to the pressure roller 21 from a driver disposed in the body of the image forming apparatus 1, the pressure roller 21 serves as a drive roller that drives and rotates the fixing belt 20. The fixing belt 20 is thus driven and rotated by the pressure roller 21 as the pressure roller 21 rotates. When the fixing belt 20 rotates, the fixing belt 20 slides on the heater 22. Therefore, in order to facilitate sliding performance of the fixing belt 20, a lubricant such as oil or grease may be provided between the heater 22 and the fixing belt 20.

The heater 22 extends in a longitudinal direction thereof throughout an entire width of the fixing belt 20 in a rotation axis direction of the fixing belt 20, referred to as a longitudinal direction of the fixing belt 20 below. The heater 22 contacts the inner circumferential surface of the fixing belt 20 at a position corresponding to the pressure roller 21.

Alternatively, the heat generator 60 may be disposed on a surface of the base 50 facing the heater holder 23, that is, the surface opposite to a surface of the base 50 facing the fixing belt 20. In that case, since the heat of the heat generator 60 is transmitted to the fixing belt 20 through the base 50, it is preferable that the base 50 be made of a material with high thermal conductivity such as aluminum nitride. In the heater 22 according to the present embodiment, another insulation layer may be further disposed on a surface of the base 50 facing the heater holder 23, that is, the surface opposite to the surface of the base 50 facing the fixing belt 20.

The heater 22 may not contact the fixing belt 20 or may be disposed opposite the fixing belt 20 indirectly via a low friction sheet or the like. However, the heater 22 that contacts the fixing belt 20 directly as in the present embodiment enhances conduction of heat from the heater 22 to the fixing belt 20. The heater 22 may contact the outer circumferential surface of the fixing belt 20. However, if the outer circumferential surface of the fixing belt 20 is brought into contact with the heater 22 and damaged, the fixing belt 20 may degrade quality of fixing the toner image on the sheet P. Hence, preferably, the heater 22 contacts the inner circumferential surface of the fixing belt 20.

The heater holder 23 and the stay 24 are disposed inside a loop of the fixing belt 20. The stay 24 includes a channel made of metal. Both lateral ends of the stay 24 in a longitudinal direction thereof are supported by side walls of the fixing device 9, respectively. The stay 24 supports a stay side face of the heater holder 23, that faces the stay 24 and is opposite a heater side face of the heater holder 23, that faces the heater 22. Accordingly, the stay 24 retains the heater 22 and the heater holder 23 to be immune from being bent substantially by pressure from the pressure roller 21, forming the fixing nip N between the fixing belt 20 and the pressure roller 21.

Since the heater holder 23 is subject to temperature increase by heat from the heater 22, the heater holder 23 is preferably made of a heat-resistant material. The heater holder 23 made of heat-resistant resin having low thermal conduction, such as a liquid crystal polymer (LCP), reduces heat transfer from the heater 22 to the heater holder 23 and provides efficient heating of the fixing belt 20.

As a print job starts, the heater 22 supplied with power causes the heat generator 60 to generate heat, thus heating the fixing belt 20. The motor drives and rotates the pressure roller 21, and the fixing belt 20 starts rotating with the rotation of the pressure roller 21. When the temperature of the fixing belt 20 reaches a predetermined target temperature called a fixing temperature, as illustrated in FIG. 2, the sheet P bearing an unfixed toner image is conveyed to the nip N between the fixing belt 20 and the pressure roller 21 in a direction indicated by arrow A in FIG. 2, and the unfixed toner image is heated and pressed onto the sheet P and fixed thereon.

Figure 3:
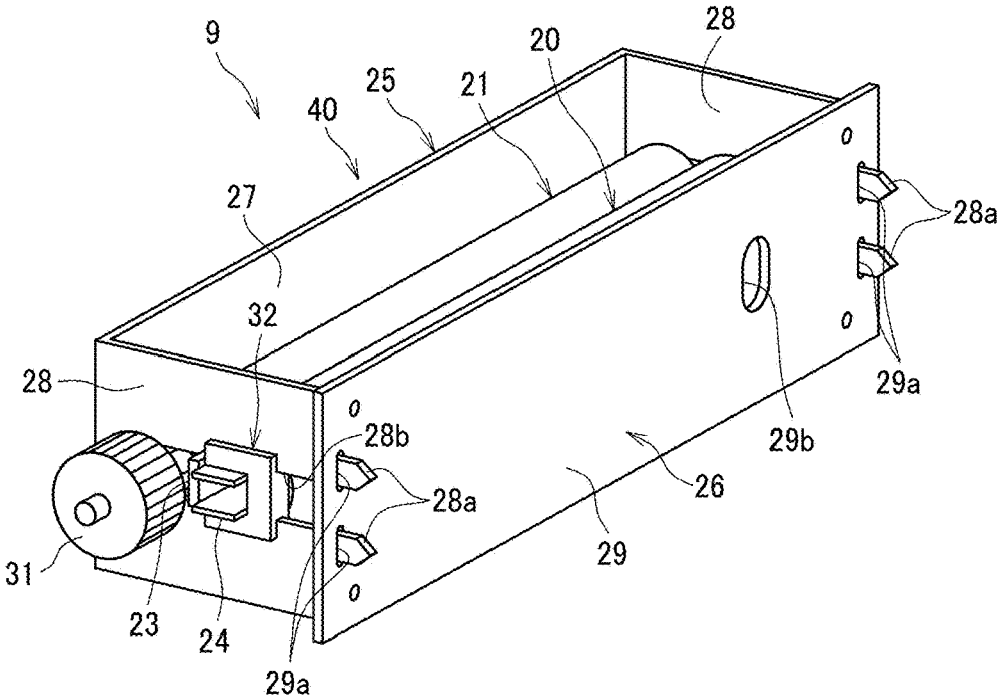
FIG. 3 is a perspective view of the fixing device depicted in FIG. 2.
Figure 4:
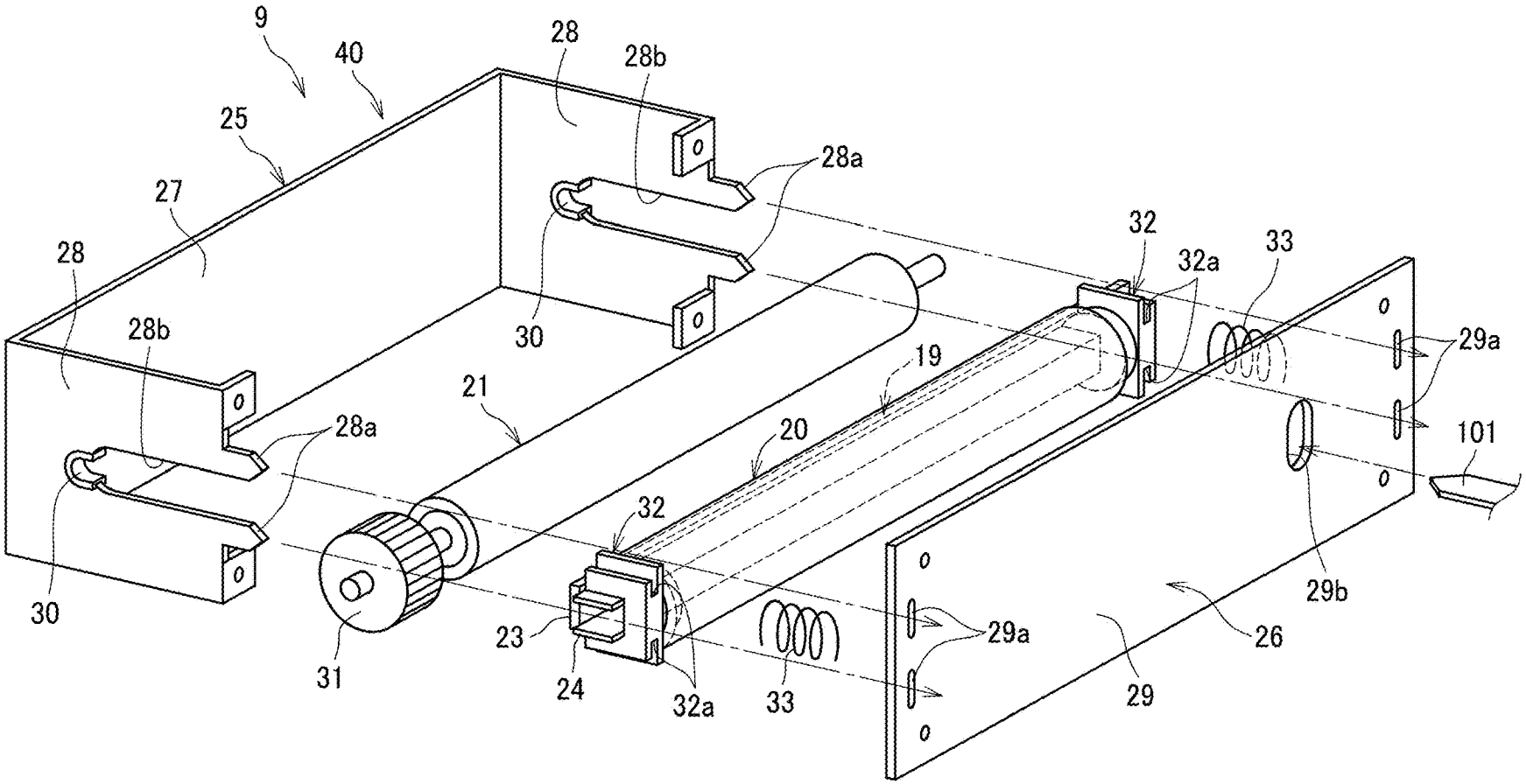
FIG. 4 is an exploded perspective view of the fixing device depicted in FIG. 2.

FIG. 3 is a perspective view of the fixing device 9. FIG. 4 is an exploded perspective view of the fixing device 9.

As illustrated in FIGS. 3 and 4, the fixing device 9 includes a device frame 40 that includes a first device frame 25 and a second device frame 26. The first device frame 25 includes a pair of side walls 28 and a front wall 27. The second device frame 26 includes a rear wall 29. The pair of side walls 28 are disposed on the outside of one end and the other end of the fixing belt 20 in the longitudinal direction of the fixing belt 20. The side walls 28 support both sides of each of the pressure roller 21 and the heating unit 19, respectively. In addition, the side walls 28 indirectly support both sides of the fixing belt 20. Each of the side walls 28 includes a plurality of engaging projections 28*a*. As the engaging projections 28*a* engage corresponding engaging holes 29*a* in the rear wall 29, the first device frame 25 is coupled to the second device frame 26.

Each of the side walls 28 includes a slot 28*b* through which a rotation shaft and the like of the pressure roller 21 are inserted. The slot 28*b* opens toward the rear wall 29 and closes at a portion opposite the rear wall 29, and the portion of the slot 28*b* opposite the rear wall 29 serves as a contact portion. A bearing 30 that supports the rotation shaft of the pressure roller 21 is disposed at an end of the contact portion. As both sides of the rotation shaft of the pressure roller 21 are attached to the corresponding bearings 30, the side walls 28 rotatably support the pressure roller 21.

A drive transmission gear 31 serving as a drive transmitter is disposed at one side of the rotation shaft of the pressure roller 21 in an axial direction thereof. In a state in which the side walls 28 support the pressure roller 21, the drive transmission gear 31 is exposed outside the side wall 28. Accordingly, when the fixing device 9 is installed in the body of the image forming apparatus 1, the drive transmission gear 31 is coupled to a gear disposed inside the body of the image forming apparatus 1 so that the drive transmission gear 31 transmits the driving force from the driver to the pressure roller 21. Alternatively, the drive transmitter to transmit the driving force to the pressure roller 21 may be pulleys over which a driving force transmission belt is stretched taut, a coupler, and the like instead of the drive transmission gear 31.

A pair of end supports 32 that supports the fixing belt 20, the heater holder 23, the stay 24, and the like is disposed at both ends of the heating unit 19 in a longitudinal direction thereof, respectively. Each end support 32 has guide grooves 32*a*. As edges of the slot 28*b* of the side wall 28 enter the guide grooves 32*a*, respectively, the end support 32 is attached to the side wall 28.

A pair of springs 33 serving as a pair of biasing members is interposed between each of the end supports 32 and the rear wall 29. As the springs 33 bias the end supports 32 and the stay 24 toward the pressure roller 21, respectively, the fixing belt 20 is pressed against the pressure roller 21 to form the fixing nip between the fixing belt 20 and the pressure roller 21.

As illustrated in FIG. 4, a hole 29*b* is disposed near one end of the rear wall 29 of the second device frame 26 in a longitudinal direction of the second device frame 26. The hole 29*b* serves as a positioner of the fixing device 9 that positions the body of the fixing device 9 with respect to the body of the image forming apparatus 1. Similarly, the body of the image forming apparatus 1 includes a projection 101 as a positioner fixed on the image forming apparatus 1. The projection 101 is inserted into the hole 29*b* of the fixing device 9. Accordingly, the projection 101 engages the hole 29*b*, positioning the body of the fixing device 9 with respect to the body of the image forming apparatus 1 in the longitudinal direction of the fixing belt 20. Although the hole 29*b* serving as the positioner is disposed near one end of the rear wall 29 in the longitudinal direction of the second device frame 26, a positioner is not disposed near another end of the rear wall 29. Thus, the second device frame 26 does not restrict thermal expansion and shrinkage of the body of the fixing device 9 in the longitudinal direction of the fixing belt 20 due to temperature change.

Figure 5:
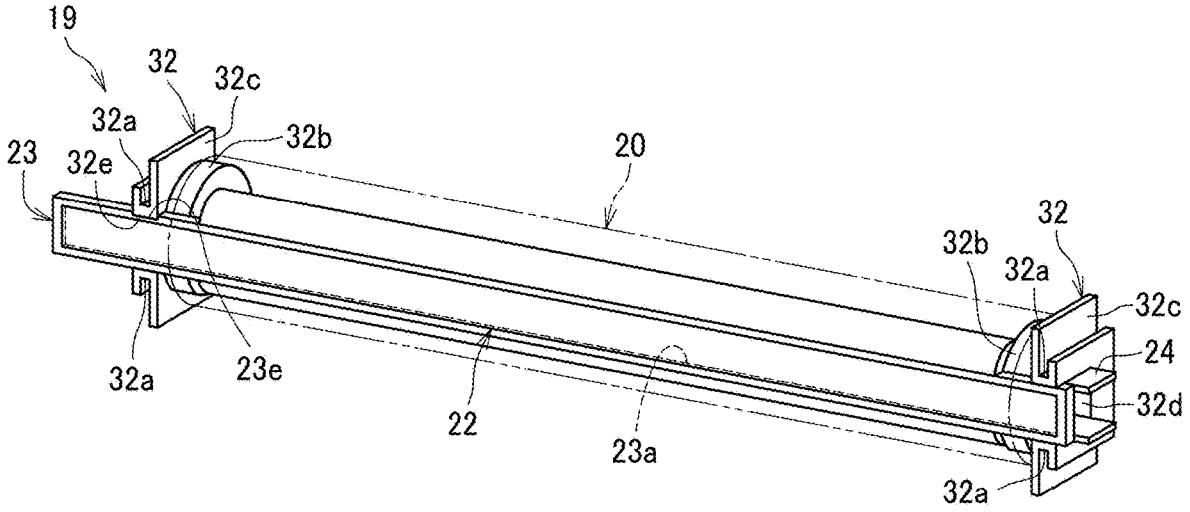
FIG. 5 is a perspective view of a heating unit incorporated in the fixing device depicted in FIG. 2.
Figure 6:
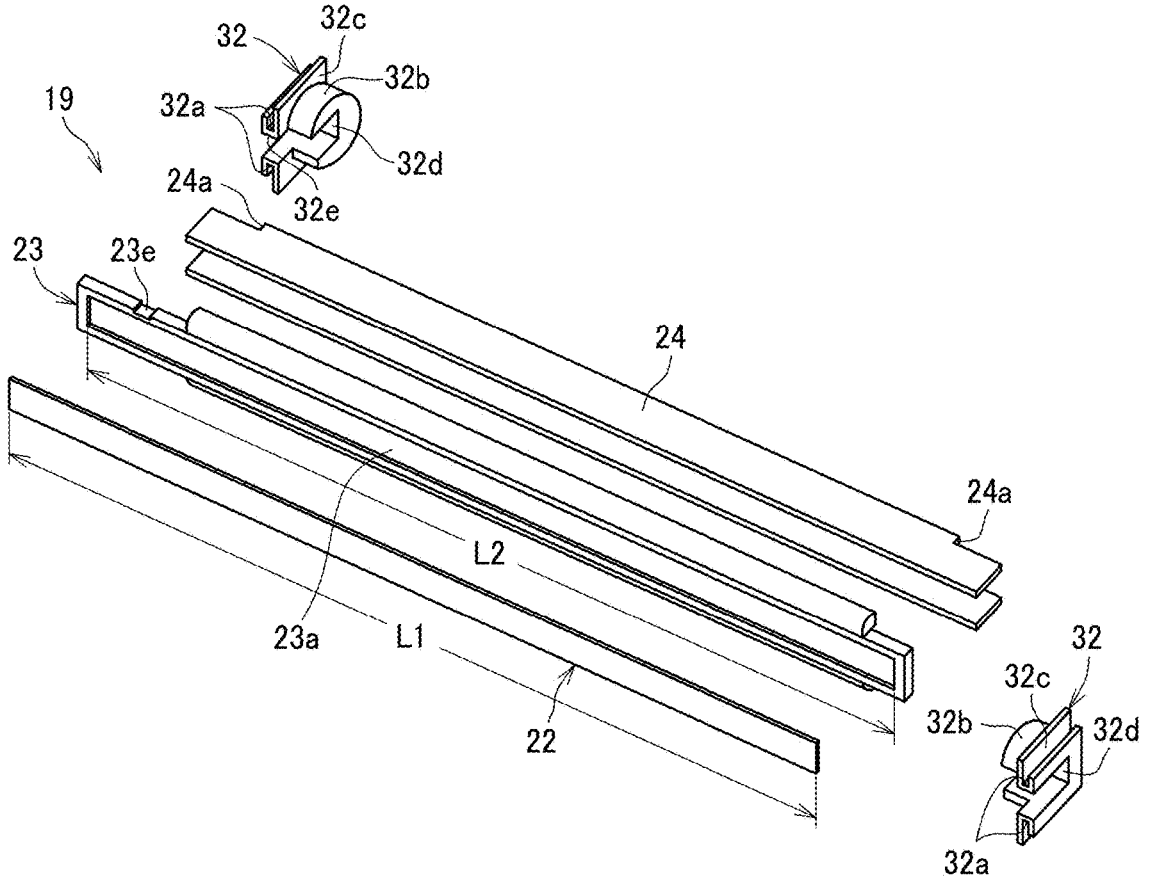
FIG. 6 is an exploded perspective view of the heating unit depicted in FIG. 5.

FIG. 5 is a perspective view of the heating unit 19. FIG. 6 is an exploded perspective view of the heating unit 19.

As illustrated in FIGS. 5 and 6, the heater holder 23 includes an accommodating recess 23*a* disposed on a fixing belt side face of the heater holder 23, that is a face in front side of FIGS. 5 and 6. The accommodating recess 23*a* is rectangular and accommodates the heater 22. The accommodating recess 23*a* has a similar shape and size of the heater 22, but a length L2 of the accommodating recess 23*a* in the longitudinal direction of the heater holder 23 is set slightly longer than a length L1 of the heater 22 in the longitudinal direction of the heater 22. The accommodating recess 23*a* formed slightly longer than the heater 22 does not interfere the heater 22 even when the heater 22 expands in the longitudinal direction due to thermal expansion. The accommodating recess 23*a* accommodates the heater 22, and the heater 22 is sandwiched by the heater holder 23 and a connector as a power supplying member described below, thus the heater 22 is held.

In addition to the guide grooves 32*a* described above, each of the pair of end supports 32 includes a belt support 32*b*, a belt restrictor 32*c*, and a supporting recess 32*d*. The belt support 32*b* is C-shaped and inserted into the loop of the fixing belt 20, thus contacting the inner circumferential surface of the fixing belt 20 to support the fixing belt 20. The belt restrictor 32*c* is a flange that contacts an edge face of the fixing belt 20 to restrict motion (e.g., skew) of the fixing belt 20 in the longitudinal direction of the fixing belt 20. The supporting recess 32*d* is inserted with a lateral end of each of the heater holder 23 and the stay 24 in the longitudinal direction thereof, thus supporting the heater holder 23 and the stay 24. As the belt support 32*b* is inserted into the loop formed by the fixing belt 20 on each axial end side of the fixing belt 20, the fixing belt 20 is supported by a free belt system in which the fixing belt 20 is not stretched basically in a circumferential direction of the fixing belt 20, which is a rotation direction of the fixing belt 20, while the fixing belt 20 does not rotate.

As illustrated in FIGS. 5 and 6, the heater holder 23 includes a positioning recess 23*e* as a positioner disposed near one end of the heater holder 23 in the longitudinal direction thereof. The end support 32 further includes an engagement 32*e* illustrated in a left part in FIGS. 5 and 6. The engagement 32*e* engages the positioning recess 23*e*, positioning the heater holder 23 with respect to the end support 32 in the longitudinal direction of the fixing belt 20. The end support 32 illustrated in a right part in FIGS. 5 and 6 does not include the engagement 32*e* and therefore the heater holder 23 is not positioned with respect to the end support 32 in the longitudinal direction of the fixing belt 20. Positioning the heater holder 23 with respect to the end support 32 near one end of the heater holder 23 in the longitudinal direction of the fixing belt 20 does not restrict an expansion and contraction of the heater holder 23 in the longitudinal direction of the fixing belt 20 due to a temperature change.

As illustrated in FIG. 6, the stay 24 includes step portions 24*a* at both ends in the longitudinal direction of the stay 24 to set the stay 24 on the end supports 32. Each step portion 24*a* abuts the end support 32 to restrict movement of the stay 24 in the longitudinal direction with respect to the end support 32. However, at least one of the step portions 24*a* is arranged to have a gap, that is, loose fit with play between the step portion 24*a* and the end support 32. The above-described arrangement of the gap between the end support 32 and at least one of the step portions 24*a* does not restrict thermal expansion or shrinkage of the stay 24 in the longitudinal direction of the fixing belt 20 caused by changes in temperature.

Figure 7:
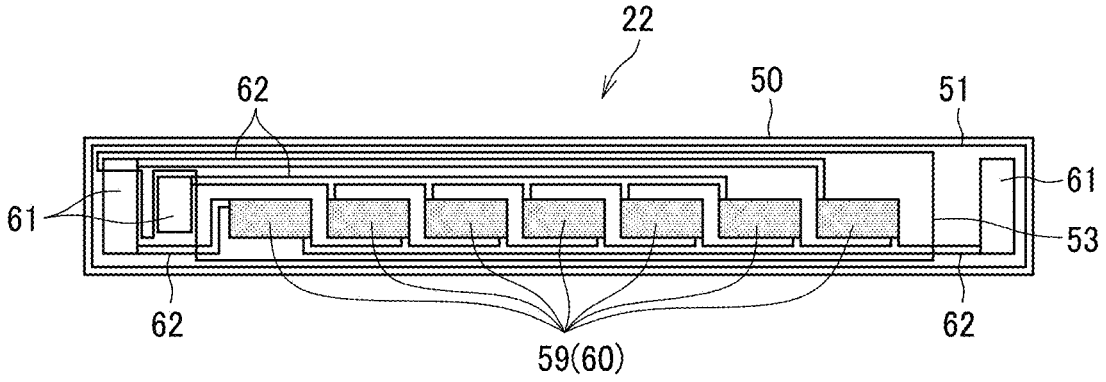
FIG. 7 is a plan view of a heater incorporated in the heating unit depicted in FIG. 5.
Figure 8:
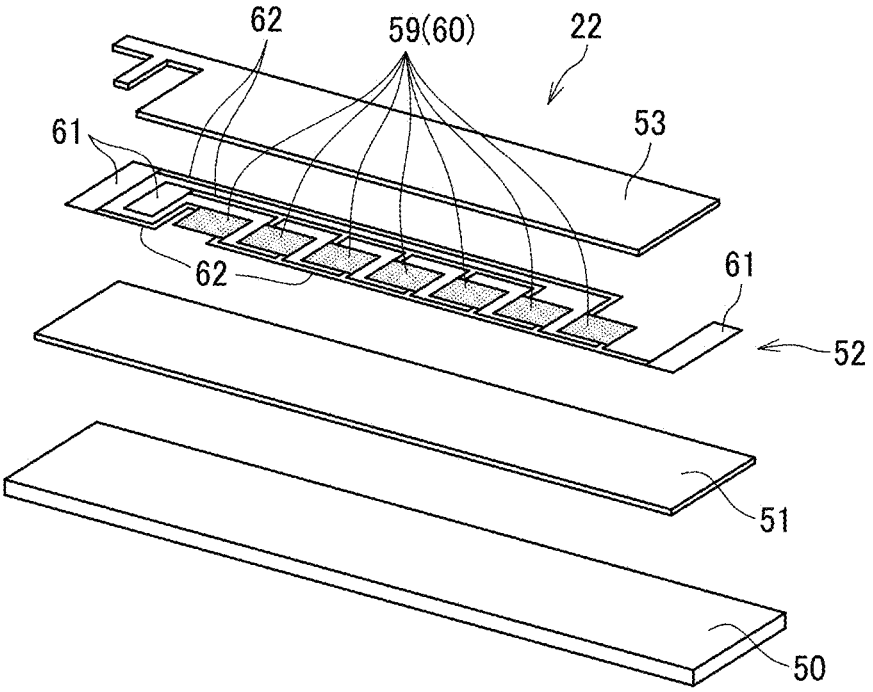
FIG. 8 is an exploded perspective view of the heater depicted in FIG. 7.

FIG. 7 is a plan view of the heater 22. FIG. 8 is an exploded perspective view of the heater 22.

As illustrated in FIG. 8, the heater 22 includes the base 50, a first insulation layer 51 disposed on the base 50, a conductor layer 52 disposed on the first insulation layer 51, and a second insulation layer 53 that covers the conductor layer 52. The conductor layer 52 includes the heat generator 60. In the present embodiment, the base 50, the first insulation layer 51, the conductor layer 52 including the heat generator 60, and the second insulation layer 53 are layered in this order toward the fixing belt 20, that is, the nip N. Heat generated from the heat generator 60 is transmitted to the fixing belt 20 via the second insulation layer 53 (see FIG. 2).

The base 50 is a long plate made of a metal such as stainless steel (SUS), iron, or aluminum. The base 50 may be made of ceramic, glass, etc. instead of metal. If the base 50 is made of an insulating material such as ceramic, the first insulation layer 51 sandwiched between the base 50 and the conductor layer 52 may be omitted. Since metal has an enhanced durability against rapid heating and is processed readily, metal is preferably used to reduce manufacturing costs. Among metals, aluminum and copper are preferable because aluminum and copper have high thermal conductivity and are less likely to cause uneven temperature. Stainless steel is advantageous because stainless steel is manufactured at reduced costs compared to aluminum and copper.

The first insulation layer 51 and the second insulation layer 53 are made of material having electrical insulation, such as heat-resistant glass. Alternatively, each of the first insulation layer 51 and the second insulation layer 53 may be made of ceramic, polyimide (PI), or the like.

The conductor layer 52 includes the heat generator 60, a plurality of electrodes 61, and a plurality of power supply lines 62. The heat generator 60 includes resistive heat generators 59 arranged in the longitudinal direction of the heater 22. The plurality of power supply lines 62 serves as a plurality of conductors that electrically connects the heat generator 60 and the plurality of electrodes 61. Each of the resistive heat generators 59 is electrically connected to any two of the three electrodes 61 in parallel to each other via the plurality of power supply lines 62 disposed on the base 50.

Thus, the resistive heat generators 59 are electrically connected in parallel to each other.

The heat generator 60 is produced by, for example, mixing silver-palladium (AgPd), glass powder, and the like into a paste. The paste is coated on the base 50 by screen printing or the like. Thereafter, the base 50 is fired to form the heat generator 60. Alternatively, the heat generator 60 may be made of a resistive material such as a silver alloy (AgPt) and ruthenium oxide (RuO2).

Each of the power supply lines 62 are made of a conductor having an electrical resistance lower than that of the heat generator 60. Silver (Ag), silver palladium (AgPd) or the like may be used as a material of the power supply lines 62 or the electrodes 61, and screen-printing such a material forms the power supply lines 62 or the electrodes 61.

Figure 9:
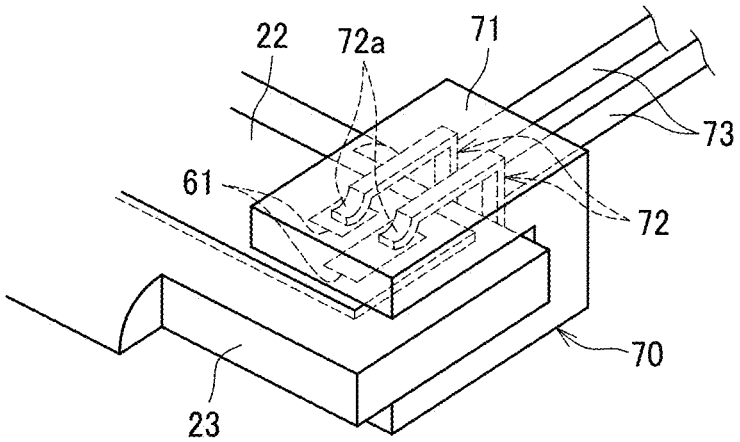
FIG. 9 is a perspective view illustrating the connector connected to the heater, according to the embodiment of the present disclosure.

FIG. 9 is a perspective view illustrating a connector 70 connected to the heater 22.

As illustrated in FIG. 9, the connector 70 includes a housing 71 made of resin and a plurality of contact terminals 72 fixed to the housing 71. Each contact terminal 72 is configured by a flat spring and connected to a power supply harness 73.

As illustrated in FIG. 9, the connector 70 is attached to the heater 22 and the heater holder 23 such that a front side of the heater 22 and the heater holder 23 and a back side of the heater 22 and the heater holder 23 are sandwiched by the connector 70. Thus, contact portions 72*a* disposed at ends of the contact terminals 72 elastically contact and press against the electrodes 61 each corresponding to the contact terminals 72, and the heat generator 60 is electrically connected to the power supply provided in the image forming apparatus via the connector 70. The above-described configuration enables the power supply to supply power to the heat generator 60. Note that, as illustrated in FIG. 7, at least part of each of the electrodes 61 is not coated by the second insulation layer 53 and therefore exposed to secure connection with the corresponding connector 70.

Figure 10:
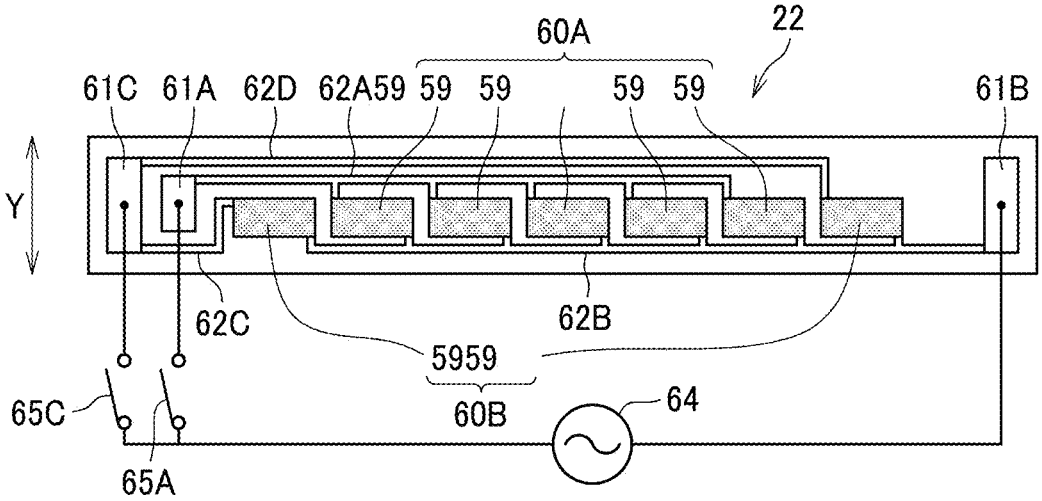
FIG. 10 is a schematic diagram illustrating a circuit to supply power to the heater according to the embodiment of the present disclosure.

As illustrated in FIG. 10, in the present embodiment, the heat generator 60 includes a plurality of resistive heat generators 59 arranged in the longitudinal direction of the base 50 including a first heat generator group 60A serving as a heat generation part and a second heat generator group 60B serving as another heat generation part. The first heat generator group 60A is a first group of the resistive heat generators 59, which are other than the resistive heat generators 59 on the ends of the plurality of resistive heat generators 59 arranged in the longitudinal direction of the base 50. The second heat generator group 60B is a second group of the resistive heat generators 59, which are arranged on both end portions of the heater 22 and distinct from the resistive heat generators 59 of the first heat generator group 60A. The first heat generator group 60A and the second heat generator group 60B are separately controllable to generate heat. Specifically, each of the resistive heat generators 59 constructing the first heat generator group 60A (i.e., the resistive heat generators 59 other than the resistive heat generators 59 arranged on the ends) is connected, through a first power supply line 62A, to a first electrode 61A provided on a first longitudinal end side of the base 50. Each of the resistive heat generators 59 constructing the first heat generator group 60A is also connected, through a second power supply line 62B, to a second electrode 61B provided on a second longitudinal end side of the base 50 opposite the first longitudinal end side of the base 50 on which the first electrode 61A is provided. On the other hand, each of the resistive heat generators 59 constructing the second heat generator group 60B (i.e., the resistive heat generators 59 on the ends) is connected, through a third power supply line 62C or a fourth power supply line 62D, to a third electrode 61C (different from the first electrode 61A) provided on the first longitudinal end side of the base 50. Like each of the resistive heat generators 59 of the first heat generator group 60A, each of the resistive heat generators 59 arranged on the ends is also connected to the second electrode 61B through the second power supply line 62B.

The electrodes 61A to 61C are connected to a power supply 64 via the connector 70 described above and supplied with power from the power supply 64. A switch 65A as a switching unit is disposed between the electrode 61A and the power supply 64. Turning the switch 65A on and off can switch whether a voltage is applied to the electrode 61A. Similarly, a switch 65C as a switching unit is disposed between the electrode 61C and the power supply 64. Turning the switch 65C on and off can switch whether the voltage is applied to the electrode 61C.

Applying the voltage to the first electrode 61A and the second electrode 61B energizes the resistive heat generators 59 other than the end resistive heat generators 59, and the first heat generator group 60A generates heat alone. On the other hand, applying the voltage to the second electrode 61B and the third electrode 61C energizes the end resistive heat generators 59, and the second heat generator group 60B generates heat alone. When the voltage is applied to all the first to third electrodes 61A to 61C, the resistive heat generators 59 of both the first heat generator group 60A and the second heat generator group 60B (i.e., all the resistive heat generators 59) generate heat. For example, the first heat generator group 60A generates heat alone to fix the toner image on a sheet P having a relatively small width conveyed, such as the sheet P of A4 size (sheet width: 210 mm) or a smaller sheet P, and the second heat generator group 60B generates heat together with the first heat generator group 60A to fix a toner image on a sheet P having a relatively large width conveyed, such as a sheet P larger than A4 size (sheet width: 210 mm). As a result, the heater 22 can generate heat in a heat generation area corresponding to the sheet conveyance span.

One approach to further downsize the image forming apparatus and the fixing device is downsizing the heater, which is one of the components disposed inside a loop formed by the fixing belt. That is, downsizing the heater in a short-side direction of the heater can downsize the fixing belt and, as a result, downsize the fixing device and the image forming apparatus. Note that the short-side direction of the heater is a direction indicated by arrow Y in FIG. 10, a direction intersecting the longitudinal direction of the heater 22 along the surface of the heater 22 on which the first heat generator group 60A and the second heat generator group 60B are provided in FIG. 10. Specifically, the following three methods are considered as examples of methods to downsize the heater in the short-side direction of the heater.

A first method is downsizing the heat generator group (i.e., resistive heat generators) in the short-side direction of the heater. However, downsizing the heat generator group in the short-side direction of the heater narrows a heating span over which the fixing belt is heated, resulting in an increase in the temperature peak of the heater to maintain the same amount of heat applied to the fixing belt as the amount of heat applied before the heating span is narrowed. The increase in the temperature peak of the heater may cause the temperature of an overheating detector such as a thermostat or a fuse disposed on a back surface of the heater to exceed a heat resistant temperature. Alternatively, the increase in the temperature peak of the heater may cause malfunction of the overheating detector. In addition, the increase in the temperature peak of the heater also reduces the efficiency of heat conduction from the heater to the fixing belt. Therefore, the increase in the temperature peak of the heater is unfavorable from the viewpoint of energy efficiency. As described above, downsizing the heat generator group in the short-side direction of the heater is hardly adopted.

A second method is downsizing, in the short-side direction of the heater, parts of the heater that are not the heat generator groups, the electrodes, and the power supply lines. However, this method shortens a distance between the heat generator group and the power supply line or between the electrode and the power supply line, thus failing to secure the insulation. Considering the structure of the current heater, it is difficult to further shorten the distance between the heat generator group and the power supply line or between the electrode and the power supply line.

The remaining third method is to reduce the size of the power supply line in the short-side direction of the heater. This method has room for implementation as compared with the above two methods. However, reducing the size of the power supply line in the short-side direction increases the resistance value of the power supply line. Therefore, an unintended shunt may occur on a conductive path of the heater. In particular, if a resistance value of the heat generator group is reduced to increase the amount of heat generated by the heat generator to speed up the image forming apparatus, the resistance value of the power supply lines and the resistance value of the heat generator group get relatively close to each other. In such a situation, an unintended shunt tends to occur. In order to prevent such an unintended shunt, the power supply lines may be upsized in a thickness direction of the heater (i.e., direction intersecting the longitudinal and short-side directions of the heater) while being downsized in the short-side direction of the heater. Such a configuration secures the cross-sectional area of the power supply lines and prevents an increase in resistance value of the power supply lines. However, in such a case, the screen printing of the power supply lines is difficult, resulting in a change of the way of forming the power supply lines. Therefore, thickening the power supply lines is hardly adopted as a solution. In conclusion, in order to downsize the heater in the short-side direction of the heater, the power supply lines are downsized in the short-side direction of the heater in anticipation of an increase in resistance value, while a measure is taken against the unintended shunt that may be caused by downsized power supply lines.

Hereinafter, referring now to FIGS. 11 to 14, a description is given of the unintended shunt and adverse effects of the unintended shunt in the heater 22 described above.

Figure 11:
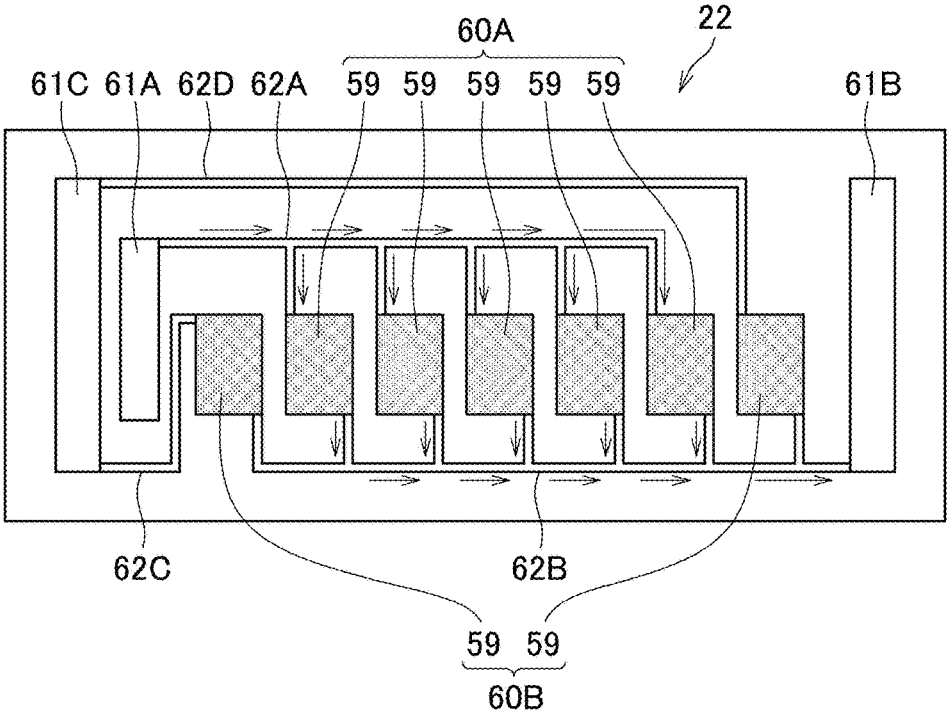
FIG. 11 is a schematic view illustrating typical current paths in the heater depicted in FIG. 7.

In the heater 22 illustrated in FIG. 11, applying the voltage to the first electrode 61A and the second electrode 61B typically generates a current that flows through the first power supply line 62A, passes through each of the resistive heat generators 59 other than the resistive heat generators 59 located on the both ends of the heater 22, and then flows through the second power supply line 62B, and the resistive heat generators 59 of the first heat generator group 60A alone generate heat.

Figure 12:
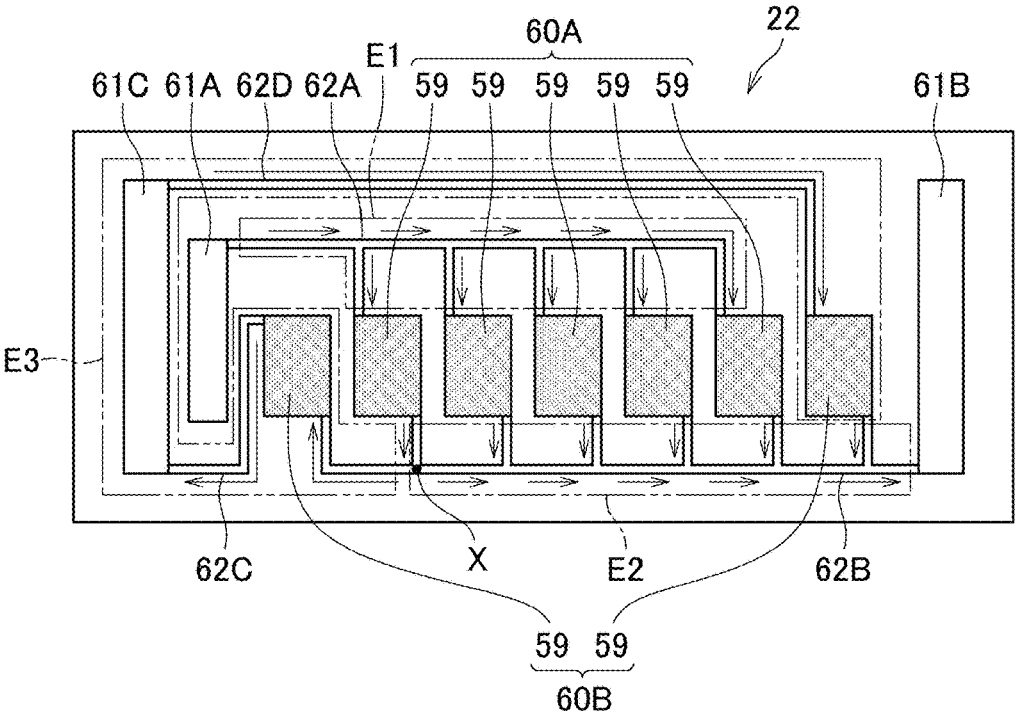
FIG. 12 is a schematic view illustrating current paths in the heater depicted in FIG. 7 in which an unintended shunt occurs.

However, as illustrated in FIG. 12, the unintended shunt occurs in current paths when increase in resistance values of the power supply lines to downsize the heater 22 as described above and decrease in resistance values of the heat generator groups to increase the heat generation amount of the heater 22 decrease the differences between the resistance values of the power supply lines and the heat generator groups. Specifically, part of the current passing through the second resistive heat generator 59 from the left in FIG. 12 does not flow to the second electrode 61B from a branch X of the second power supply line 62B to which the current flow from the second resistive heat generator 59, but flows opposite side of the second electrode 61B from the branch X. The shunted current then passes through the resistive heat generator 59 arranged on the left end in FIG. 12 and further passes through the third power supply line 62C, the third electrode 61C, the fourth power supply line 62D, and the resistive heat generator 59 arranged on the right end in FIG. 12 in this order. Finally, the current joins the second power supply line 62B.

As described above, in the heater 22 illustrated in FIG. 12, a shunted current path E3 through which the unintended shunt flows includes a part of the second power supply line 62B extending from the branch X to the left in FIG. 12, the resistive heat generators 59 on the ends constructing the second heat generator group 60B, the third electrode 61C, the third power supply line 62C, and the fourth power supply line 62D.

The above-described unintended shunt may occur when the first heat generator group 60A is energized as long as the heater 22 includes a conductive path including at least a first conductive portion E1, a second conductive portion E2, and the shunted current path E3. The first conductive portion E1 connects the first heat generator group 60A and the first electrode 61A. The second conductive portion E2 extends from the first heat generator group 60A in one direction (i.e., to the right in FIG. 12) of a longitudinal direction of the heater 22 to connect the first heat generator group 60A and the second electrode 61B. The shunted current path E3 separates from the second conductive portion E2 in another direction (i.e., to the left in FIG. 12) opposite the one direction and is connected to the second conductive portion E2 or the second electrode 61B without passing through the first conductive portion E1. In the present embodiment, the shunted current path E3 includes the second heat generator group 60B and the third electrode 61C. However, the unintended shunt may occur even on a conductive path without the second heat generator group 60B or the third electrode 61C, or a conductive path provided with a conductor other than the second heat generator group 60B and the third electrode 61C.

Figure 13:
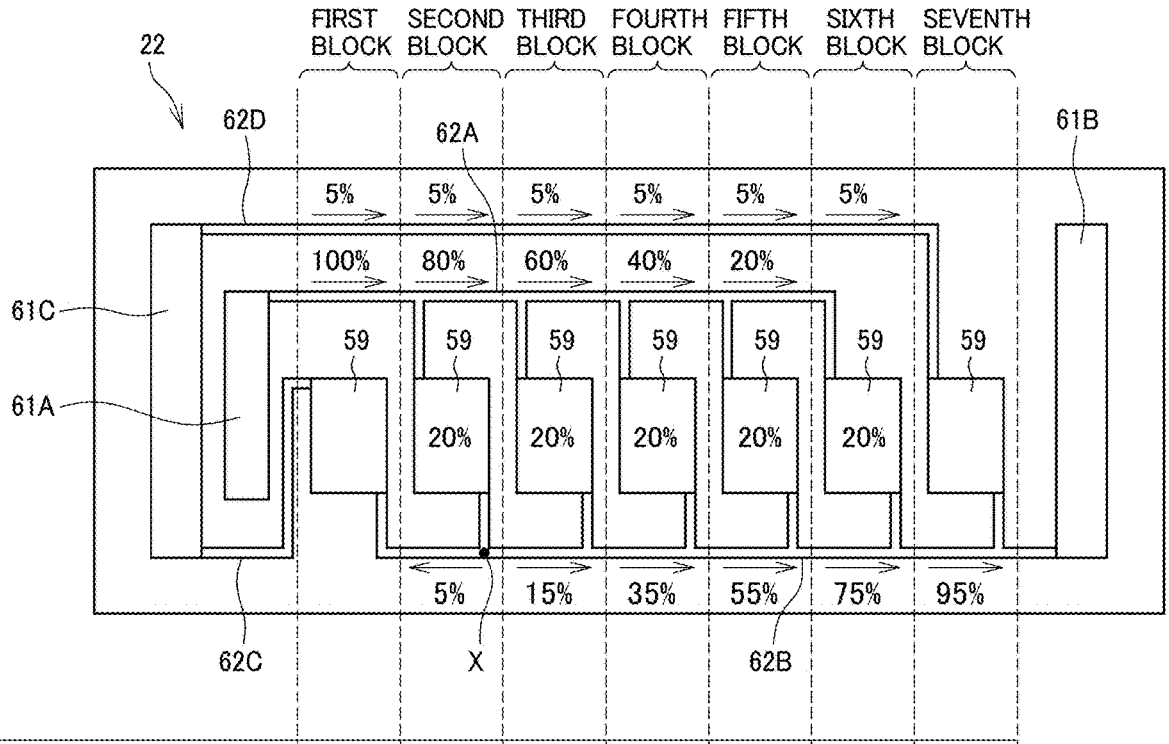
FIG. 13 is a schematic view illustrating heat generation amounts generated by power supply lines in each block of the heater depicted in FIG. 7 in which the unintended shunt occurs.

The unintended shunt is a current flowing through an unexpected path and causes heat generation of the power supply lines in the unexpected path, and the heat generation causes a variation in the temperature distribution of the heater 22. For example, in the heater 22 illustrated in FIG. 13, 20% of a current from the first electrode 61A flows equally through each of the resistive heat generators 59 of the first heat generator group 60A. FIG. 13 illustrates a case in which 5% of a current passing through the second resistive heat generator 59 from the left in FIG. 13 flows from the branch X to the third electrode 61C, and the table in FIG. 13 illustrates heat generation amounts in each of the power supply lines in each block that is separated so as to include each resistive heat generator 59.

Since the portion of each power supply line extending in the short-side direction of the heater 22 is relatively short and therefore the heat generation amount generated in the shorter portion is relatively small, the heat generation amount in the shorter portion is eliminated. The table illustrated in FIG. 13 simply indicates the calculated heat generation amounts generated in a longer portion of each power supply line extending in the longitudinal direction of the heater 22. Specifically, the table illustrates calculated heat generation amounts in portions extending in the longitudinal direction of the heater 22 in the first power supply line 62A, the second power supply line 62B, and the fourth power supply line 62D. Since a heat generation amount (W) is represented by the following equation (1), each of the heat generation amounts indicated in the table of FIG. 13 is calculated as the square of a current (I) flowing through each of the power supply lines for convenience. Therefore, the numerical values of the heat generation amounts indicated in the table of FIG. 13 are merely values calculated simply and may be different from the actual heat generation amount.

Equation (1)

$$W=R\times I^2, \quad (1)$$

where W represents the heat generation amount, R represents the resistance, and I represents the current.

A description is given of a specific calculation method of the heat generation amounts illustrated in FIG. 13. In the first block in FIG. 13, a proportion of a current flowing through the fourth power supply line 62D to a current flowing through the first power supply line 62A is 5%, and a proportion of the current flowing through the first power supply line 62A is expressed as 100%. Therefore, the total heat generation amount generated by the first power supply line 62A and the fourth power supply line 62D in the first block is expressed as 10025, which is the total value of the square of 100 (i.e., 10000) and the square of 5 (i.e., 25). In the second block, a proportion of a current flowing through the first power supply line 62A is 80%, a proportion of a current flowing through the second power supply line 62B is 5%, and a proportion of a current flowing through the fourth power supply line 62D is 5%. Therefore, the total heat generation amount of the power supply lines 62A, 62B, and 62D in the second block is expressed as 6450 (6400+25+25), which is the sum of the squares of the above-described proportions of the currents. The heat generation amounts in other blocks are similarly calculated.

Figure 14:
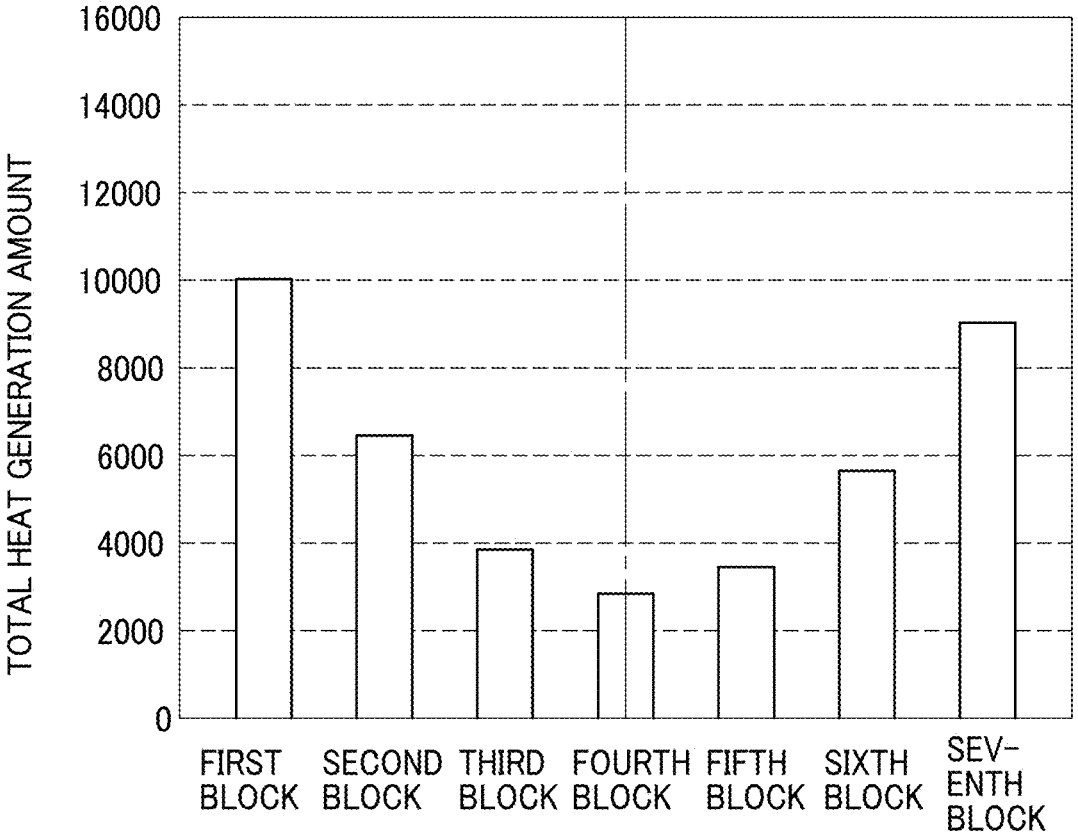
FIG. 14 is a graph illustrating the total heat generation amount generated by the power supply lines in each block of the heater illustrated in FIG. 13.

FIG. 14 is a graph based on the table of FIG. 13. The x-axis represents blocks in FIG. 13, and the y-axis represents the total heat generation amounts described above in the blocks. As illustrated in FIG. 14, the above-described unintended shunt affects the total heat generation amount in each block, and the distribution of the total heat generation amounts becomes a lateral asymmetrical shape with respect to the fourth block located in the center of the heat generation area.

Similarly, when all the heat generator groups of the heater 22 according to the present embodiment are energized, that is, even when the above-described shunt is not generated, a lateral difference of currents flowing through the conductive portions occurs in the longitudinal direction, and the distribution of the total heat generation amounts in the longitudinal direction of the heater 22 becomes asymmetrical shape. A factor generating the asymmetrical shape as described above is, for example, a difficulty of designing the distribution of the heat generation amounts in the longitudinal direction of the heater 22 to be a lateral symmetrical shape because downsizing the heater 22 limits an arrangement of the electrodes and the conductive portions. In particular, increasing currents flowing through the resistive heat generators to increase the speed of the image forming apparatus increases the amounts of heat generated in the conductive portions. Therefore, the heat generated in the conductive portions affects the distribution of the heat generation amounts and causes the asymmetrical shape of the distribution of the total heat generation amounts. Next, a description is given of the asymmetrical shape of the distribution of the total heat generation amounts when all the heat generator groups are energized.

Figure 15:
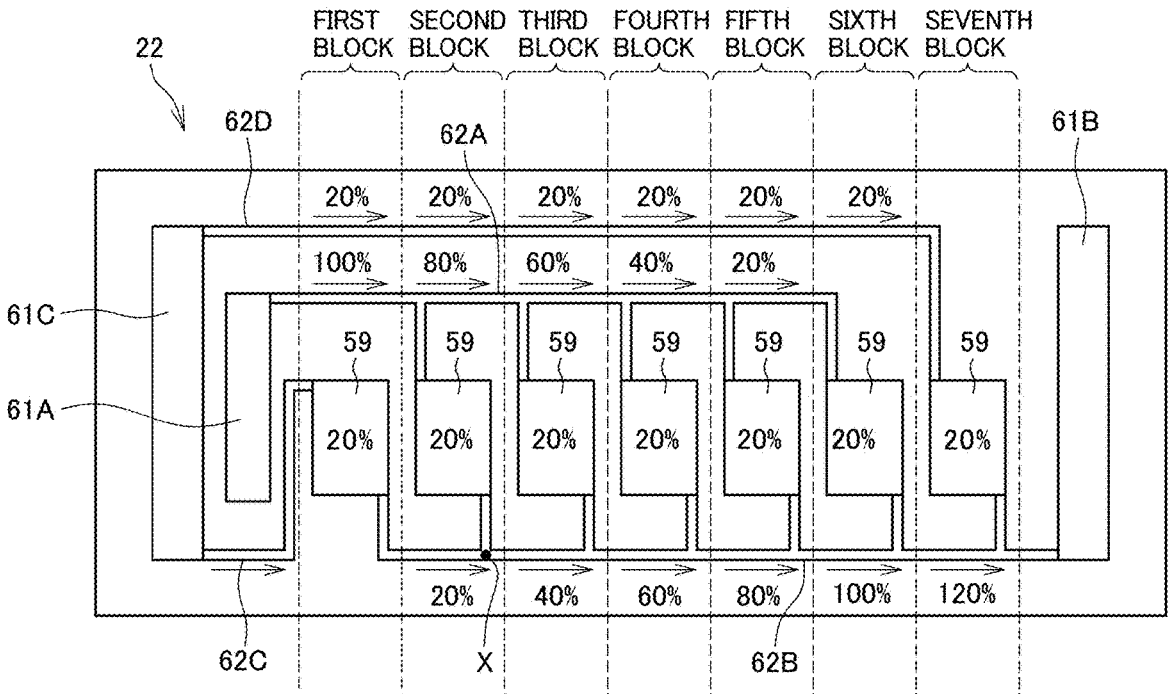
FIG. 15 is a schematic view illustrating heat generation amounts generated by power supply lines in each block of the heater depicted in FIG. 7 when all heat generators are energized.

As illustrated in FIG. 15, the difference between the case when all the heat generator groups are energized and the case when the first heat generator group is energized is that a current having a proportion of 20% to the current flowing through the first power supply line 62A flows through each of the resistive heat generators 59 at both ends of the heat generator 60 and each of the power supply lines 62C and 62D connected to the resistive heat generators at the both ends. The value of the current flowing through the power supply line 62A is the same as that in the case when the first heat generator group is energized. In the first block in FIG. 15, a proportion of a current flowing through the fourth power supply line 62D to the current flowing through the first power supply line 62A is 20%, and the proportion of the current flowing through the first power supply line 62A is expressed as 100%. Therefore, the total heat generation amount generated by the first power supply line 62A and the fourth power supply line 62D in the first block is expressed as 10400, which is the total value of the square of 100 (i.e., 10000) and the square of 20 (i.e., 400). In the second block, a proportion of a current flowing through the first power supply line 62A is 80%, a proportion of a current flowing through the second power supply line 62B is 20%, and a proportion of a current flowing through the fourth power supply line 62D is 20%. Therefore, the total heat generation amount of the power supply lines 62A, 62B, and 62D in the second block is expressed as 7200 (6400+400+400), which is the sum of the squares of the above-described proportions of the currents. The heat generation amounts in other blocks are similarly calculated.

Figure 16:
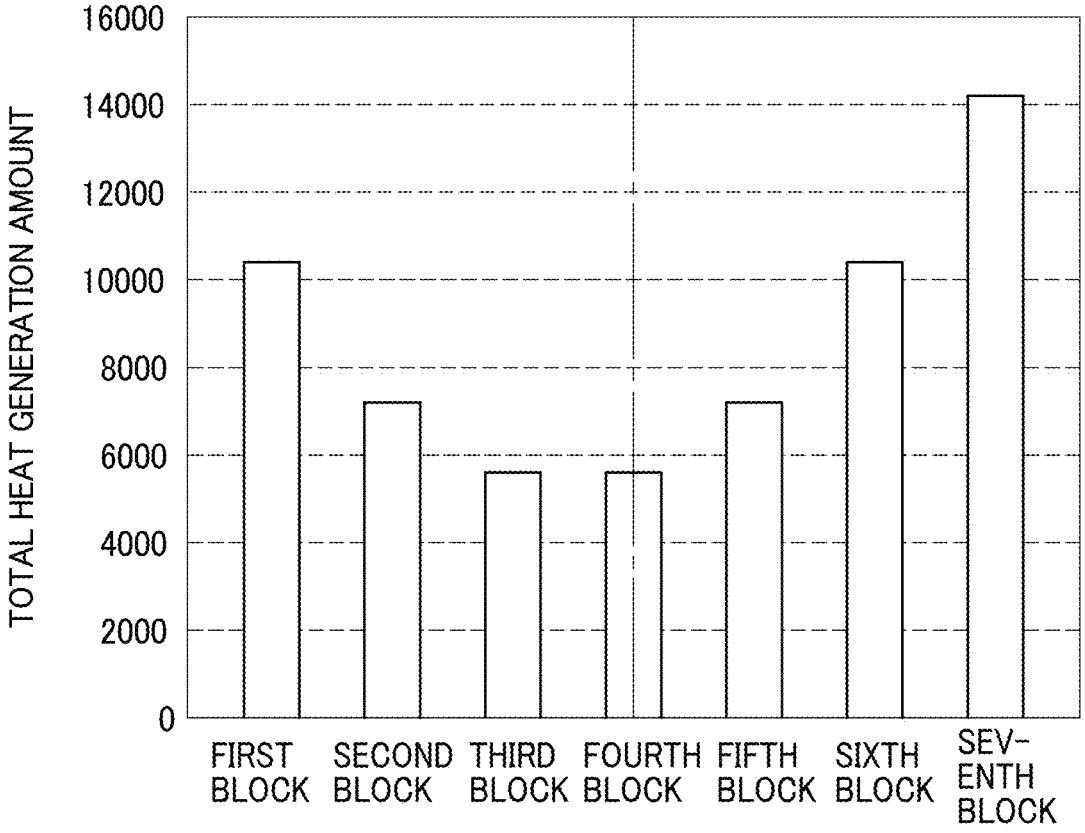
FIG. 16 is a graph illustrating the total heat generation amount generated by the power supply lines in each block of the heater illustrated in FIG. 15.

As illustrated in FIG. 16, the distribution of the total heat generation amounts becomes the lateral asymmetrical shape with respect to the fourth block located in the center of the heat generation area. In particular, the second power supply line 62B is connected to all resistive heat generators 59, and a proportion of a current flowing through downstream portion of the power supply line 62B, that is, the power supply line 62B in the seventh block to the current flowing through the first power supply line 62A in the first block becomes 120%. Such a large current value causes a difference between heat generation amounts in right and left portions of the power supply line.

Such an asymmetrical variation in the heat generation amount of the power supply lines causes a longitudinal unevenness in temperature of the heater 22. When the temperature of the heater 22 varies in the longitudinal direction of the heater 22, the glossiness of an image fixed on a portion of the sheet P corresponding to the higher temperature portion of the heater 22 is higher than the glossiness of an image fixed on a portion of the sheet P corresponding to the lower temperature portion of the heater 22. In short, the entire image exhibits the unevenness in glossiness, leading to a deterioration in image quality. In the present embodiment, lengths of the blocks are designed to be the same so that the heater 22 can uniformly heat the sheet P regardless of the size of the sheet P such as A4 size and A3 size.

In the present embodiment, the following measures are taken to reduce a temperature difference in the fixing device caused by the temperature difference between one side and the other side of the heater 22 in the longitudinal direction of the heater 22 when all the heat generator groups are energized, that is, when the one side of the heater 22 generates larger heat than the other side of the heater 22 in the longitudinal direction of the heater 22.

Figure 17:
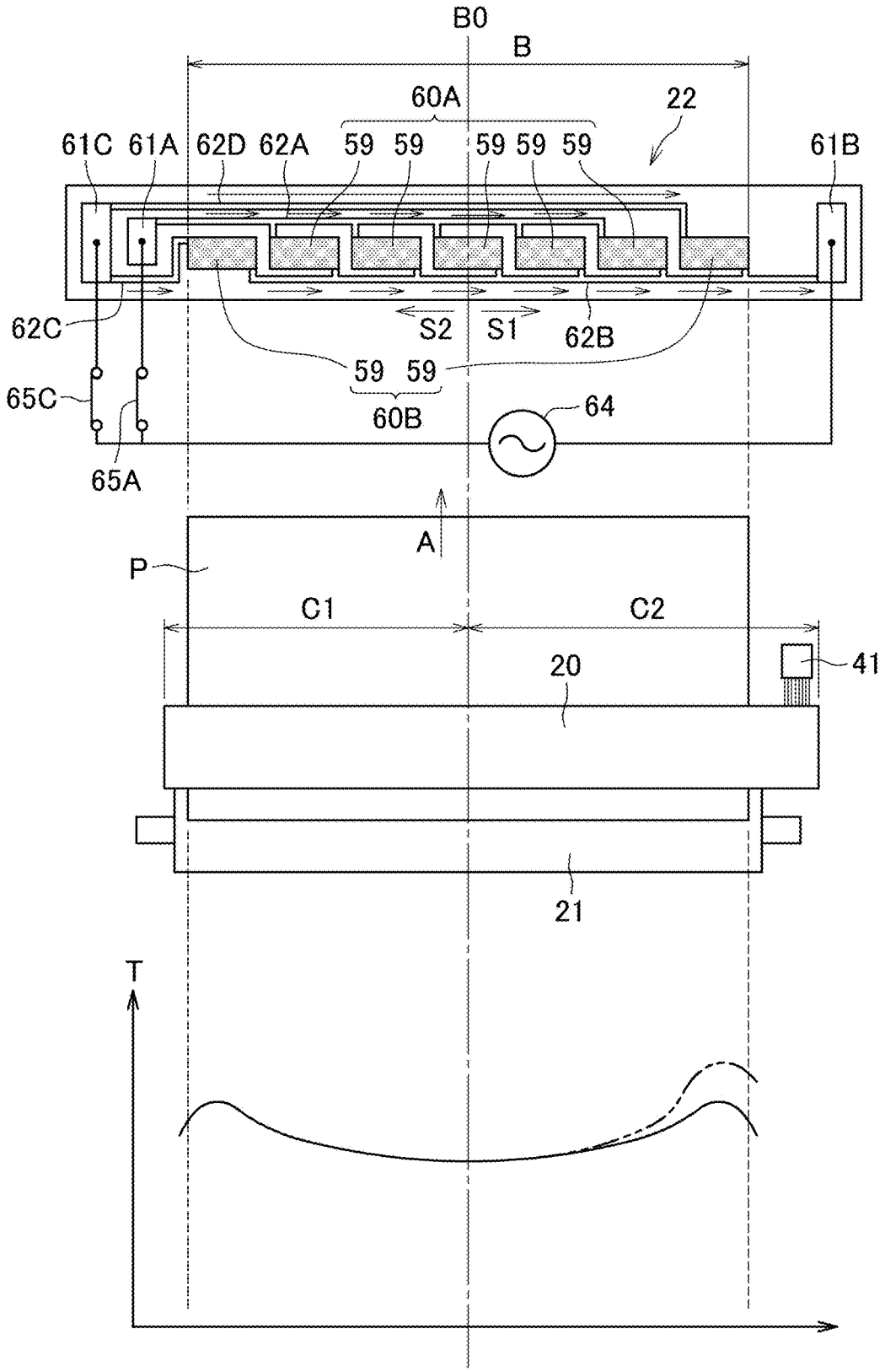
FIG. 17 is a schematic view illustrating a longitudinal positional relationship of the heater and other parts in the fixing device and a graph illustrating a temperature distribution in the longitudinal direction of the fixing belt in the fixing device according to a first embodiment of the present disclosure.

FIG. 17 is a schematic view illustrating a longitudinal positional relationship of the heater 22 and other parts in the fixing device 9. The heater 22 is depicted in the upper part of FIG. 17, and the parts in the fixing device 9 are depicted in the middle part of FIG. 17. As a result, the longitudinal positional relationship is illustrated. In addition, the lower part of FIG. 17 is a graph illustrating distributions of temperatures T of the fixing belt 20 in the longitudinal direction of the fixing belt 20. The heating span B in FIG. 17 includes ranges of the first block to the seventh block described above and is a heat generation region of all the resistive heat generators 59 in the longitudinal direction of the heater 22. The width of the sheet P passing between the fixing belt 20 and the pressure roller 21 in FIG. 17 is the largest of all the sheet which the heater 22 can heat, for example, the length of the longer side of the A4 size sheet.

As illustrated in FIG. 15, when all the resistive heat generators 59 are energized in the present embodiment, the total heat generation amount on the right side of the heater 22 in the longitudinal direction of the heater 22 is larger than the total heat generation amount on the left side of the heater 22 in the longitudinal direction of the heater 22. That is, with reference to FIG. 17, the heater 22 generates larger heat on the right side of the heater 22 in the longitudinal direction of the heater 22 from the center line B0 passing through the center position of the heating span B than the left side of the heater 22 in the longitudinal direction of the heater 22 from the center line B0. In the following description, one side on which the heater generates larger heat is referred to as a first side S, and the other side on which the heater generates smaller heat is referred to as a second side S2. The first side S1 is on the opposite side of the second side S2 in the longitudinal direction of the heater 22 with respect to the center position of the heating span B of the heater 22 in the longitudinal direction of the heater 22. The first side S1 and the second side S2 are also used to identify positions of parts other than the heater 22 in the fixing device 9 with respect to the center position of the heating span B of the heater 22 in the following description. The first side S1 of the heater 22 according to the present embodiment is on the right side of the heater 22 from the center line B0 in FIG. 17, and is also referred to as one side in the following description, and the second side S2 of the heater 22 is on the left side of the heater 22 from the center line B0 in FIG. 17, and is also called the other side in the following description.

As illustrated in FIG. 17, one portion of the fixing belt 20 on the one side of the fixing belt 20 in the longitudinal direction of the fixing belt 20 (the right side in FIG. 17, that is, the first side S1) extends toward outside from the heating span B (i.e. a sheet conveyance span) in the longitudinal direction of the heater 22. That is, in the fixing belt 20, a length C2 from the center line B0 to one end of the fixing belt 20 on the first side S1 that is referred to as the one side of the fixing belt 20 in the longitudinal direction of the fixing belt 20 is longer than a length C1 from the center line B0 to the other end of the fixing belt 20 on the second side S2 that is referred to as the other side of the fixing belt 20 in the longitudinal direction of the fixing belt 20. In the present embodiment, the central position of the pressure roller 21 in the longitudinal direction (that is an axial direction) is on the center line B0, but the present disclosure is not limited to this configuration.

The heat received by the fixing belt 20 from the heating span B is transferred to a portion of the fixing belt 20 outside the heating span B, that is, the portion of the fixing belt 20 on the one side of the fixing belt 20 in the longitudinal direction of the fixing belt 20 (that is, the portion of the fixing belt 20 on the first side S1). That is, a thermal capacity of the portion of the fixing belt 20 on the one side in the longitudinal direction of the fixing belt 20 (that is, the portion of the fixing belt 20 in the first side S1) is larger than a thermal capacity of the other portion of the fixing belt 20 on the other side in the longitudinal direction of the fixing belt 20 (that is, the left side portion of the fixing belt 20 in FIG. 17 and a portion of the fixing belt 20 on the second side S2) with respect to the central position of the heating span B. Therefore, the portion of the fixing belt 20 outside the heating span B on the first side S1, that is, the one side of the fixing belt 20 in the longitudinal direction of the fixing belt 20 becomes a heat transfer portion that releases the heat from the heating span B. In this specification, the meaning of the "heat transfer portion" provided on the portion of the fixing device 9 on the one side of the fixing device 9 in the longitudinal direction of the fixing device 9, that is, on the first side S described above includes a member provided in one portion of the fixing device 9 on the one side that is the first side S1 of the fixing device 9 in the longitudinal direction of the fixing device 9 and a part of a member extended from the other portion of the member on the other side that is the second side S2 of the member in the longitudinal direction of the member to the one portion of the member on the one side that is the first side S of the member in the longitudinal direction of the member.

The fixing device 9 includes a discharge brush 41 serving as a discharger facing the one portion of the fixing belt 20 on the one side (that is, the first side S1) in the longitudinal direction of the fixing belt 20 and outside the heating span B. The discharge brush 41 contacts a surface of the fixing belt 20 and removes electric charges on the surface of the fixing belt 20. The above-described discharge brush 41 contacting the one portion of the fixing belt 20 on the one side of the fixing belt 20 in the longitudinal direction of the fixing belt 20 that is the portion of the fixing belt 20 on the first side S1 increases a thermal capacity related to the one portion of the fixing belt 20 on the one side of the fixing belt 20 in the longitudinal direction of the fixing belt 20 that is the portion of the fixing belt 20 on the first side S1 by the thermal capacity of the discharge brush 41 and releases a lot of heat from the heating span B. That is, the discharge brush 41 contacts the fixing belt 20 as a part of the heat transfer portion and increases an amount of heat released from the heating span B to the heat transfer portion.

The discharger that is the discharge brush 41 serving as the part of the heat transfer portion prevents a part of the toner image from adhering to the surface of the fixing belt 20 and an image failure on the surface of the sheet caused by an offset phenomenon.

As described above, the fixing device 9 according to the present embodiment includes the heat transfer portion to release the heat received from the heating span B on the first side S1 of the fixing device 9 that is the one side of the fixing device 9 from the center line B0 in the longitudinal direction of the fixing device 9. That is, lengthening the one portion of the fixing belt 20 on the one side of the fixing belt 20 in the longitudinal direction of the fixing belt 20 (that is, the portion of the fixing belt 20 in the first side S1) and providing the discharge brush 41 on the one portion of the fixing belt 20 on the one side of the fixing belt 20 in the longitudinal direction of the fixing belt 20 (that is, the portion of the fixing belt 20 on the first side S1) change the thermal capacity related to the portion of the fixing belt 20 on the first side S larger than the thermal capacity of the portion of the fixing belt 20 on the second side S2.

When all the resistive heat generators in the heater 22 are energized, the one portion of the heater 22 on the one side of the heater 22 in the longitudinal direction of the heater 22 (that is, the portion of the heater 22 on the first side S1) generates larger heat than the other portion of the heater 22 on the second side S2 as described above. Note that amounts of heat generated by the heater 22 may be measured by the heater 22 alone. Therefore, as illustrated by a long dashed double-short dashed line in the graph in the lower part of FIG. 17, temperatures T in the one portion of the fixing belt 20 on the one side of the fixing belt 20 in the longitudinal direction of the fixing belt 20 that is the portion of the fixing belt 20 on the first side S is higher than temperatures in the other portion of the fixing belt 20 on the other side of the fixing belt 20 that is the portion of the fixing belt 20 on the second side S2. However, in the present embodiment, since the heat transfer portion releases the heat in the one portion of the fixing belt 20 on the one side of the fixing belt 20 in the longitudinal direction of the fixing belt 20 that is the portion of the fixing belt 20 on the first side S1, the heat transfer portion reduces temperature increase in the one portion of the fixing belt 20 on the one side of the fixing belt 20 in the longitudinal direction of the fixing belt 20 that is the portion of the fixing belt 20 on the first side S1. As illustrated by a solid line in the graph in the lower part of FIG. 17, the above-described configuration can reduce a temperature difference between the one portion of the fixing belt 20 on the one side of the fixing belt 20 in the longitudinal direction of the fixing belt 20 that is the portion of the fixing belt 20 on the first side S1 and the other portion of the fixing belt 20 in the longitudinal direction that is the portion of the fixing belt 20 on the second side S2 when the heater 22 heats the fixing belt 20. Therefore, the above-described configuration can reduce a temperature difference in the fixing device 9 serving as the heating device, that is, a temperature difference between the one portion of the fixing device 9 on the one side of the fixing device 9 in the longitudinal direction (that is, the one portion on the first side S1) and the other portion of the fixing device 9 on the other side of the fixing device 9 in the longitudinal direction (that is, the other portion on the second side S2). As a result, the fixing device described above can reduce an unevenness in glossiness of the toner image or an unevenness in a fixing property of the toner image caused by the temperature difference between the one portion and the other portion of the heater 22 in the longitudinal direction of the heater 22.

The portion of the fixing belt 20 projected toward the one portion of the fixing belt 20 on the one side (that is, on the first side S1) of the fixing belt 20 in the longitudinal direction of the fixing belt 20 as described in the present embodiment is outside the heating span B on the fixing belt 20 and enables the discharge brush 41 to contact the fixing belt 20 outside the sheet conveyance span. Arranging the discharge brush 41 outside the heating span B on the fixing belt 20 and outside the sheet conveyance span prevents occurrences of abnormal images such as fixing failure and streak stains that occur when the discharge brush 41 contacts the toner image on the surface of the sheet.

Figure 18:
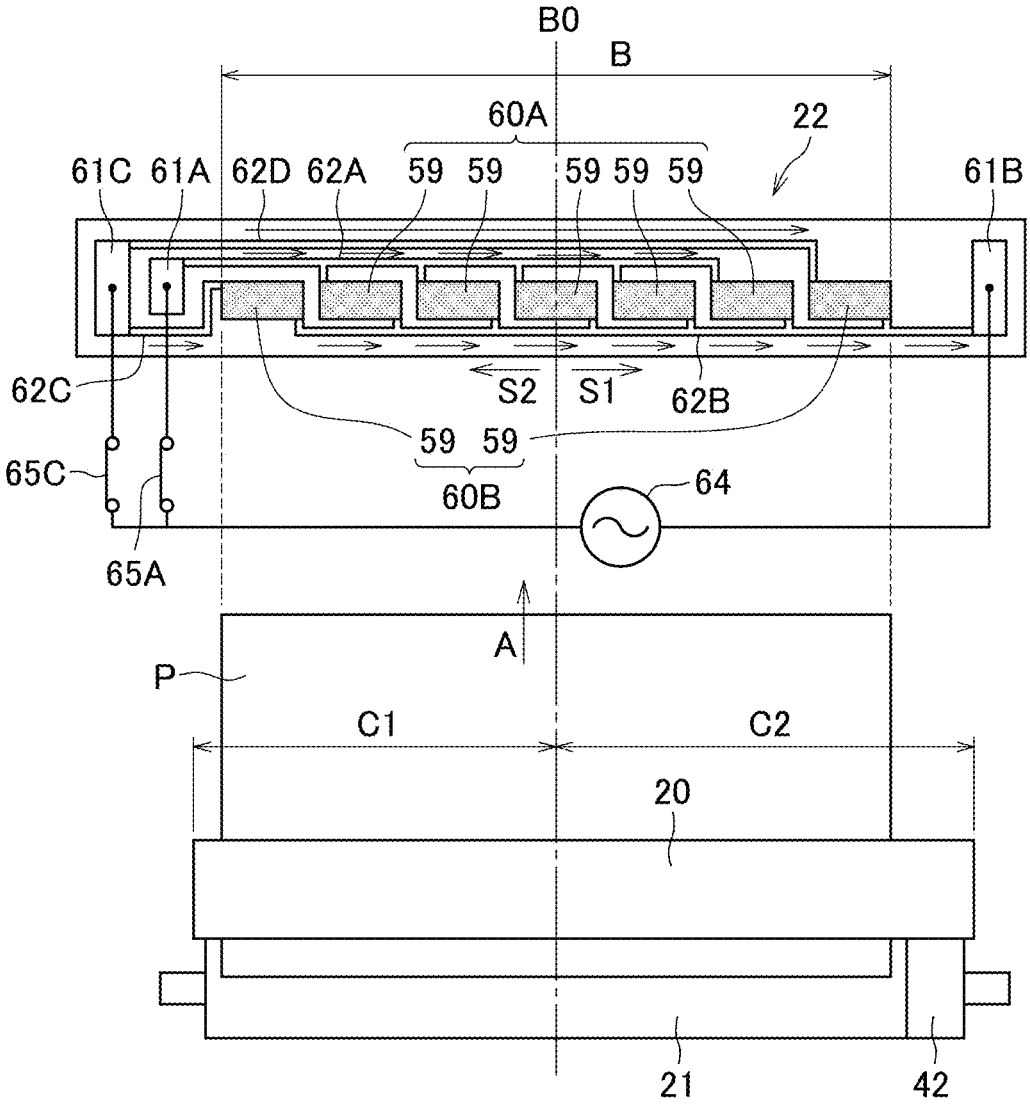
FIG. 18 is a schematic view illustrating a longitudinal positional relationship of the heater and other parts in the fixing device according to a second embodiment of the present disclosure.

Alternatively, as illustrated in FIG. 18, the fixing device 9 may include a discharge rubber ring 42 as the discharger instead of the discharge brush 41 in one portion of the pressure roller 21 on the one side of the pressure roller 21 in the longitudinal direction of the pressure roller 21. The one portion of the pressure roller 21 on the one side of the pressure roller 21 corresponds to the one portion of the heater 22 on the first side S that generates larger heat than the other portion of the heater 22 on the second side S2 in the longitudinal direction of the heater 22. The discharge rubber ring 42 is attached to the one end of the pressure roller 21 in the axial direction of the pressure roller 21 and rotates with the pressure roller 21. The discharge brush 41 contacts the one portion of the fixing belt 20 outside the heating span B in the longitudinal direction of the fixing belt 20 and removes electric charges on the surface of the fixing belt 20. Providing the discharge rubber ring 42 as apart of the heat transfer portion on the one portion of the pressure roller 21 corresponding to the one portion of the fixing belt 20 on the one side of the fixing belt 20 in the longitudinal direction of the fixing belt 20 enables the heat in the one portion of the fixing belt 20 on the one side (that is, the first side S1) of the fixing belt 20 in the longitudinal direction of the fixing belt 20 to transfer to the one portion of the pressure roller 21. In other words, the above-described discharge rubber ring 42 contacting the one portion of the fixing belt 20 on the one side of the fixing belt 20 in the longitudinal direction of the fixing belt 20 increases the thermal capacity related to the one portion of the fixing belt 20 on the one side of the fixing belt 20 in the longitudinal direction of the fixing belt 20 that is the portion of the fixing belt 20 on the first side S1 and releases a lot of heat from the heating span B.

The above-described configuration can reduce a temperature difference between the one portion of the fixing belt 20 on the one side of the fixing belt 20 in the longitudinal direction of the fixing belt 20 that is the portion of the fixing belt 20 on the first side S1 and the other portion of the fixing belt 20 in the longitudinal direction that is the portion of the fixing belt 20 on the second side S2. Arranging the discharge rubber ring 42 outside the heating span B on the one portion of the fixing belt 20 on the one side of the fixing belt 20 in the longitudinal direction of the fixing belt 20 enables the discharge rubber ring 42 to contact the fixing belt 20 outside the sheet conveyance span, which prevents occurrences of abnormal images such as fixing failure that occur when the discharge rubber ring 42 contacts the toner image on the surface of the sheet.

Figure 19:
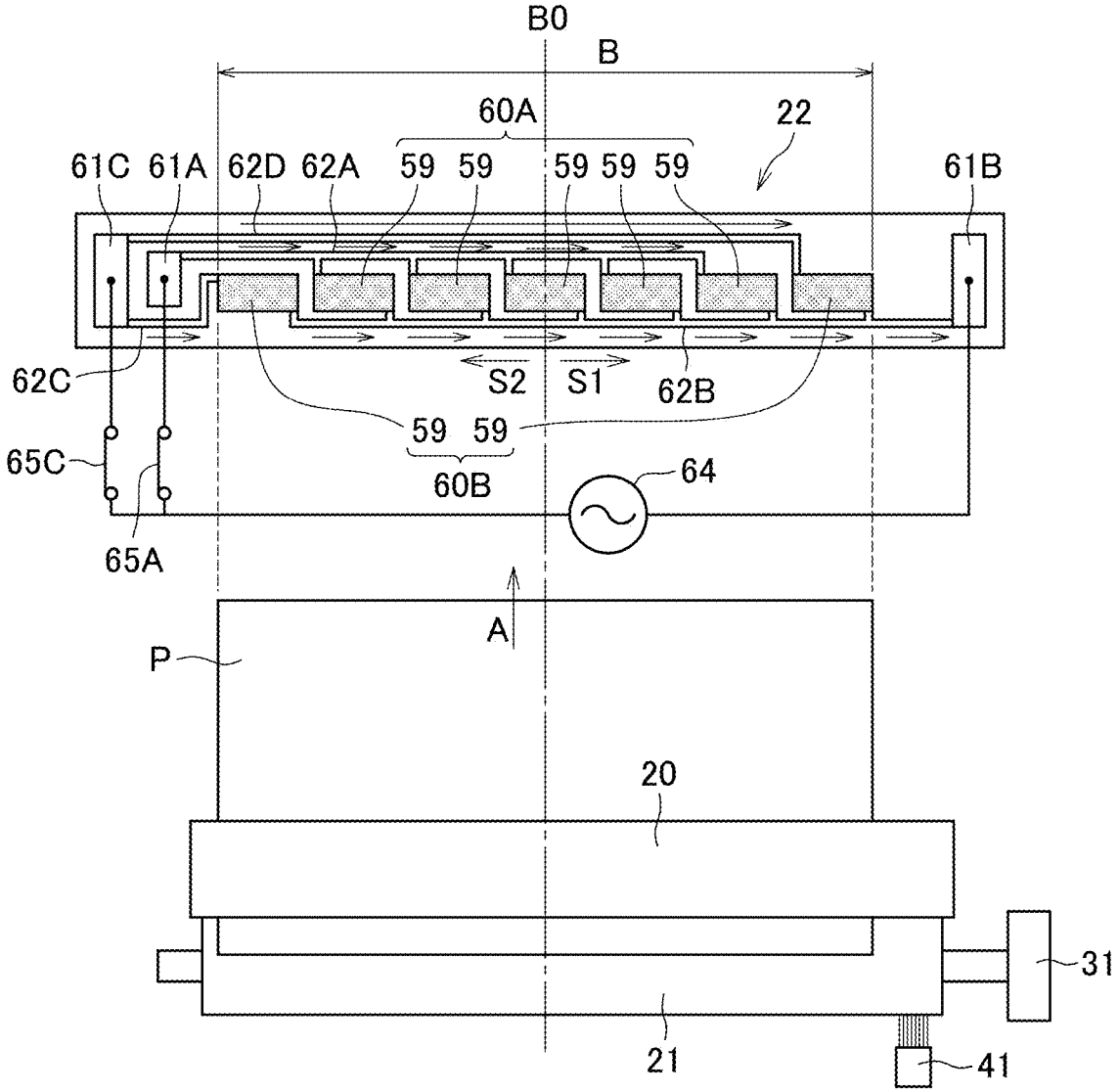
FIG. 19 is a schematic view illustrating a longitudinal positional relationship of the heater and other parts in the fixing device according to a third embodiment of the present disclosure.

Alternatively, as illustrated in FIG. 19, lengthening the one portion of the pressure roller 21 on the one side (that is, the first side S1) of the pressure roller 21 in the longitudinal direction of the pressure roller 21 can release the heat from the one portion of the fixing belt 20 on the one side (that is, the first side S1) of the fixing belt 20 in the longitudinal direction of the fixing belt 20. That is, a lengthened part of the pressure roller 21 is outside the heating span B and functions as a part of the heat transfer portion. The lengthened part of the pressure roller 21 contacting the one portion of the fixing belt 20 on the one side of the fixing belt 20 in the longitudinal direction of the fixing belt 20 that is the portion of the fixing belt 20 on the first side S increases the thermal capacity related to the one portion of the fixing belt 20 on the one side of the fixing belt 20 in the longitudinal direction of the fixing belt 20 that is the portion of the fixing belt 20 on the first side S1 and releases a lot of heat from the heating span B. The above-described configuration can reduce a temperature difference between the one portion of the fixing belt 20 on the one side of the fixing belt 20 in the longitudinal direction of the fixing belt 20 and the other portion of the fixing belt 20 on the other side of the fixing belt 20 in the longitudinal direction. In the present embodiment, the one portion of the pressure roller 21 and the one portion of the fixing belt 20 on the first side S1 are lengthened to the first side S1 in the longitudinal direction. However, the present disclosure is not limited to this. The one portion of the fixing belt 20 on the one side of the fixing belt 20 in the longitudinal direction of the fixing belt 20 that is the portion of the fixing belt 20 on the first side S1 may not be lengthened.

In the present embodiment, the lengthened part of the pressure roller 21 is outside the heating span B and contacts the discharge brush 41. The discharge brush can remove electric charges on the surface of the pressure roller 21. Arranging the discharge brush 41 outside the heating span B on the pressure roller 21 and outside the sheet conveyance span prevents occurrences of abnormal images such as fixing failure that occur when the discharge brush 41 contacts the pressure roller 21 and causes damage on the pressure roller 21. In addition, the discharge brush 41 contacting the lengthened part of the pressure roller 21 increases an amount of heat released from the heating span B.

In the present embodiment, the pressure roller 21 includes a shaft extending in the longitudinal direction of the pressure roller 21 from one end of the pressure roller 21 on the first side S to attach a drive transmission gear 31 serving as a drive transmitter that transmits a driving force to rotate the pressure roller 21. Providing the drive transmission gear 31 on the one end of the pressure roller 21 on the one side (that is, on the first side S1) of the pressure roller 21 in the longitudinal direction of the pressure roller 21 can release the heat from the one portion of the fixing device 9 on the one side (that is, the first side S1) of the fixing device 9 in the longitudinal direction of the fixing device 9. That is, the drive transmission gear 31 functions as a part of the heat transfer portion. The heat transfer portion in the present embodiment includes the drive transmission gear 31, the shaft extending from the one end of the pressure roller 21 on the one end (that is on the first side S1) of the pressure roller 21 in the longitudinal direction of the pressure roller 21 to attach the drive transmission gear 31, the lengthened part of the pressure roller 21 toward the one side (that is, the first side S1) of the pressure roller 21 in the longitudinal direction of the pressure roller 21, and the one portion of the fixing belt 20 that contacts the lengthened part of the pressure roller 21. The heat transfer portion increases the thermal capacity related to the one portion of the fixing belt 20 on the one side of the fixing belt 20 in the longitudinal direction of the fixing belt 20 that is the portion of the fixing belt 20 on the first side S1 and releases a lot of heat from the heating span B. The above-described configuration can reduce the temperature difference between the one portion and the other portion of the fixing device 9 in the longitudinal direction of the fixing device 9.

Figure 20:
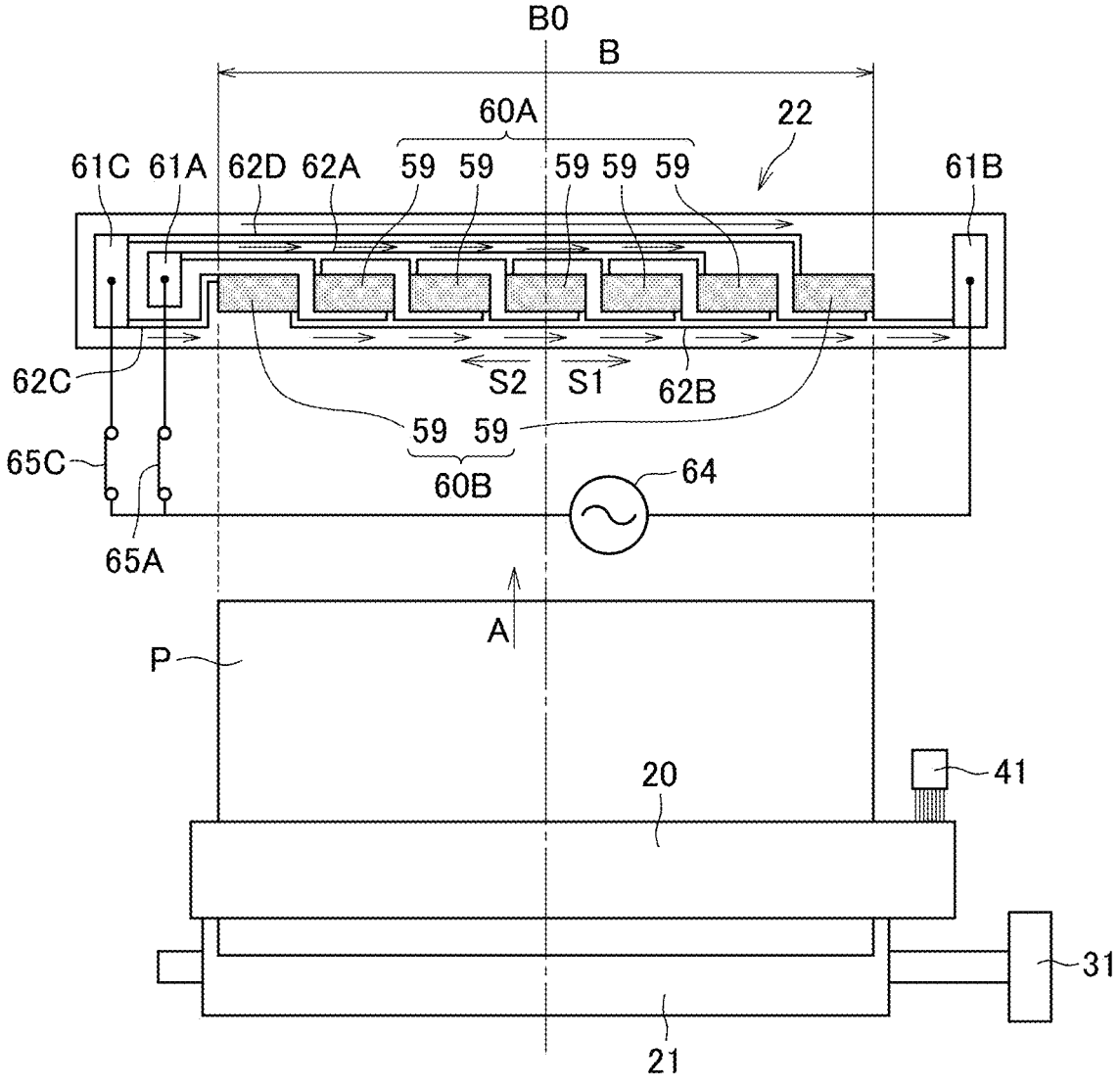
FIG. 20 is a schematic view illustrating a longitudinal positional relationship of the heater and other parts in the fixing device according to a fourth embodiment of the present disclosure.
Figure 21:
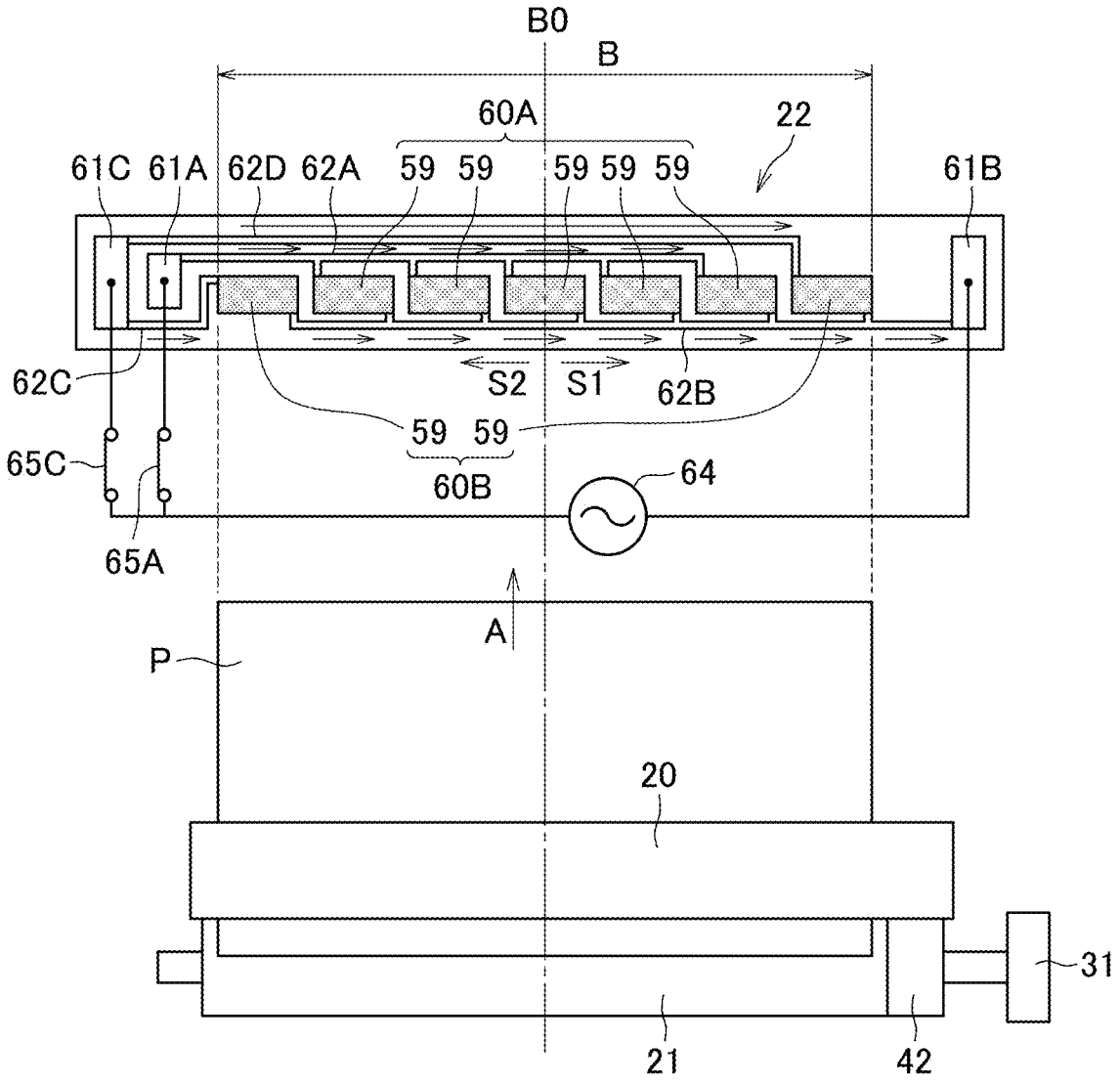
FIG. 21 is a schematic view illustrating a longitudinal positional relationship of the heater and other parts in the fixing device according to a fifth embodiment of the present disclosure.

Alternatively, as illustrated in FIG. 20, the fixing device 9 may include the drive transmission gear 31 on the one end of the pressure roller 21 in the longitudinal direction of the pressure roller 21 (on the first side S1) and the discharge brush 41 facing the one portion of the fixing belt 20. As illustrated in FIG. 21, the fixing device 9 may include the discharge rubber ring 42 instead of the discharge brush 41 attached to the one portion of the pressure roller 21 in addition to the drive transmission gear 31 described above.

As described above, combinations of a plurality of parts on the one side (that is, the first side S1) of the fixing device 9 in the longitudinal direction of the fixing device 9 can receive and release the heat from the heating span B and are not limited to the above-described combinations. For example, the position of the discharger is not limited to the positions illustrated in FIGS. 19 and 20. Although the fixing device 9 in the present embodiment includes the drive transmitter attached to the shaft extending from one end of the pressure roller 21 on the one side (that is, the first side S1), the fixing device 9 may include a driver such as a motor attached to the shaft.

Figure 22:
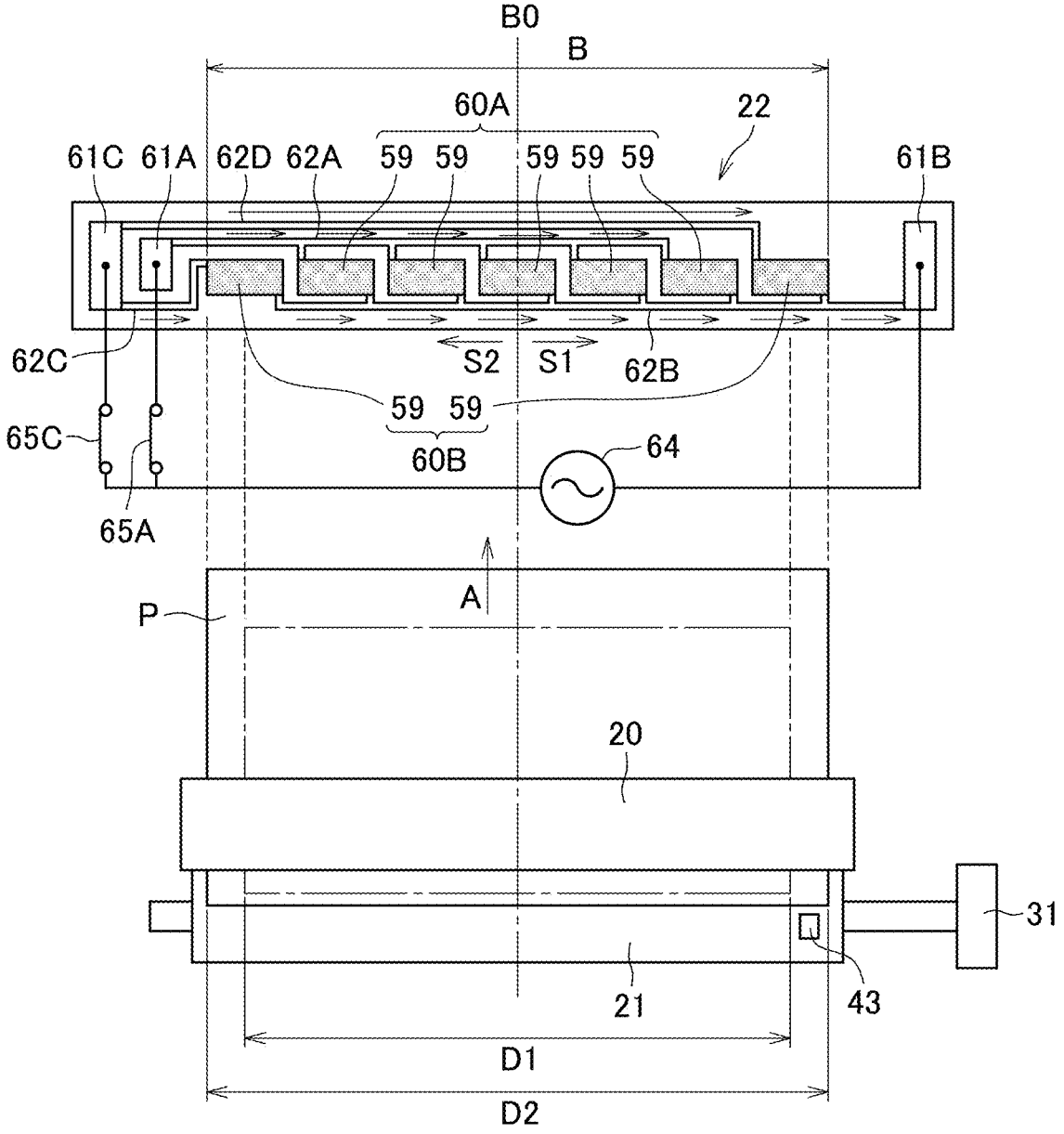
FIG. 22 is a schematic view illustrating a longitudinal positional relationship of the heater and other parts in the fixing device according to a sixth embodiment of the present disclosure.
Figure 23:
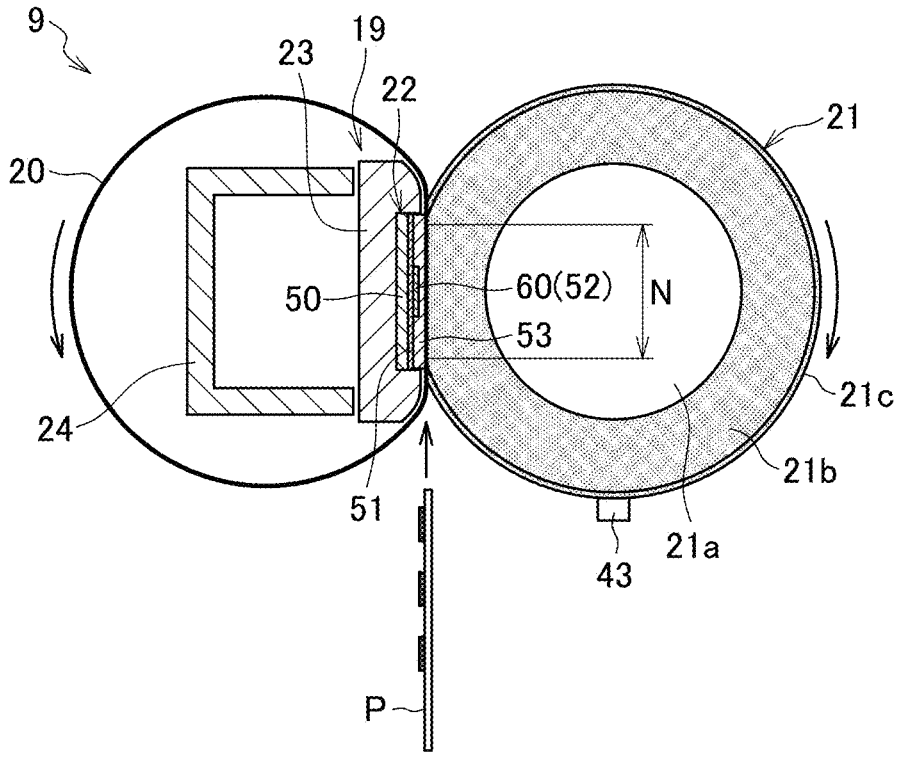
FIG. 23 is a vertical cross-sectional view of a fixing device according to a sixth embodiment of the present disclosure viewed from a lateral side of the fixing device.

A temperature detector may be disposed in the one portion of the fixing device 9 on the one side (that is, the first side S1) in the longitudinal direction of the fixing device 9 to prevent an excessive temperature rise in the one portion of the fixing device 9. For example, as illustrated in FIGS. 22 and 23, a thermistor 43 as the temperature detector is disposed outside the sheet conveyance span D1 drawn by a dash-dot-dash line in FIG. 22 and inside the sheet conveyance span D2 in the longitudinal direction of the pressure roller 21 facing the outer circumferential surface of the pressure roller 21. The sheet conveyance span D1 has a length of the longer side of the B5 size sheet, and the sheet conveyance span D2 has the length of the longer side of the A4 size sheet. The thermistor 43 is a contact-type temperature detector. In the present embodiment, the sheet conveyance span D1 is the largest sheet conveyance span in the fixing device 9, and the heating span B is substantially the same.

When the sheet having a horizontal width larger than the length of the shorter side of the A4 size sheet passes through the fixing device 9, the first heat generator group 60A and the second heat generator group 60B generate heat. However, when the sheet has a horizontal width larger than the length of the shorter side of the A4 size sheet and smaller than the largest width of the sheet used in the fixing device 9 and passes through the fixing device 9, for example, when the B5 size sheet is fed in landscape orientation, the sheet does not pass through end portions of the heating span B in the longitudinal direction of the fixing device 9. Therefore, temperatures of end portions of the fixing belt 20 corresponding to the end portions of the heating span B, which is referred to as a non-conveyance region, becomes higher than the other portion of the fixing belt 20. Overheating the fixing belt 20 may exceed the heat resistant temperature of the fixing belt 20 and damage the fixing belt 20. To avoid overheating the non-conveyance region of the fixing belt 20, the thermistor 43 is disposed, and when the thermistor 43 detects a temperature equal to or higher than a predetermined temperature, printing speed is decreased, or print operations are stopped.

Providing the thermistor 43 as the temperature detector on the one portion of the pressure roller 21 on the one side (that is, the first side S1) of the pressure roller 21 in the longitudinal direction of the pressure roller 21 as described above prevents the excessive temperature rise in the one portion of the fixing device 9 on the one side (that is, the first side S1) of the fixing device 9 in the longitudinal direction of the fixing device 9. That is, providing the temperature detector (i.e. the thermistor 43) as a part of the heat transfer portion on the first side S increases the thermal capacity related to the one portion of the fixing belt 20 on the one side of the fixing belt 20 in the longitudinal direction of the fixing belt 20 that is the portion of the fixing belt 20 on the first side S1 and releases a lot of heat from the heating span B. The above-described configuration can reduce the temperature difference between the one portion and the other portion of the fixing device 9 in the longitudinal direction of the fixing device 9.

Figure 24:
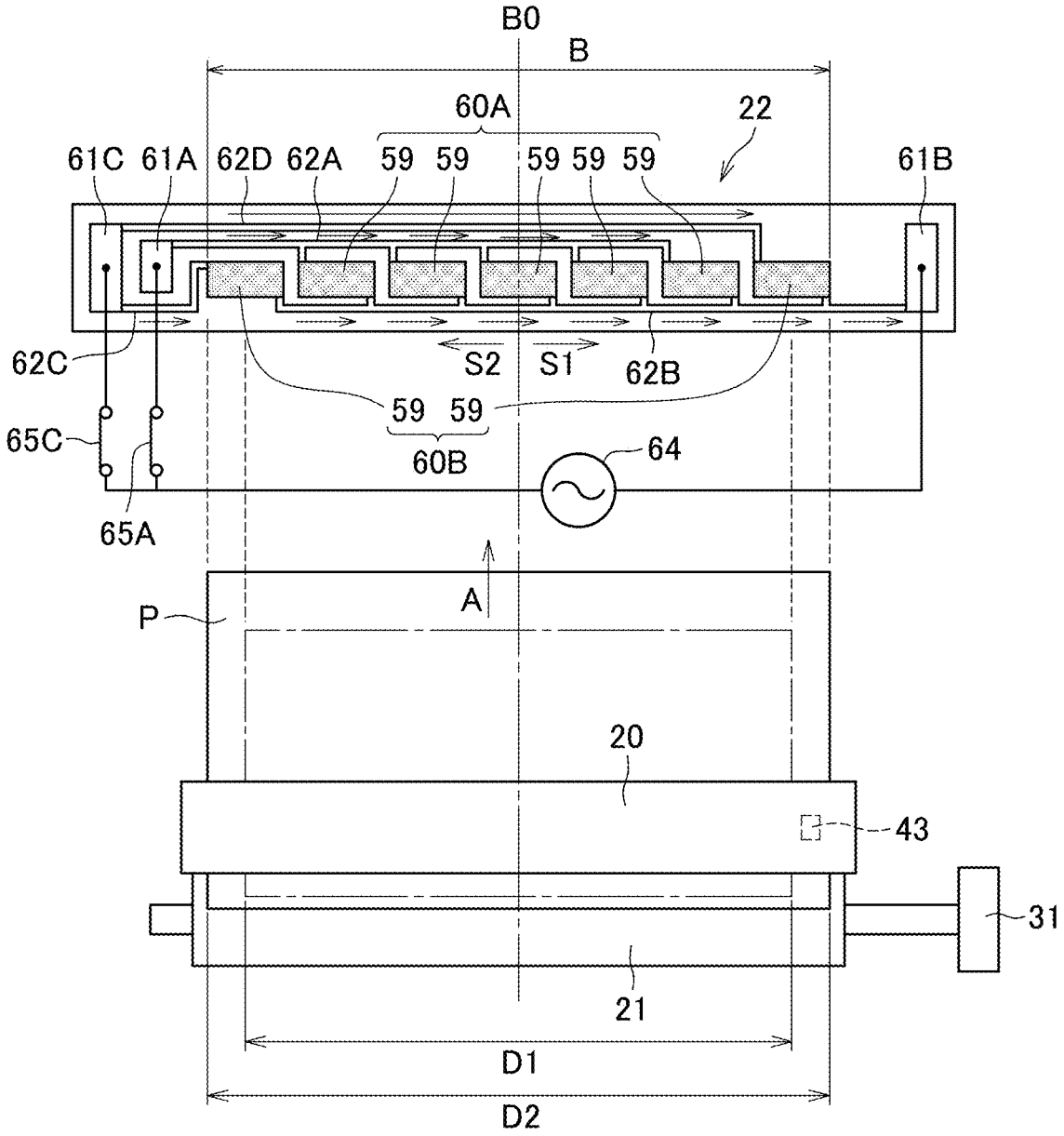
FIG. 24 is a schematic view illustrating a longitudinal positional relationship of the heater and other parts in the fixing device according to a seventh embodiment of the present disclosure.
Figure 25:
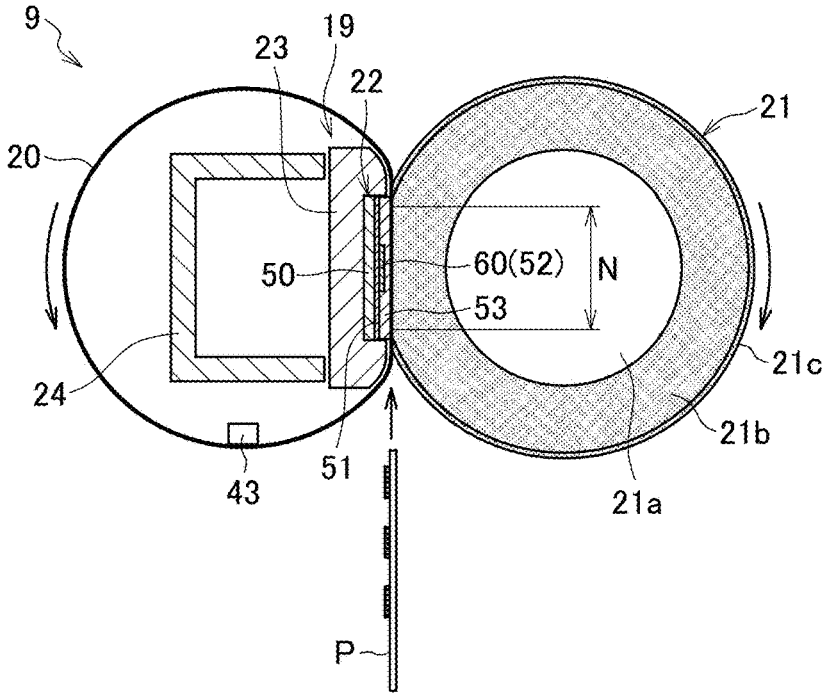
FIG. 25 is a vertical cross-sectional view of a fixing device according to a seventh embodiment of the present disclosure viewed from a lateral side of the fixing device.

The temperature detector may be disposed on the fixing belt 20. For example, as illustrated in FIGS. 24 and 25, a thermistor 43 as the temperature detector is disposed outside the sheet conveyance span D1 having the length of the longer side of the B5 size sheet and inside the sheet conveyance span D2 having the length of the longer side of the A4 size sheet facing the inner circumferential surface of the fixing belt 20. The above-described configuration can prevent overheating the non-conveyance region of the fixing belt 20. Similar to the above description, providing the thermistor 43 as the temperature detector on the one portion of the fixing belt 20 on the one side (that is, the first side S1) of the fixing belt 20 in the longitudinal direction of the fixing belt 20 prevents the excessive temperature rise in the one portion of the fixing device 9 on the one side (that is, the first side S1) of the fixing device 9 in the longitudinal direction of the fixing device 9. Providing the thermistor 43 on the inner circumferential surface of the fixing belt 20 does not damage the outer circumferential surface of the fixing belt 20 that contacts a surface of the sheet bearing the toner image and can prevent the occurrences of abnormal images such as fixing failure and streak stains caused by a damage of the outer circumferential surface of the fixing belt 20 that contacts the surface of the sheet. Of course, in addition to the temperature detector, the fixing device 9 may include other structures such as the discharger.

In the above embodiments, the heat transfer portion is the lengthened part of the fixing belt 20 or the pressure roller 21 that is lengthened toward the one side (that is, the first side S1) of the fixing belt 20 or the pressure roller 21 in the longitudinal direction of the fixing belt 20 or the pressure roller 21. In addition, the discharger or the like contacts the fixing belt 20 or the pressure roller 21 and functions as a part of the heat transfer portion. The heat transfer portion prevents the heat of the heating span B from excessively increasing the temperature in the one portion of the fixing device 9 on the one side (that is, the first side S1) in the longitudinal direction of the fixing device 9. In the following embodiment, the heat transfer portion is provided in the heater holder 23 as the holder to hold the heater 22.

Figure 26A:
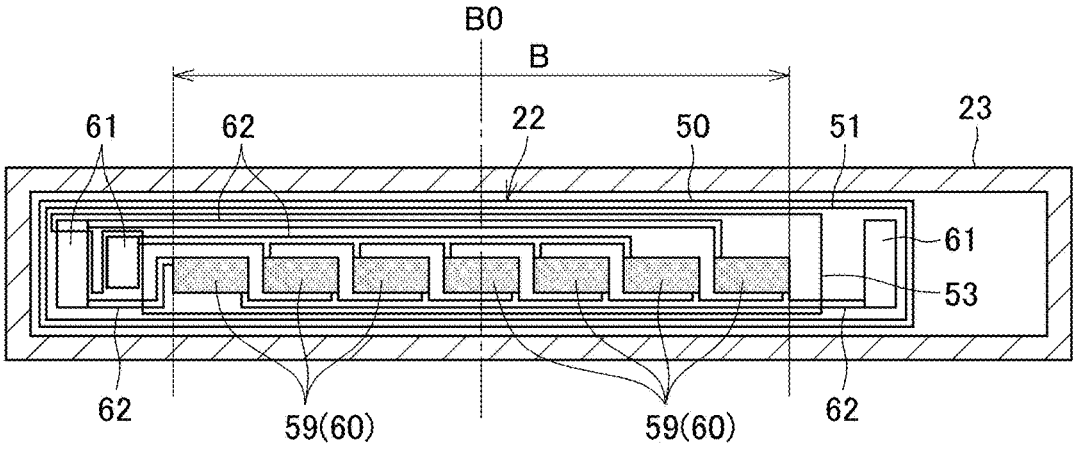
FIG. 26A is a cross-sectional view illustrating the heater and a heater holder according to an eighth embodiment of the present disclosure viewed from a top side of the fixing device.
Figure 26B:
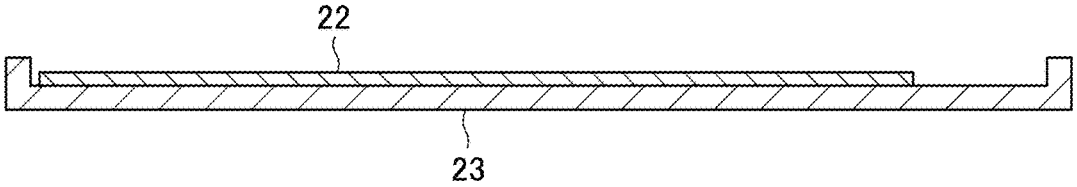
FIG. 26B is a cross-sectional view illustrating the heater and a heater holder according to the eighth embodiment of the present disclosure viewed from a lateral side of the fixing device.

As illustrated in FIG. 26, the heater holder 23 includes one portion extending outward from a position at which the heater holder 23 contacts an end of the base 50 of the heater 22 and toward the one side (that is, the first side S1) of the heater holder 23 in the longitudinal direction of the heater holder 23. That is, in the heater holder 23, a length from the center line B0 passing through the center position of the heating span B to one end of the heater holder 23 on the first side S1 that is referred to as one portion of the heater holder 23 is longer than a length from the center line B0 to the other end of the heater holder 23 on the second side S2 that is referred to as the other portion of the heater holder 23. Providing the one portion of the heater holder 23 extending outward as a part of the heat transfer portion on the first side S1 increases the thermal capacity related to the one portion of the fixing belt 20 on the one side of the fixing belt 20 in the longitudinal direction of the fixing belt 20 that is the portion of the fixing belt 20 on the first side S1 and releases a lot of heat from the heating span B. The above-described configuration can reduce the temperature difference between the one portion and the other portion of the fixing device 9 in the longitudinal direction of the fixing device 9.

As described above, the fixing device 9 according to the present embodiments includes the heat transfer portion to release the heat of the heating span B in the first portion that corresponds to the one portion of the heater 22 on the one side of the heater 22 in the longitudinal direction of the heater 22 that generates larger heat than the other portion of the heater 22 and reduces the temperature difference between the one portion and the other portion of the fixing device 9 in the longitudinal direction. As a result, the fixing device described above can reduce the unevenness in glossiness of the toner image or the unevenness in the fixing property of the toner image caused by the temperature difference between the one portion and the other portion of the heater 22 in the longitudinal direction of the heater 22. The above-described configuration is helpful to speed up and downsize the image forming apparatus.

Figure 27:
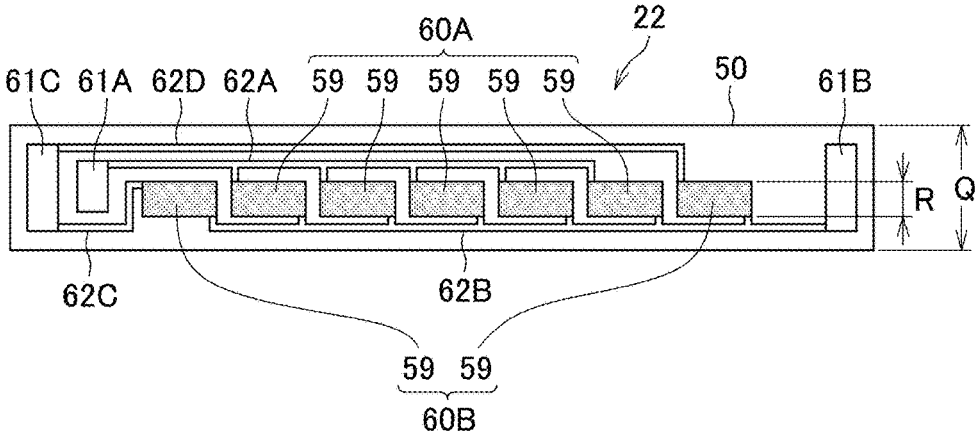
FIG. 27 is a plan view of the heater, illustrating a short-side dimension of the heater and a short-side dimension of resistive heat generators.

As described above, the embodiments of the present disclosure prevent the unevenness in temperature in the fixing device 9 and the fixing belt 20 caused by downsizing of the heater. Accordingly, the Embodiments of the present disclosure are particularly suitable for the heater downsized in the short-side direction. Specifically, it is preferable for the embodiments to be applied to the heater 22 illustrated in FIG. 27 in which a ratio (R/Q) of the short-side dimension R of the resistive heat generators 59 to the short-side dimension Q of the heater 22 (i.e. the base 50) is not less than 25%. It is more preferably for the embodiments of the present disclosure to be applied to the heater 22 having the ratio (R/Q) of dimensions of 40% or more in the short-side direction. A larger effect can be expected by applying the embodiments to the small heater 22 as described above.

The following is results of an experiment that measured the temperature differences between a center portion and an end portion of the heater 22 in the longitudinal direction of the heater 22 when the above-described ratio (R/Q) of the dimensions in the short-side direction were changed. In the experiment, the heaters 22 were prepared to have the above-described configuration and different values of the above-described ratio (R/Q) of the dimensions in the short-side direction, that is, 20% or more and less than 25%, 25% or more and less than 40%, 40% or more and less than 70%, 70% or more and less than 80%. A predetermined voltage was applied to all the resistive heat generators in the heater. The surface temperatures of the center and the end of the heater itself (that is, the heater was not set in the fixing device) in the longitudinal direction were measured using an infrared thermography FLIR T620 manufactured by FLIR Systems. The above experimental results are illustrated in Table 1. In Table 1, symbols ○, Δ, x mean temperature differences between the center and the end of the prepared heaters. The symbol ○ means that the temperature difference was less than 2° C., the symbol Δ means that the temperature difference was 2° C. or more and less than 5° C., and the symbol x means that the temperature difference was 5° C. or more. The heater having the ratio (R/Q) of the dimensions of 80% or more in the short-side direction was not prepared because such a heater has no space for arranging the power supply lines unless the dimension of the heater in the short-side direction is made extremely large.

TABLE 1

| RATIO OF DIMENSIONS IN SHORT-SIDE DIRECTION | TEMPERATURE DIFFERENCE |
|---|---|
| 20 TO 25% | ○ |
| 25 TO 40% | Δ |
| 40 TO 70% | x |
| 70 TO 80% | x |

As illustrated in Table 1, the larger the ratio (R/Q) of the dimensions in the short-side direction is, the larger the temperature difference between the center and the end of the heater is. Specifically, when the ratio (R/Q) of the dimensions in the short-side direction was 20% or more and less than 25%, the temperature difference between the center and the end of the heater was less than 2° C., that is, ○. When the ratio (R/Q) of the dimensions in the short-side direction was 25% or more and less than 40%, the temperature difference between the center and the end of the heater was 2° C. or more and less than 5° C., that is, Δ. When the ratio (R/Q) of the dimensions in the short-side direction was 40% or more and less than 70% and 70% or more and less than 80%, the temperature difference between the center and the end of the heater was 5° C. or more, that is x. As can be seen from this result, the temperature unevenness in the longitudinal direction of the heater becomes remarkable when the ratio (R/Q) of the dimensions in the short-side direction is 25% or more, and becomes particularly remarkable when the ratio (R/Q) of the dimensions in the short-side direction is 40% or more. It is preferable to apply the above configuration of the present embodiment to the heater having the above-described ratio (R/Q) of the dimensions in the short-side direction to reduce the above-described temperature difference.

In order to decrease the variation in the temperature of the heater 22 described above, the resistive heat generator having a positive temperature coefficient (PTC) characteristic may be used. PTC defines a property in which the resistance value increases as the temperature increases. Therefore, for example, a heater output decreases under a given voltage when the temperature increases. The heat generator having the PTC property starts quickly with an increased output at low temperatures and prevents overheating with a decreased output at high temperatures. For example, if a temperature coefficient of resistance (TCR) of the PTC is in a range of from about 300 ppm/° C. to about 4,000 ppm/° C., the heater 22 is manufactured at reduced costs while retaining a resistance required for the heater 22. The TCR is preferably in a range of from about 500 ppm/° C. to about 2,000 ppm/° C.

The TCR can be calculated using the following equation (2). In the equation (2), T0 represents a reference temperature, T1 represents a freely selected temperature, R0 represents a resistance value at the reference temperature T0, and R1 represents a resistance value at the selected temperature T1. For example, in the heater 22 described above with reference to FIG. 7, the TCR is 2,000 ppm/° C. from the equation (2) when the resistance values between the first electrode 61A and the second electrode 61B are 10Ω (i.e., resistance value R0) and 12Ω (i.e., resistance value R1) at 25° C. (i.e., reference temperature T0) and 125° C. (i.e., selected temperature T), respectively.

Equation (2)

$$TCR=(R1-R0)/R0/(T1-T0)\times 106, \quad (2)$$

Figure 28A:
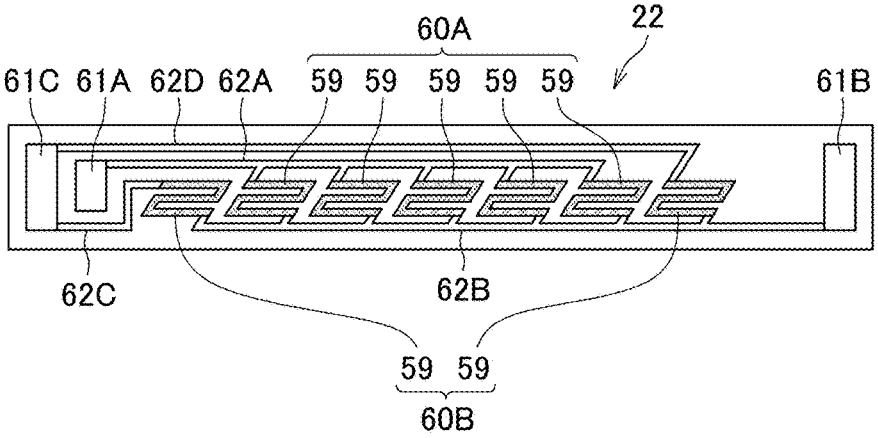
FIG. 28A is a plan view of a first variation of the heater.
Figure 28B:
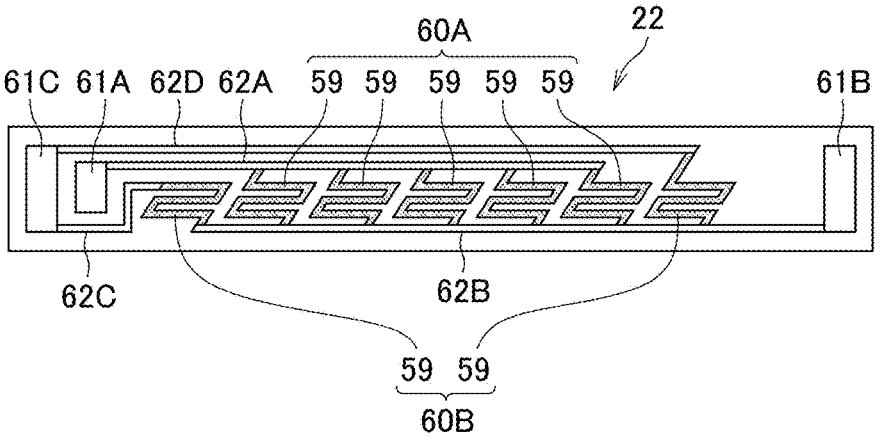
FIG. 28B is a plan view of a second variation of the heater.

The heater to which the embodiments of the present disclosure are applied is not limited to the heater 22 including block-shaped (or square-shaped) resistive heat generators 59 as illustrated in FIG. 7. For example, FIGS. 28A and 28B are plan views of heaters 22 as variations of the heater 22. The embodiments are applicable to the heaters 22 including resistive heat generators 59 having a shape in which a straight line is folded back as illustrated in FIGS. 28A and 28B. The embodiments are also applicable to a heater including resistive heat generators having another shape. In FIGS. 28A and 28B, portions filled with gray are the resistive heat generators 59. In FIG. 28A, the heater 22 has power supply lines extending in a direction intersecting the longitudinal direction of the heater 22 from the power supply line 62A or 62D extending in the longitudinal direction. On the other hand, in FIG. 28B, the heater 22 has the resistive heat generators 59 having portions extending in the direction intersecting the longitudinal direction of the heater 22 from the power supply line 62A or 62D extending in the longitudinal direction.

Figure 29:
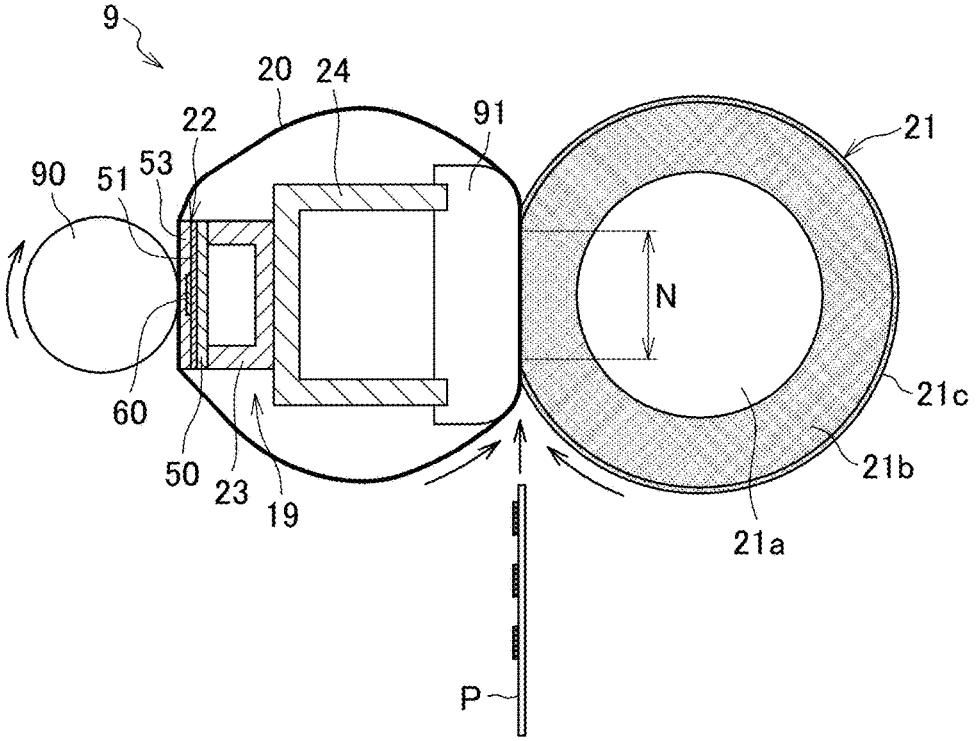
FIG. 29 is a schematic cross-sectional view illustrating a configuration of another fixing device according to an embodiment of the present disclosure.
Figure 30:
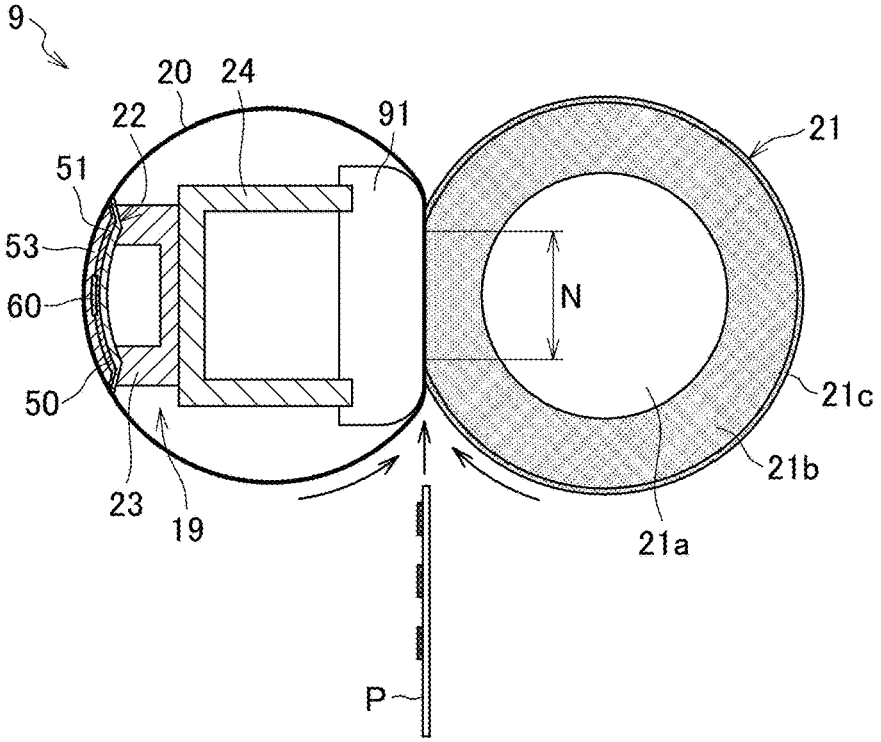
FIG. 30 is a schematic cross-sectional view illustrating a configuration of still another fixing device according to an embodiment of the present disclosure.
Figure 31:
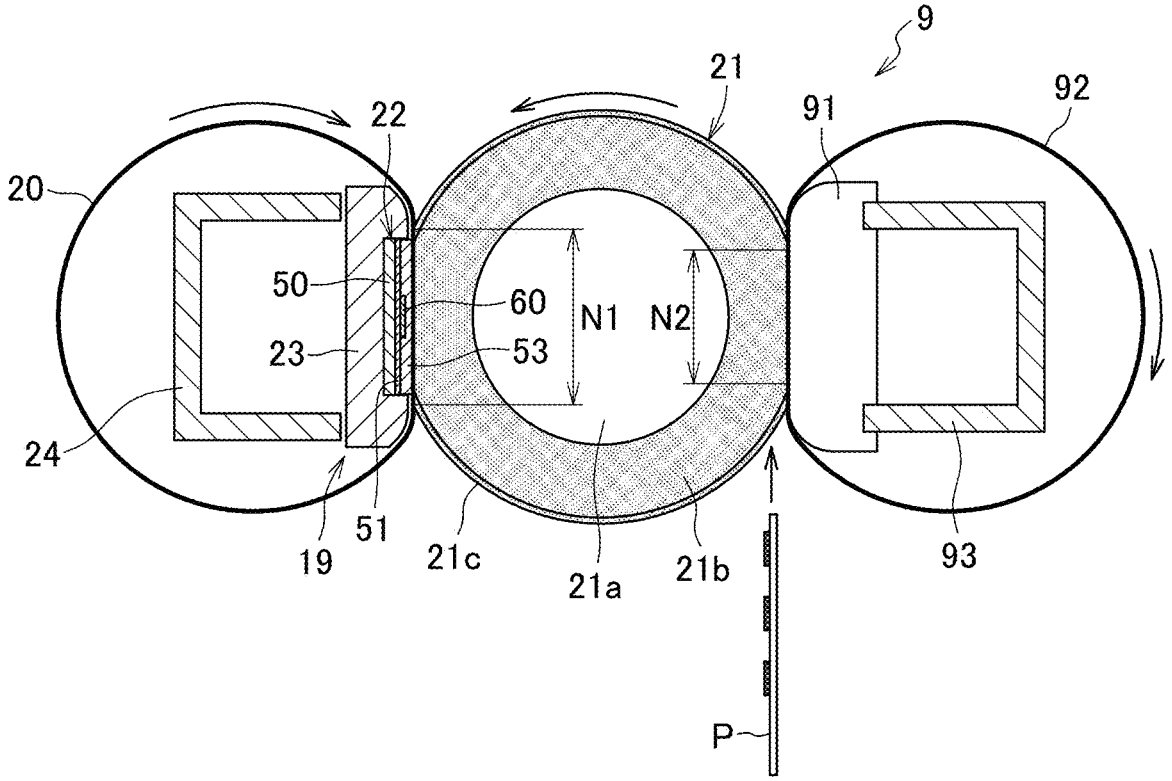
FIG. 31 is a schematic cross-sectional view illustrating a configuration of still another fixing device according to an embodiment of the present disclosure.

The embodiments of the present disclosure are also applicable to fixing devices as illustrated in FIGS. 29 to 31, respectively, other than the fixing device 9 described above. Referring now to FIGS. 29 to 31, a description is given of some variations of the fixing devices.

First, the fixing device 9 illustrated in FIG. 29 includes a pressurization roller 90 opposite the pressure roller 21 with respect to the fixing belt 20 and heats the fixing belt 20 sandwiched by the pressurization roller 90 and the heater 22. On the other hand, a nip formation pad 91 serving as a nip former is disposed inside the loop formed by the fixing belt 20 and disposed opposite the pressure roller 21. The stay 24 supports the nip formation pad 91. The nip formation pad 91 and the pressure roller 21 sandwich the fixing belt 20 and define the fixing nip N.

As described in the above embodiments, the fixing device 9 illustrated in FIG. 29 may also include the heat transfer portion to release the heat of the heating span B of the heater 22 in the one portion of the fixing belt 20 on the one side (that is, the first side S1) of the fixing belt 20 in the longitudinal direction of the fixing belt 20 that corresponds to the one portion of the heater 22 on the first side S1 in the longitudinal direction of the heater 22 that generates larger heat than the other portion of the heater 22 to reduce the temperature difference between the one portion and the other portion of the fixing device 9 in the longitudinal direction of the fixing device 9. The heat transfer portion includes the one portion of the fixing belt 20 extending to the one side (that is, the first side S1) of the fixing belt 20 in the longitudinal direction of the fixing belt 20, the discharger such as the discharge brush or the discharge rubber ring on the one portion of the fixing belt 20, and the temperature detector such as the thermistor on the one portion of the fixing belt 20. Additionally, the heat transfer portion may include the one portion of the pressure roller 21 extending to the one side (that is, the first side S1) of the pressure roller 21 in the longitudinal direction of the pressure roller 21, the one portion of the heater holder 23 extending to the one side (that is, the first side S1) of the heater holder 23 in the longitudinal direction of the heater holder 23, the drive transmitter such as the drive transmission gear provided in the one portion of the fixing device 9 on the one side (that is, the first side S1) of the fixing device 9 in the longitudinal direction of the fixing device 9, or the temperature detector such as the thermistor provided in the one portion of the fixing device 9.

Next, the fixing device 9 illustrated in FIG. 30 omits the above-described pressurization roller 90 and includes the heater 22 formed to be arc having a curvature of the fixing belt 20 to keep a circumferential contact length between the fixing belt 20 and the heater 22. Other parts of the fixing device 9 illustrated in FIG. 30 are the same as the fixing device 9 illustrated in FIG. 29.

Lastly, the fixing device 9 illustrated in FIG. 31 includes a pressing belt 92 in addition to the fixing belt 20 and has a heating nip (a first nip) N1 and the fixing nip (a second nip) N2 separately. That is, the nip formation pad 91 and the stay 93 are disposed opposite the fixing belt 20 with respect to the pressure roller 21, and the pressing belt 92 is rotatably disposed to wrap around the nip formation pad 91 and the stay 93. The sheet P passes through the fixing nip N2 between the pressing belt 92 and the pressure roller 21 and is applied to heat and pressure, and the image is fixed on the sheet P. Other construction of the fixing device is equivalent to that of the fixing device 9 depicted in FIG. 2.

As described in the above embodiments, the fixing device 9 illustrated in FIG. 31 may also include the heat transfer portion to release the heat of the heating span B of the heater 22 in the one portion of the fixing belt 20 on the one side (that is, the first side S1) of the fixing belt 20 in the longitudinal direction of the fixing belt 20 that corresponds to the one portion of the heater 22 on the first side S in the longitudinal direction of the heater 22 that generates larger heat than the other portion of the heater 22 and reduce the temperature difference between the one portion and the other portion of the fixing device 9 in the longitudinal direction of the fixing device 9. The heat transfer portion includes the one portion of the fixing belt 20 extending to the one side (that is, the first side S1) of the fixing belt 20 in the longitudinal direction of the fixing belt 20, the discharger such as the discharge brush or the discharge rubber ring on the one portion of the fixing belt 20, and the temperature detector such as the thermistor on the one portion of the fixing belt 20. Additionally, the heat transfer portion may include the one portion of the pressure roller 21 extending to the one side (that is, the first side S1) of the pressure roller 21 in the longitudinal direction of the pressure roller 21, the one portion of the heater holder 23 extending to the one side (that is, the first side S1) of the heater holder 23 in the longitudinal direction of the heater holder 23, the drive transmitter such as the drive transmission gear provided in the one portion of the fixing device 9 on the one side (that is, the first side S1) of the fixing device 9 in the longitudinal direction of the fixing device 9, or the temperature detector such as the thermistor provided in the one portion of the fixing device 9.

A layout of the electrodes and the like arranged on the base 50 of the heater 22 is not limited to the above embodiments, and the present disclosure may be applied to the heater in which a temperature difference occurs between one portion and the other portion of the heater in the longitudinal direction.

Figure 32:
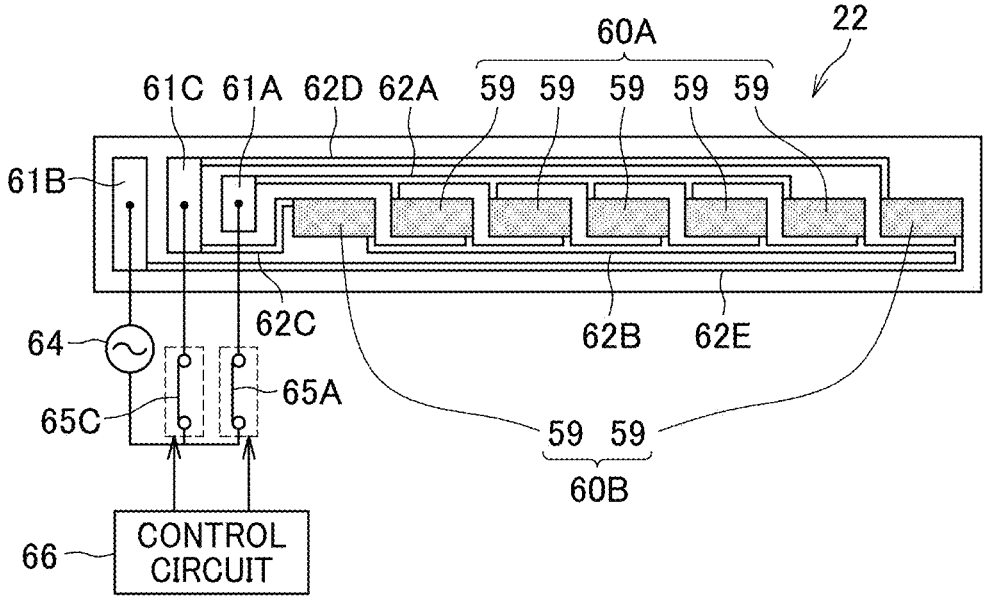
FIG. 32 is a schematic diagram illustrating a circuit to supply power to the heater according to another embodiment of the present disclosure.

For example, FIG. 32 illustrates an example of another heater to which the present disclosure is applied. All electrodes of the heater 22 illustrated in FIG. 32 are arranged on one portion of the heater 22 in the longitudinal direction of the heater 22, which is different from the above-described embodiments. That is, the second electrode 61B and other electrodes of the heater 22 in FIG. 32 is disposed on one end portion in the longitudinal direction of the heater 22, which is different from the heater 22 in FIG. 10. As illustrated in FIG. 32, since the second electrode 61B is disposed on one end portion of the heater 22 in the longitudinal direction of the heater 22, the power supply line directly connected to the second electrode 61B extends to the other end portion of the heater 22 in the longitudinal direction and turns back to resistive heat generators 59 to be connected to all resistive heat generators 59. In the present embodiment, the power supply line that connects the second electrode 61B and all resistive heat generators 59 includes the second power supply line 62B that is connected to all resistive heat generators 59 and extends to a turning back position on the other end portion of the heater 22 and a fifth power supply line 62E as the conductor extending from the turning back position to the second electrode 61B on the one end portion of the heater 22 in the longitudinal direction of the heater 22.

The temperature difference in the longitudinal direction as described above occurs in the above heater 22 of FIG. 32 when the first heat generator group 60A is energized and when the first heat generator group 60A and the second heat generator group 60B are energized.

Figure 33:
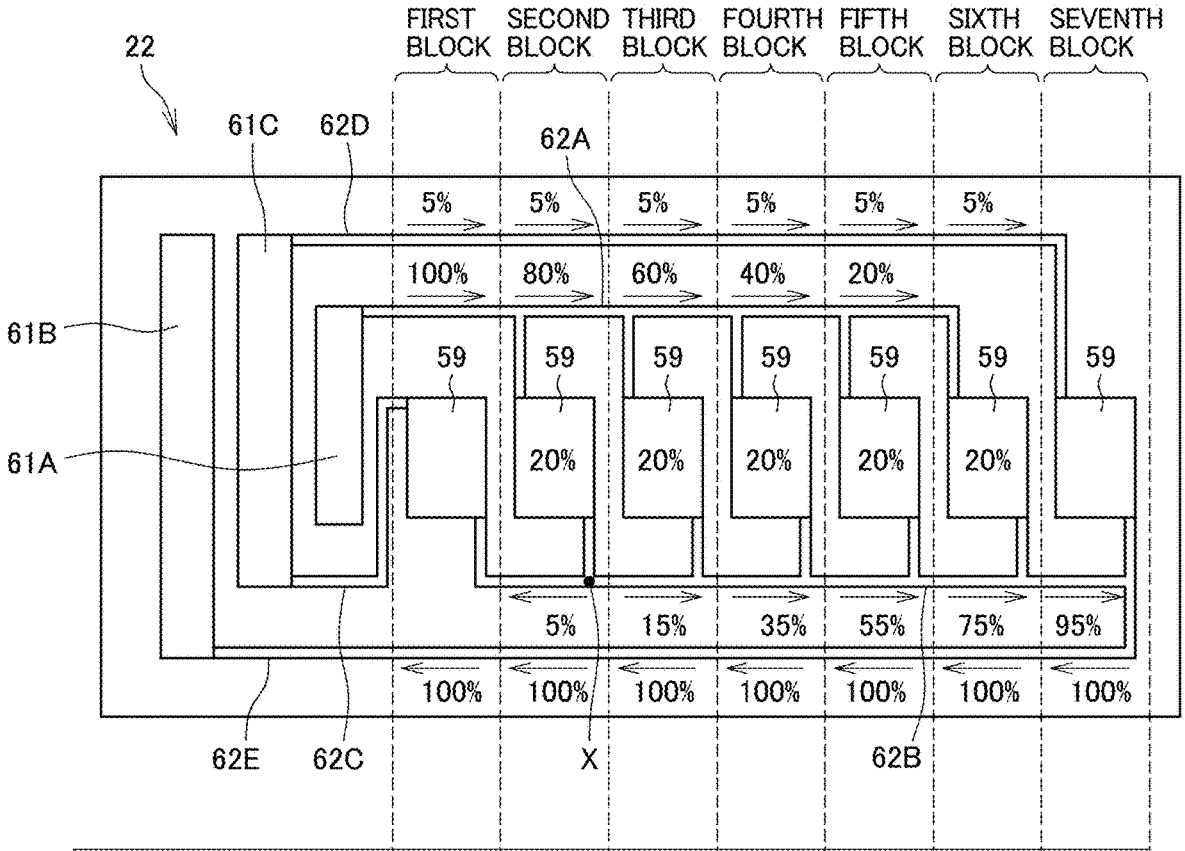
FIG. 33 is a schematic view illustrating heat generation amounts generated by power supply lines in each block of the heater depicted in FIG. 32 in which the unintended shunt occurs.
Figure 34:
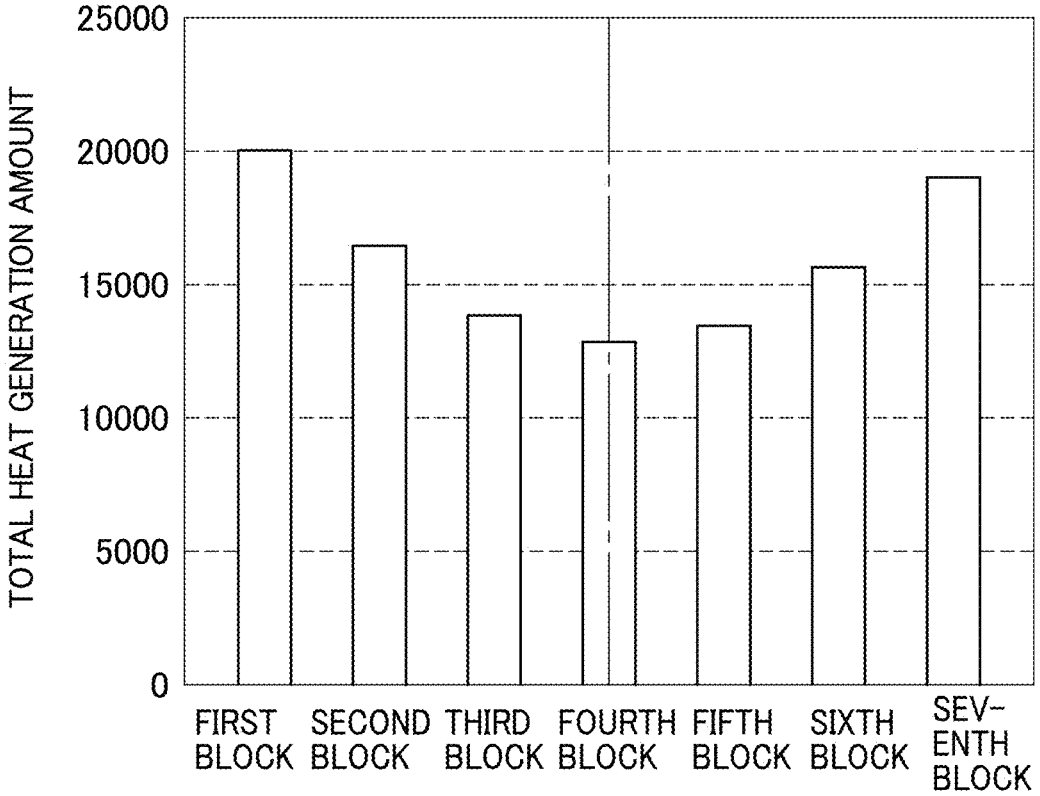
FIG. 34 is a graph illustrating a total heat generation amount generated by power supply lines in each block of the heater illustrated in FIG. 33.
Figure 35:
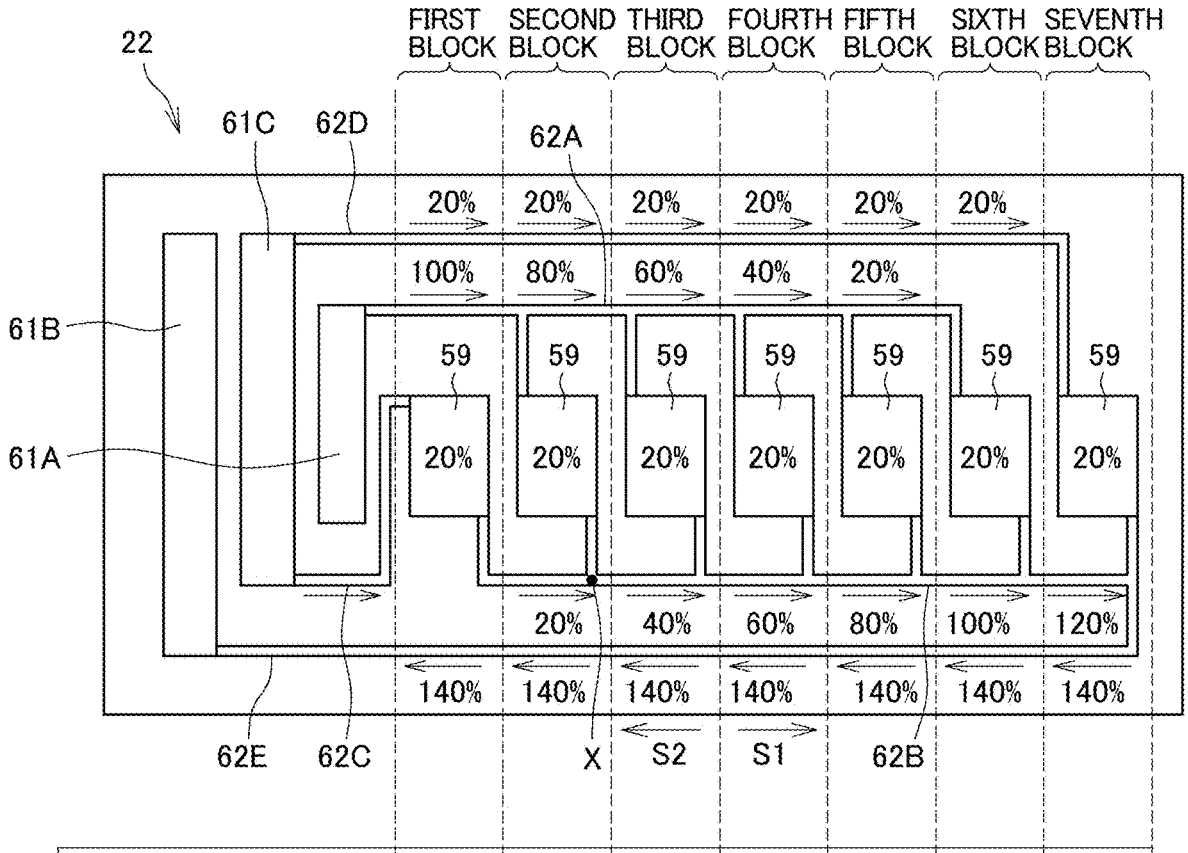
FIG. 35 is a schematic view illustrating heat generation amounts generated by power supply lines in each block of the heater depicted in FIG. 32 when all heat generators are energized.
Figure 36:
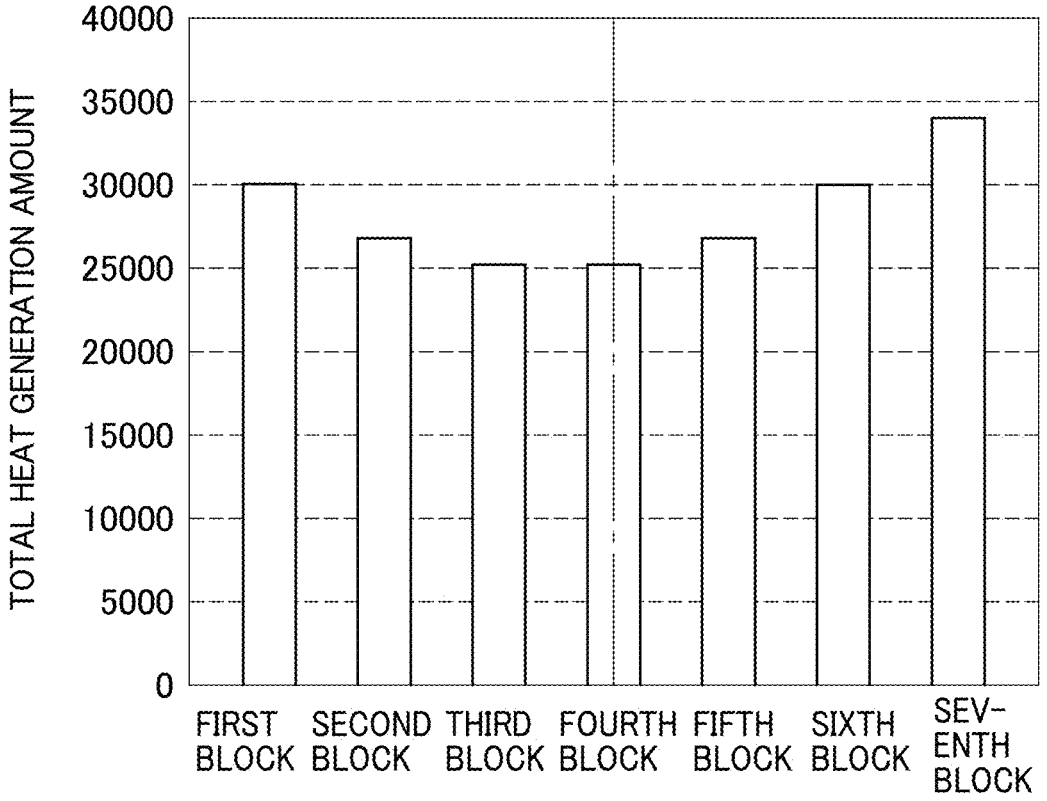
FIG. 36 is a graph illustrating the total heat generation amount generated by the power supply lines in each block of the heater illustrated in FIG. 35.

When only the first heat generator group 60A is energized, the unintended shunt occurs and flows toward the third power supply line 62C, as illustrated in FIGS. 33 and 34. As a result, the distribution of the total heat generation amounts becomes asymmetrical shape in the lateral direction with respect to the fourth block located in the center of the heat generation area, and the heat generation amount in the other portion of the heater on the other side of the heater in the longitudinal direction of the heater is larger than the heat generation amount in the one portion of the heater. When the first heat generator group 60A and the second heat generator group 60B are energized, as illustrated in FIGS. 35 and 36, the distribution of the total heat generation amounts becomes asymmetrical shape in the lateral direction with respect to the fourth block, and the heat generation amount in the one portion of the heater on the one side (that is, the first side S1) of the heater in the longitudinal direction of the heater is larger than the heat generation amount in the other portion of the heater on the other side of the heater in the longitudinal direction of the heater.

As in the above-described embodiments, providing the heat transfer portion on the first side S1 of the fixing device 9 that corresponds to the one portion of the heater 22 on the one side (that is, the first side S1) of the heater 22 in the longitudinal direction of the heater 22 that generates larger heat than the other portion of the heater 22 reduces the temperature difference between the one portion and the other portion of the fixing device 9 in the longitudinal direction when all the heat generator groups are energized. As a result, the above-described configuration can reduce the difference in the fixing property between one portion and the other portion of the image in the longitudinal direction of the image and the unevenness in glossiness of the image in the longitudinal direction. That is, unevenness of the image or the unevenness in glossiness of the image on the sheet can be reduced.

Figure 37:
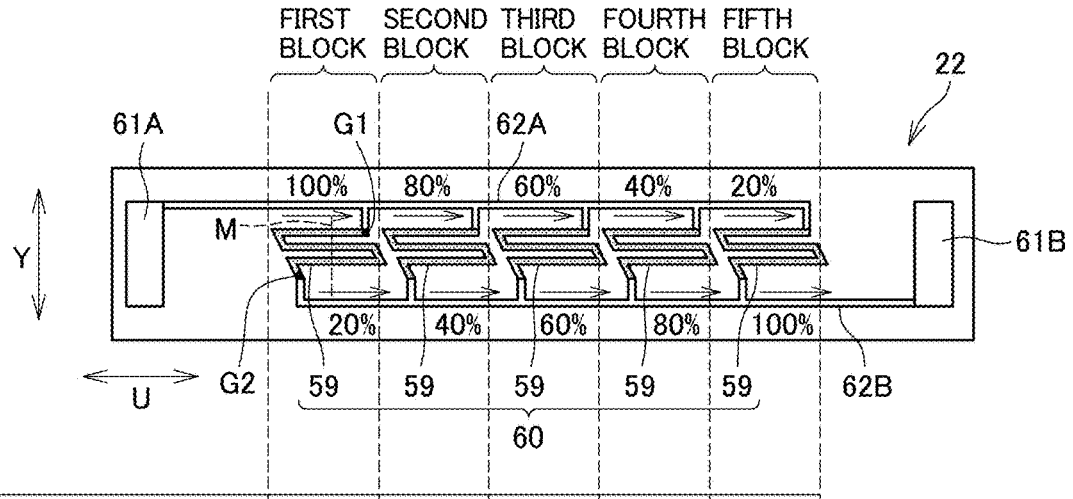
FIG. 37 is a schematic view illustrating heat generation amounts generated by power supply lines in each block of the heater including two electrodes.
Figure 37:
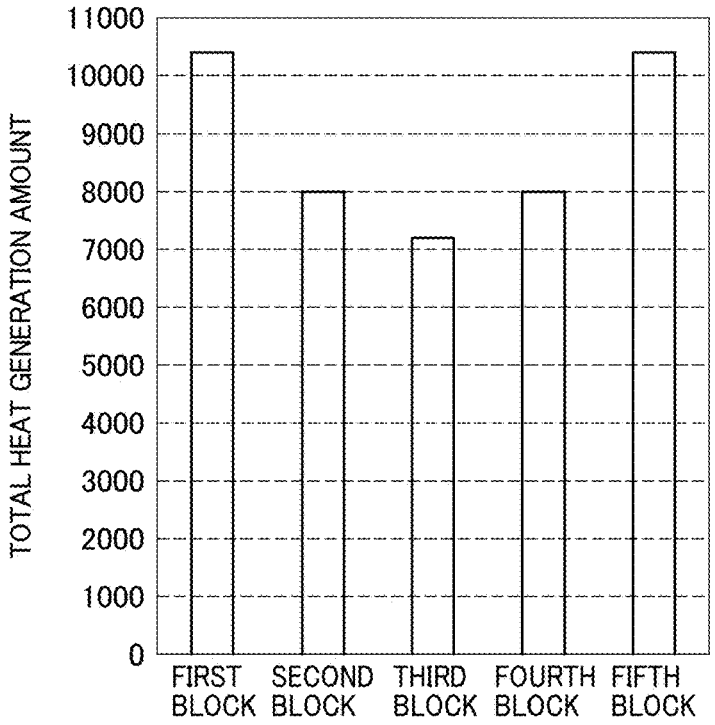

The present disclosure may be applied to the heater having a configuration that is different from the above-described heaters and includes two electrodes. For example, as illustrated in FIG. 37, the heater 22 includes the heat generator 60 including the plurality of resistive heat generators 59, the plurality of electrodes 61, and the plurality of power supply lines 62 that electrically connects the heat generator 60 and the plurality of electrodes 61. In the present embodiment, the plurality of electrodes 61 includes a first electrode 61A and a second electrode 61B. The first electrode 61A and the second electrode 61B are arranged on opposed longitudinal end sides of the base 50.

Figure 38:
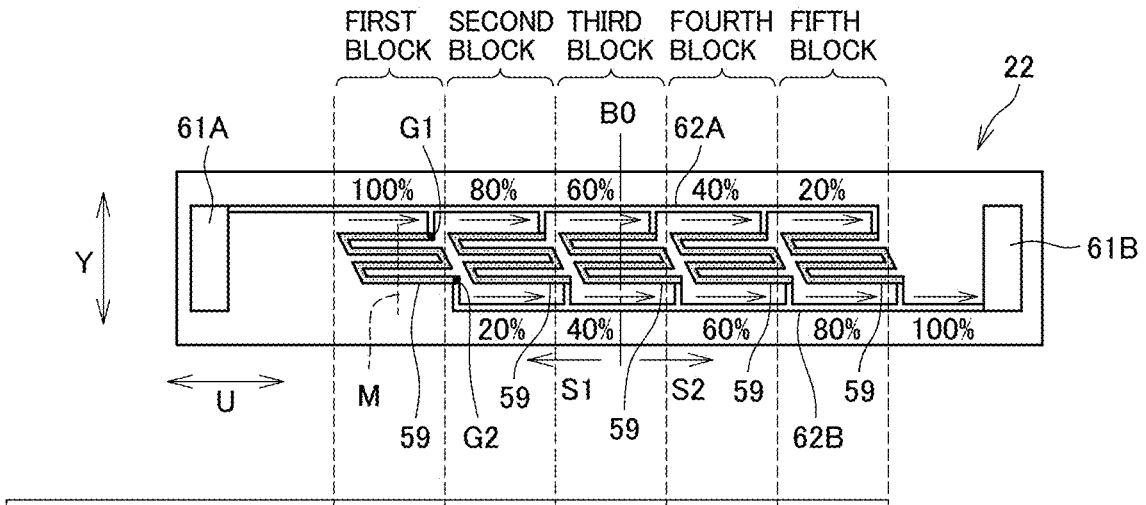
FIG. 38 is a schematic view illustrating heat generation amounts generated by power supply lines in each block of the heater in which each power supply line couples each resistive heat generator at a coupling position different from a coupling position in FIG. 37.
Figure 38:
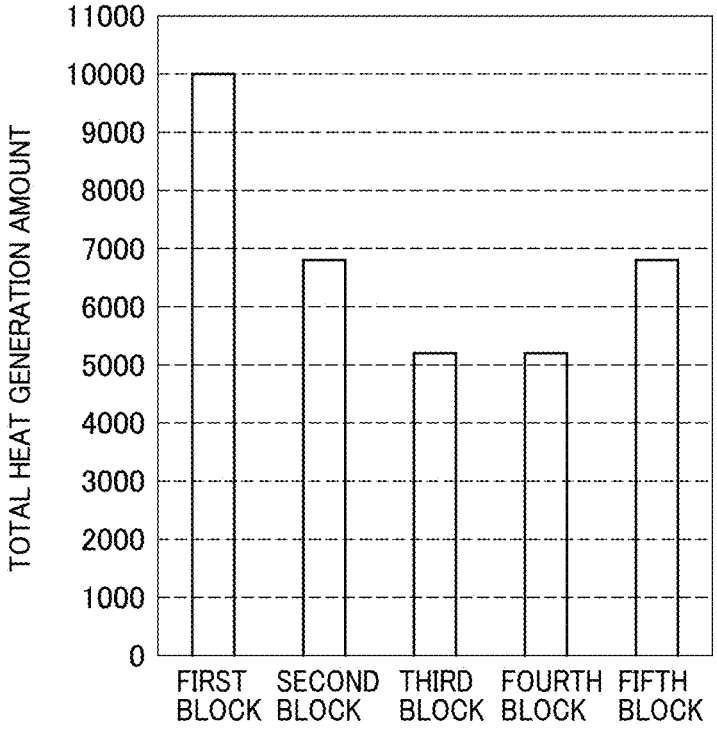
Figure 39:
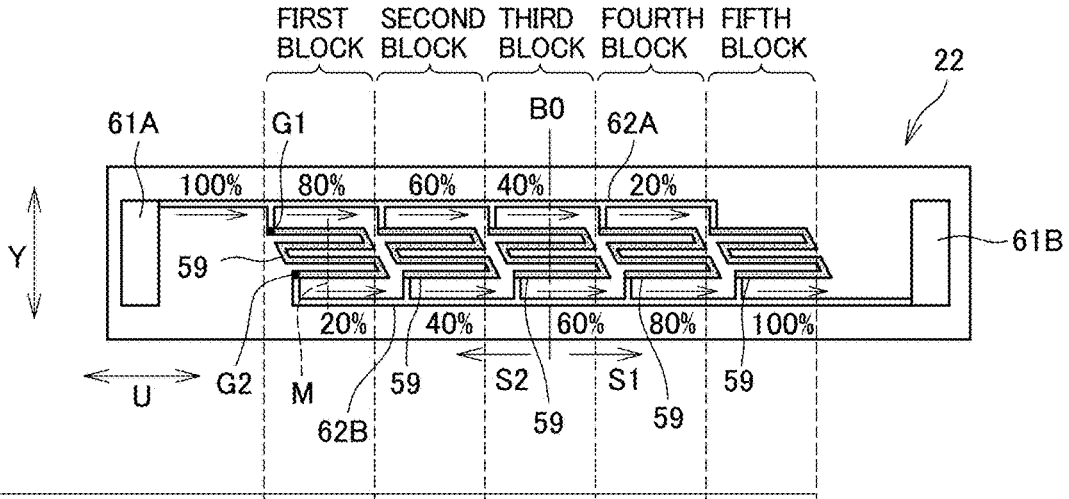
FIG. 39 is a schematic view illustrating heat generation amounts generated by power supply lines in each block of the heater in which each power supply line couples each resistive heat generator at a coupling position different from coupling positions in FIGS. 37 and 38.
Figure 39:
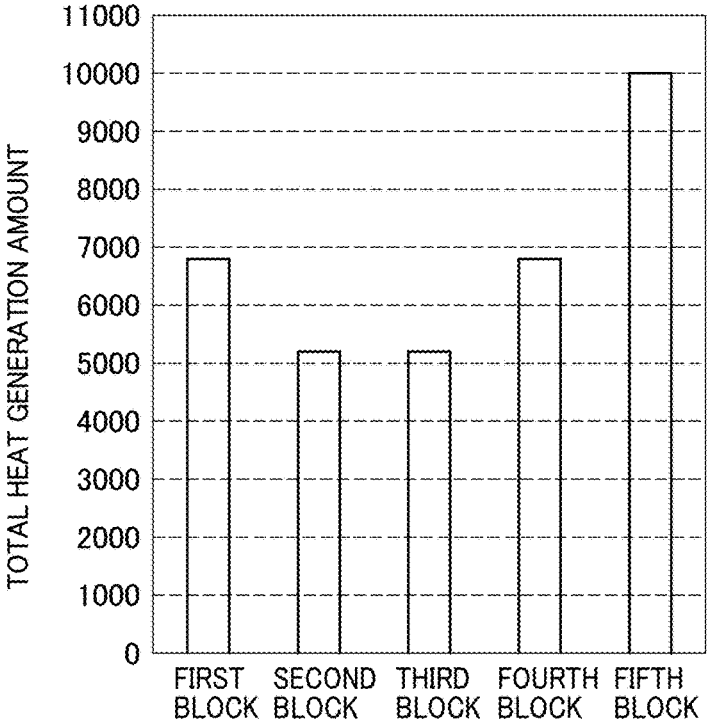

The difference between the above-described embodiments and the present embodiment is a configuration of the resistive heat generator 59. The resistive heat generator 59 includes a plurality of straight-line portions extending in the longitudinal direction U of the heater 22 in FIG. 37 and a plurality of curved line portions that curves in the short-side direction Y in FIG. 37 and connects the straight-line portions. That is, the resistive heat generator 59 has a plurality of turns. A first end of each of the resistive heat generators 59 in the short-side direction Y of the heater 22 is connected to the first electrode 61A through the first power supply line 62A. In other words, the first power supply line 62A is connected to the first end of each of the resistive heat generators 59 in the short-side direction Y of the heater 22 at a connection position G1. A second end of each of the resistive heat generators 59 in the short-side direction Y of the heater 22 is connected to the second electrode 61B through the second power supply line 62B. In other words, the second power supply line 62B is connected to the second end of each of the resistive heat generators 59 in the short-side direction Y of the heater 22 at a connection position G2. Thus, the resistive heat generators 59 are connected in parallel with each other to the first electrode 61A and the second electrode 61B through the first power supply line 62A and the second power supply line 62B, respectively. In other words, the first power supply line 62A serving as a first conductor is configured to connect the resistive heat generators 59 in parallel with each other to the first electrode 61A. The second power supply line 62B serving as a second conductor is configured to connect the resistive heat generators 59 in parallel with each other to the second electrode 61B The following is a description of difference in amounts of heat generated by the power supply lines having different connection positions in the above described heater 22. FIG. 37 illustrates the heater 22 including the resistive heat generator 59 in which the connection position G1 connecting the power supply line 62A and the resistive heat generator 59 is on the opposite side of the connection position G2 connecting the power supply line 62B and the resistive heat generator 59 from the center line M in the longitudinal direction of the heater 22. FIG. 38 illustrates the heater 22 including the resistive heat generator 59 having the connection positions G1 and G2 arranged at the right side, that is, the one side, with respect to the center line M. FIG. 39 illustrates the heater 22 including the resistive heat generator 59 having the connection positions G1 and G2 arranged at the left side, that is, the other side, with respect to the center line M. FIGS. 37 to 39 illustrate heat generation amounts of each power supply lines in each block and total heat generation amounts in each block when the voltage is applied to the first electrode 61A and the second electrode 61B.

As illustrated in FIG. 37, when the connection position G1 is on the opposite side of the connection position G2 from the center line M, the distribution of the total heat generation amounts becomes the lateral symmetrical shape with respect to the third block located in the center of the heat generation area. In contrast, as illustrated in FIGS. 38 and 39, when the connection positions G1 and G2 of the power supply lines 62A and 62B for each resistive heat generator 59 are arranged on the same side with respect to the center line M, the distribution of the total heat generation amounts becomes the lateral asymmetrical shape with respect to the third block located in the center of the heat generation area. Specifically, in FIG. 38, the total heat amount in the right side portion of the heater 22 that is the one portion of the heater 22 on the one side of the heater 22 in the longitudinal direction of the heater 22 is smaller than the total heat generation amount in the left side portion of the heater 22 that is the other portion of the heater 22 on the other side of the heater 22 in the longitudinal direction of the heater 22. Therefore, the one side is the second side S2, and the other side is the first side S1 in FIG. 38. In FIG. 39, the total heat amount in the right side portion of the heater 22 that is the one portion of the heater 22 on the one side of the heater 22 in the longitudinal direction of the heater 22 is larger than the total heat generation amount in the left side portion of the heater 22 that is the other portion of the heater 22 on the other side of the heater 22 in the longitudinal direction of the heater 22. Therefore, the one side is the first side S1, and the other side is the second side S2 in FIG. 39.

In short, depending on whether the connection positions G1 and G2 are located on different sides or the same side with respect to the center line M in the longitudinal direction U, the total heat generation amounts of the power supply lines 62 are symmetric on the one hand and asymmetric on the other hand. As illustrated in FIGS. 38 and 39, the asymmetrical distribution of the total heat generation amounts of the power supply lines in the lateral direction of the heater 22 affects a temperature distribution of the heater, and the temperature distribution of the heater is asymmetric. The asymmetrical temperature distribution of the heater may cause trouble such as the unevenness in glossiness of the toner image or the unevenness in the fixing property of the toner image. The number of turns in the resistive heat generator 59 changes the connection position. Therefore, counter measures against the above-described trouble caused by the asymmetrical distribution of the total heat generation amounts of the power supply lines improve the flexibility of heater design.

Embodiments of the fixing device 9 including the above described heater 22 and the above-described heat transfer portions are described with reference to FIGS. 40 to 44. In the following description, among the above heaters 22, the heater 22 is the one illustrated in FIG. 38. That is, the connection positions G1 and G2 are arranged at the right side, that is, the one side of the heater 22, with respect to the center line M in the longitudinal direction of the heater 22. In this case, as described above, the first side S1 is the left side in FIGS. 40 to 44 that is in the one side of the fixing device 9 in the longitudinal direction of the fixing device 9, and the second side S2 is the right side in FIGS. 40 to 44 that is in the other side of the fixing device 9 in the longitudinal direction of the fixing device 9.

Figure 40:
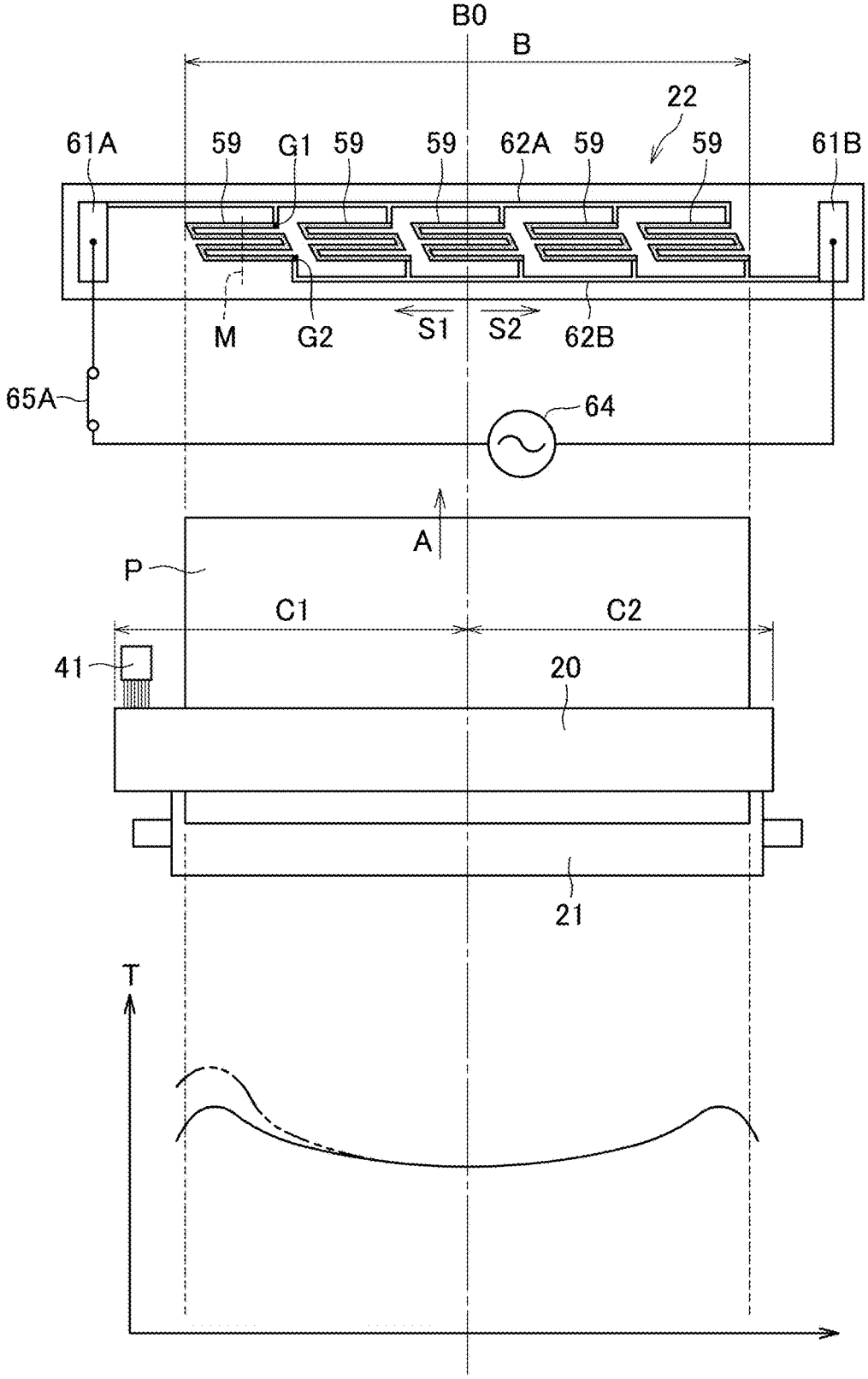
FIG. 40 is a schematic view illustrating a longitudinal positional relationship of the heater and other parts in the fixing device including the heater illustrated in FIG. 38 that includes a thermal conductor illustrated in FIG. 17.

As illustrated in FIG. 40, in the fixing belt 20, a length C2 from the center line B0 to one end of the fixing belt 20 on the one side (that is, the second side S2) of the fixing belt 20 in the longitudinal direction of the fixing belt 20 is shorter than a length C1 from the center line B0 to the other end of the fixing belt 20 on the other side (that is, the first side S1) of the fixing belt 20 in the longitudinal direction of the fixing belt 20. The portion of the fixing belt 20 outside the heating span B becomes the heat transfer portion that releases the heat from the heating span B. The fixing device 9 includes the discharge brush 41 serving as the discharger facing the above-described portion of the fixing belt 20. In addition to the portion of the fixing belt 20 outside the heating span B, the discharge brush 41 contacts the fixing belt 20 as a part of the heat transfer portion and increases the amount of heat released from the heating span B to the heat transfer portion.

Figure 41:
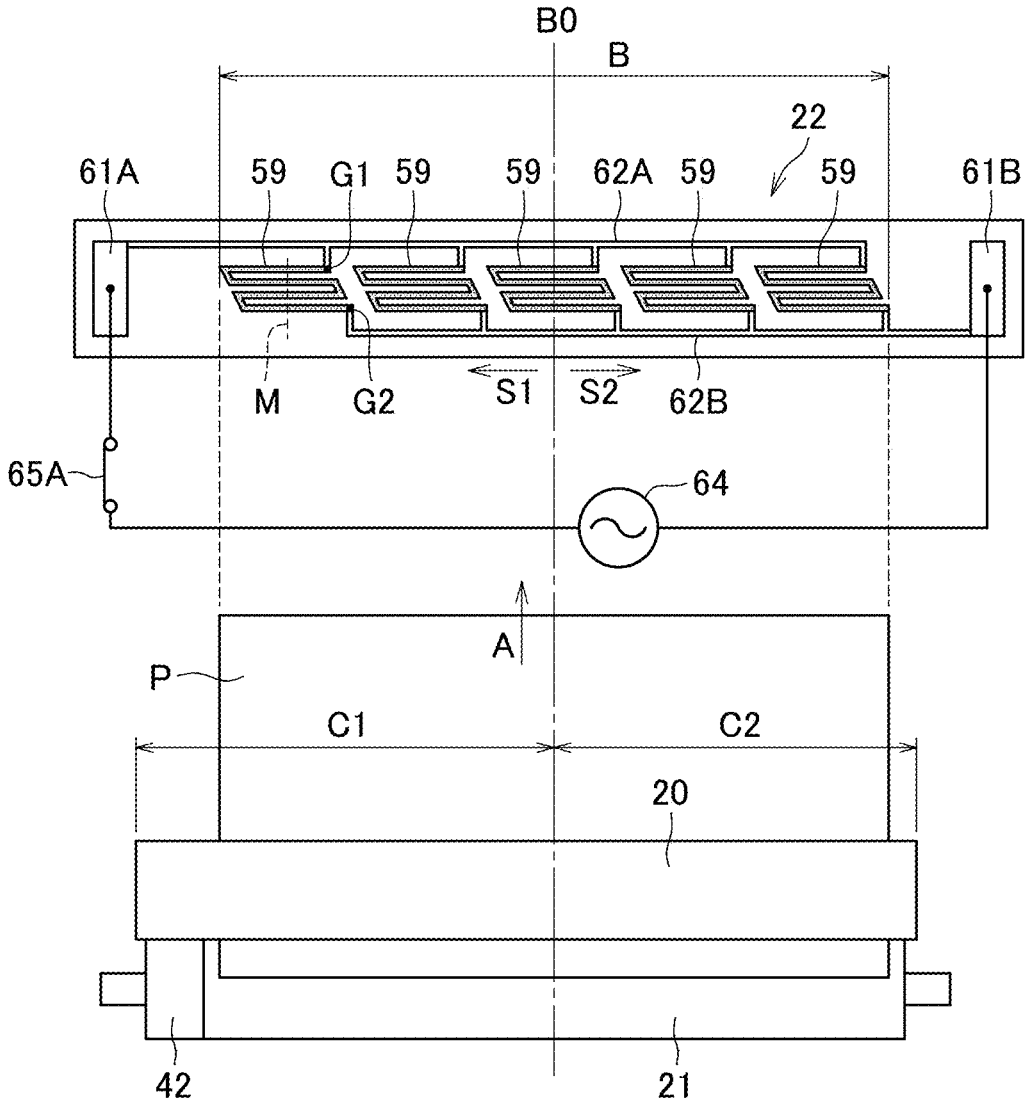
FIG. 41 is a schematic view illustrating a longitudinal positional relationship of the heater and other parts in the fixing device including the heater illustrated in FIG. 38 that includes a thermal conductor illustrated in FIG. 18.

In an embodiment illustrated in FIG. 41, the fixing device 9 includes the discharge rubber ring 42 as the discharger instead of the discharge brush 41 in the other portion of the pressure roller 21 on the other side of the pressure roller 21 in the longitudinal direction of the pressure roller 21. The other portion of the pressure roller 21 corresponds to the other portion of the heater 22 on the other side of the heater 22 that generates larger heat than the one portion of the heater 22 on the one side of the heater 22 in the longitudinal direction of the heater 22 and is on the first side S1. The above-described discharge rubber ring 42 contacting the other portion of the fixing belt 20 on the other side of the fixing belt 20 in the longitudinal direction of the fixing belt 20 increases the thermal capacity related to the other portion of the fixing belt 20 in the longitudinal direction of the fixing belt 20 that is the portion of the fixing belt 20 on the first side S1 and releases a lot of heat from the heating span B.

Figure 42:
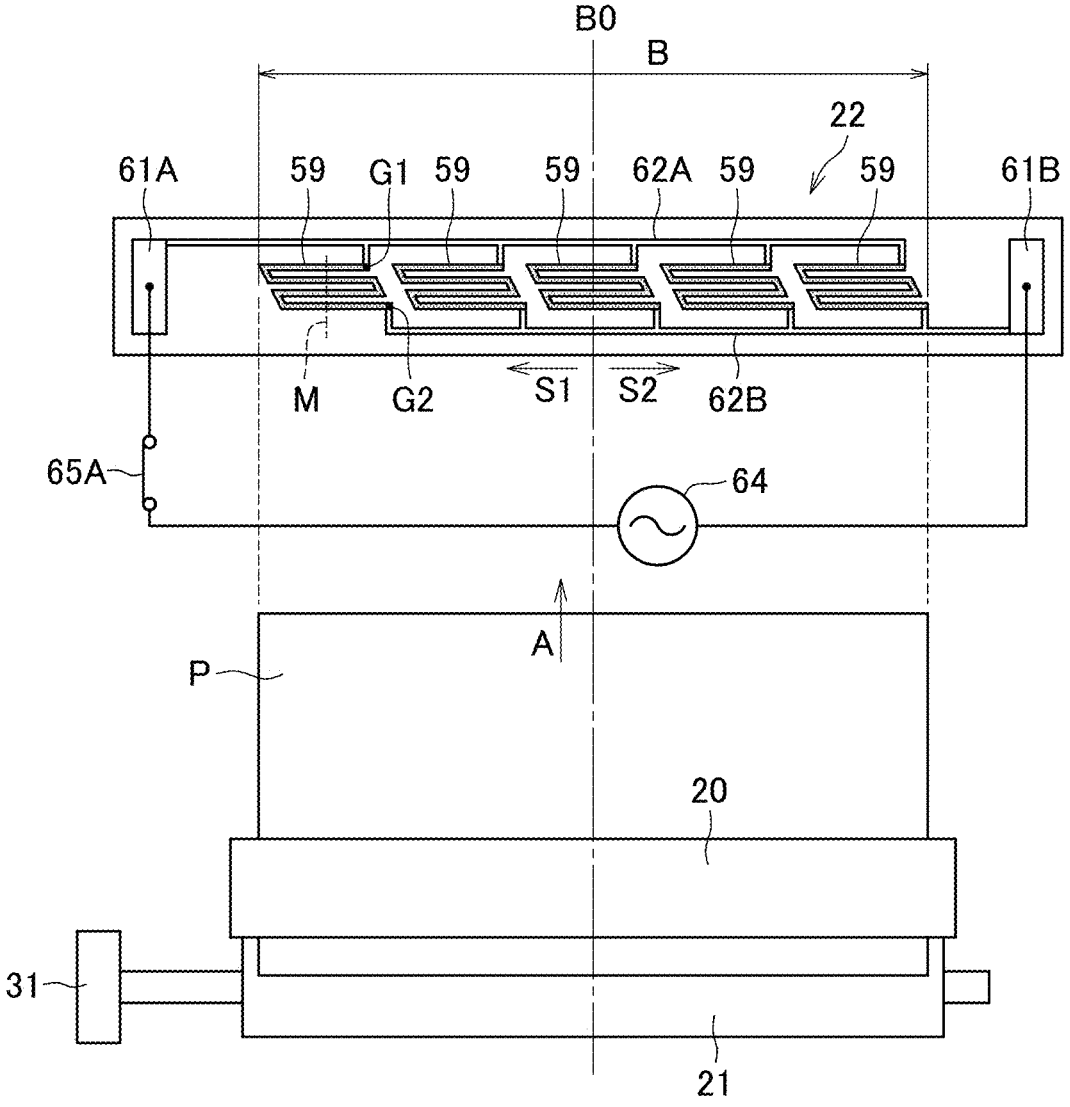
FIG. 42 is a schematic view illustrating a longitudinal positional relationship of the heater and other parts in the fixing device including the heater illustrated in FIG. 38 that includes a drive gear as a thermal conductor.

In an embodiment illustrated in FIG. 42, the pressure roller 21 includes a shaft extending in the longitudinal direction of the pressure roller 21 from the other end of the pressure roller 21 on the other side (that is, the first side S1) of the pressure roller 21 to attach the drive transmission gear 31 serving as the drive transmitter. The drive transmission gear 31 functions as a part of the heat transfer portion. The heat transfer portion in the present embodiment includes the drive transmission gear 31, the shaft extending from the other end of the pressure roller 21 on the other side (that is, the first side S1) of the pressure roller 21 in the longitudinal direction of the pressure roller 21 to attach the drive transmission gear 31, the lengthened part of the pressure roller 21 to the other side (that is, the first side S1) of the pressure roller 21 in the longitudinal direction of the pressure roller 21. The heat transfer portion increases the thermal capacity related to the other portion of the fixing belt 20 on the other side (that is, the first side S1) of the fixing belt 20 in the longitudinal direction of the fixing belt 20 and releases a lot of heat from the heating span B.

Figure 43:
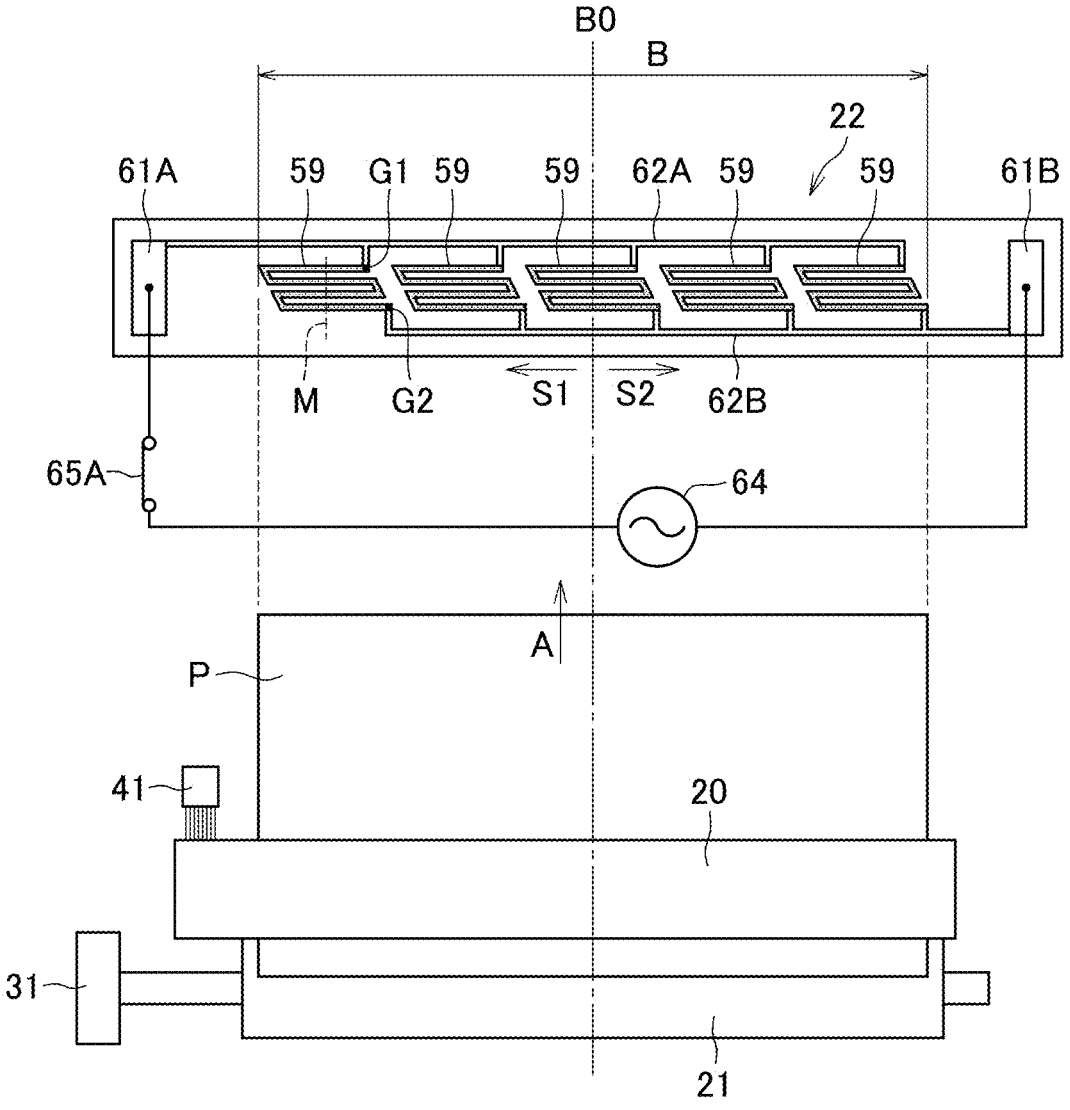
FIG. 43 is a schematic view illustrating a longitudinal positional relationship of the heater and other parts in the fixing device including the heater illustrated in FIG. 38 that includes a thermal conductor illustrated in FIG. 20.
Figure 44:
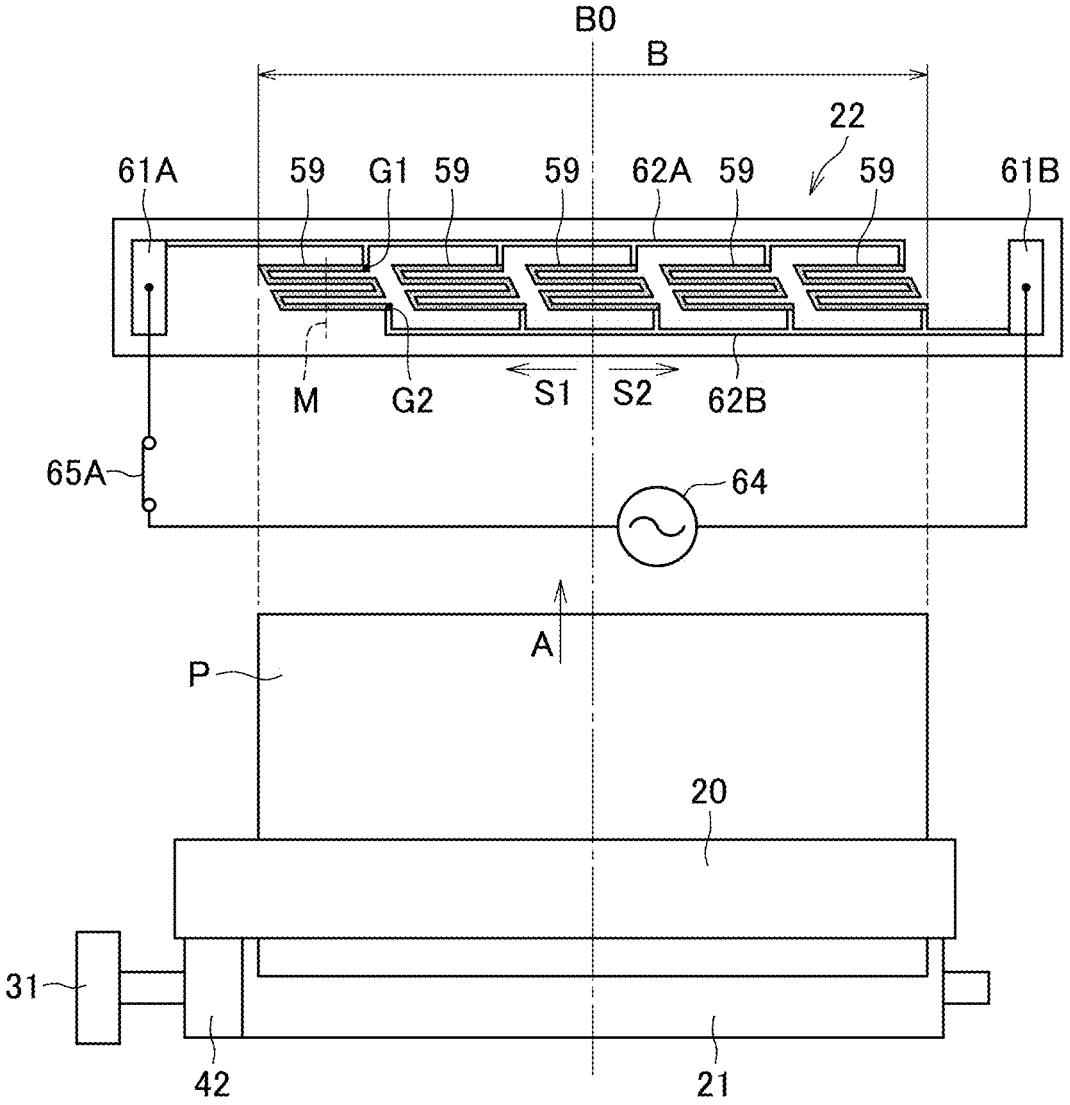
FIG. 44 is a schematic view illustrating a longitudinal positional relationship of the heater and other parts in the fixing device including the heater illustrated in FIG. 38 that includes a thermal conductor illustrated in FIG. 21.

Alternatively, as illustrated in FIG. 43, the fixing device 9 may include the drive transmission gear 31 on the other end of the pressure roller 21 on the other side (that is, the first side S1) of the pressure roller 21 in the longitudinal direction of the pressure roller 21 and the discharge brush 41 facing the other portion of the fixing belt 20 on the other side of the fixing belt 20. As illustrated in FIG. 44, the fixing device 9 may include the discharge rubber ring 42 instead of the discharge brush 41 in the other portion of the pressure roller 21 on the other side of the pressure roller 21 in addition to the drive transmission gear 31 described above.

As described in the above embodiments, providing the heat transfer portion on the other side (that is, the first side) from the center line B0 of the heating span of the heater 22 in the longitudinal direction of the heater 22 changes the thermal capacity related to the portion of the fixing belt 20 on the first side S1 of the fixing belt 20 to be larger than the thermal capacity related to the portion of the fixing belt 20 on the one side (that is, the second side S2) and releases the heat in the heating span B. The above-described configuration can reduce the temperature difference between the one portion and the other portion of the fixing device 9 in the longitudinal direction of the fixing device 9.

Figure 45:
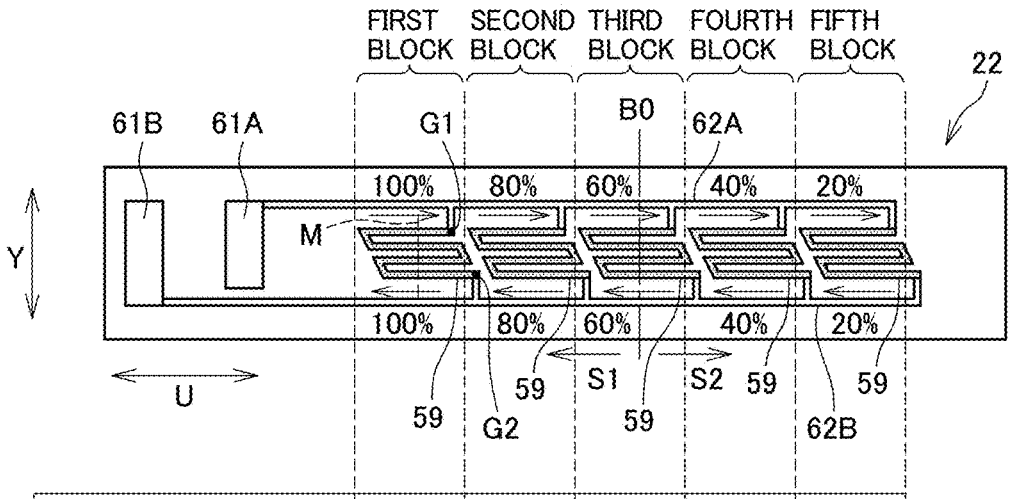
FIG. 45 is a schematic view illustrating heat generation amounts generated by power supply lines in each block of the heater having an arrangement of electrodes different from the arrangement in FIG. 38.
Figure 45:
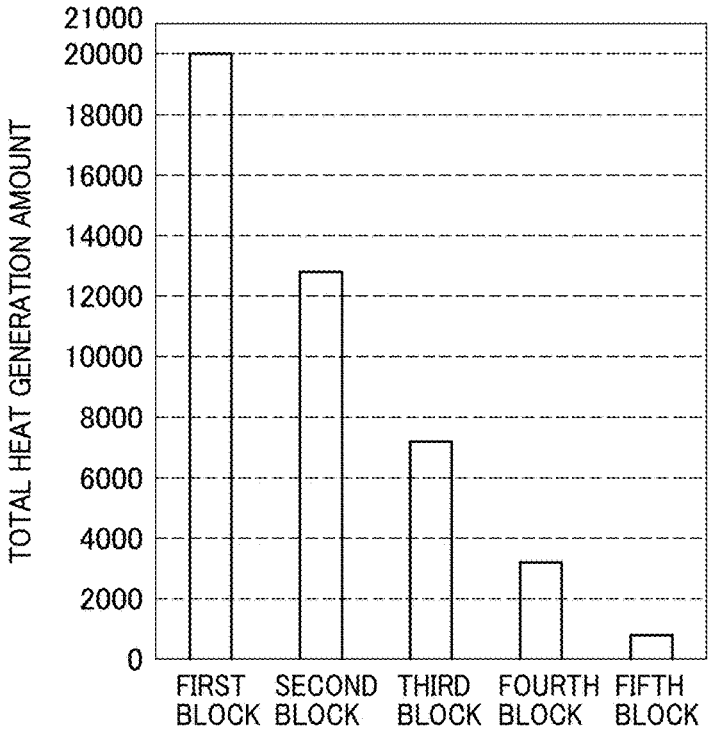

As illustrated in FIG. 45, the heater 22 may include all the electrodes 61 on the same side in the longitudinal direction of the heater 22. That is, the second electrode 61B and other electrodes of the heater 22 in FIG. 45 is disposed on the other end portion of the heater 22 on the other side of the heater 22 in the longitudinal direction of the heater 22, which is different from the heater 22 in FIG. 39. In addition, as illustrated in FIG. 45, the second power supply line 62B extends from the one end portion of the heater 22 to the second electrode 61B on the other end portion of the heater 22 in the longitudinal direction of the heater 22 and connects to the second electrode 61B.

As illustrated in FIG. 45, the distribution of the total heat generation amounts in the present embodiment also becomes the lateral asymmetrical shape with respect to the third block located in the center of the heat generation area. Specifically, in the longitudinal direction of the heater 22, an amount of heat generated in the left side portion of the heater 22 that is the other portion of the heater 22 is larger than an amount of heat generated in the right side portion of the heater 22 that is the one portion of the heater 22. That is, the other portion is on the first side S1, and the one portion is on the second side S2.

Figure 46:
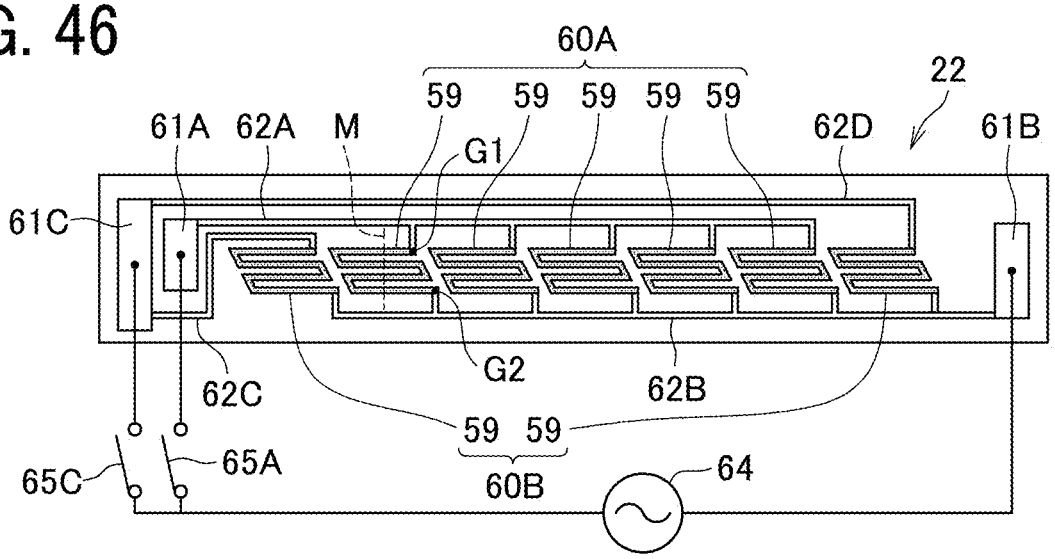
FIG. 46 is a plan view of a first variation of the heater according to an embodiment of the present disclosure.

The heater 22 illustrated in FIG. 7 and including three electrodes and two heat generator groups may include the resistive heat generator 59 illustrated in FIG. 46, including a plurality of straight-line portions extending in the longitudinal direction U of the heater 22 in FIG. 46 and a plurality of curved line portions that curves in the short-side direction in FIG. 46 and connects the straight-line portions, and having a plurality of turns.

Figure 47:
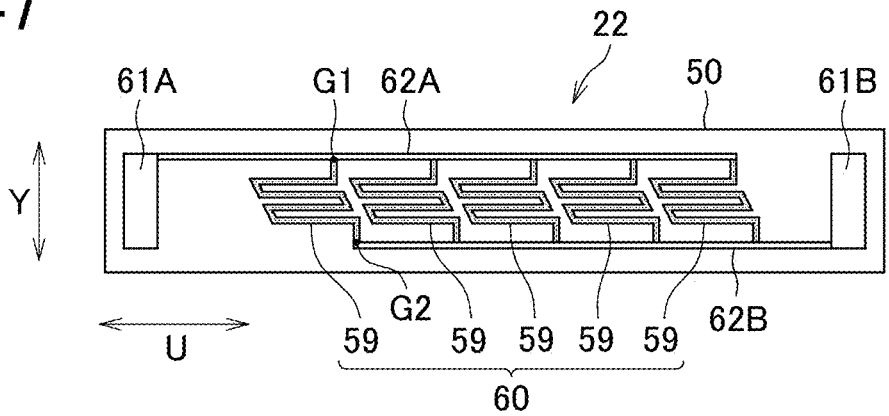
FIG. 47 is a plan view of a second variation of the heater according to an embodiment of the present disclosure.

In the embodiments described above, each of the first power supply line 62A and the second power supply line 62B has short-side portions extending in the short-side direction Y of the heater 22 as illustrated in FIG. 45 and connected to each of the resistive heat generators 59. However, the short-side portion that connects each of the first power supply line 62A and the second power supply line 62B to each of the resistive heat generators 59 is not limited to a part of each of the first power supply line 62A and the second power supply line 62B. Alternatively, as in the example illustrated in FIG. 47, the short-side portion may be a part of each of the resistive heat generators 59.

Figure 48:
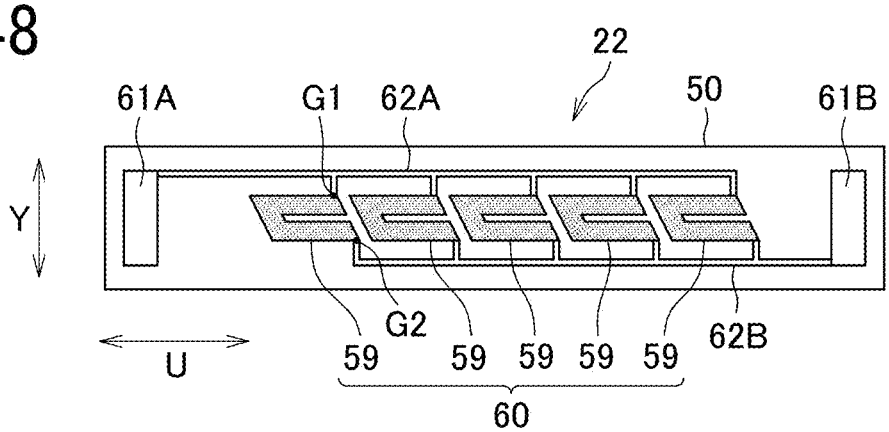
FIG. 48 is a plan view of a third variation of the heater according to an embodiment of the present disclosure.
Figure 49:
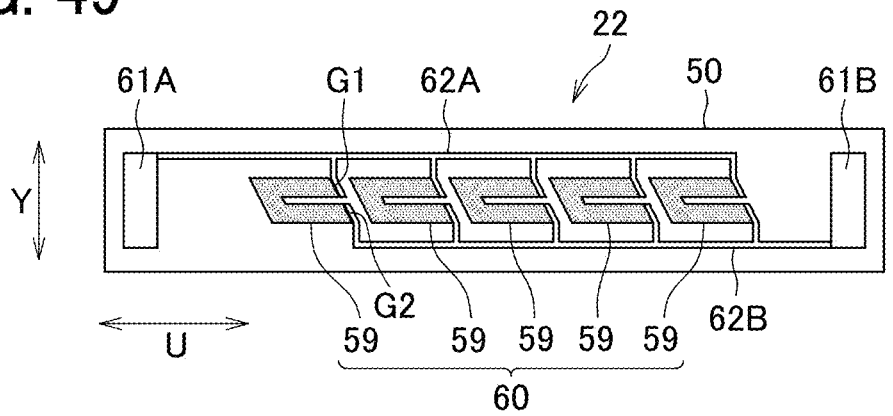
FIG. 49 is a plan view of a fourth variation of the heater according to an embodiment of the present disclosure.

In the embodiments described above, the number of turns (that is, the number of curved line portions) of each resistive heat generator 59 is not limited to multiple and may be one as illustrated in FIGS. 48 and 49. Each of the connection position G1 connecting the first power supply line 62A and each of the resistive heat generators 59 and the connection position G2 of the second power supply line 62B and each of the resistive heat generators 59 may be a corner of an end portion of each of the resistive heat generators 59 as illustrated in FIG. 48. Alternatively, as illustrated in FIG. 49, each of the connection positions G1 and G2 may be an entire edge, extending in the short-side direction Y, of the end portion of each of the resistive heat generators 59.

The fixing device 9 including each of the above-described heaters 22 may also include the heat transfer portion disposed on the portion of parts on the first side S1 in the fixing device 9 corresponding to the portion of the heater 22 that generates larger heat than the other portion of the heater 22 to reduce the temperature difference between the one portion and the other portion of the fixing device 9 in the longitudinal direction. Specifically, the portion of the heater 22 is one of the one portion on the one side and the other portion on the other side in the heater 22 with respect to the center line B0 of the heating span B in the longitudinal direction of the heater 22. As a result, the above-described configuration can reduce the difference in the fixing property between one portion and the other portion of the image in the longitudinal direction of the image and the unevenness in glossiness of the image in the longitudinal direction. That is, unevenness of the image or the unevenness in glossiness of the image on the sheet can be reduced.

Figure 50:
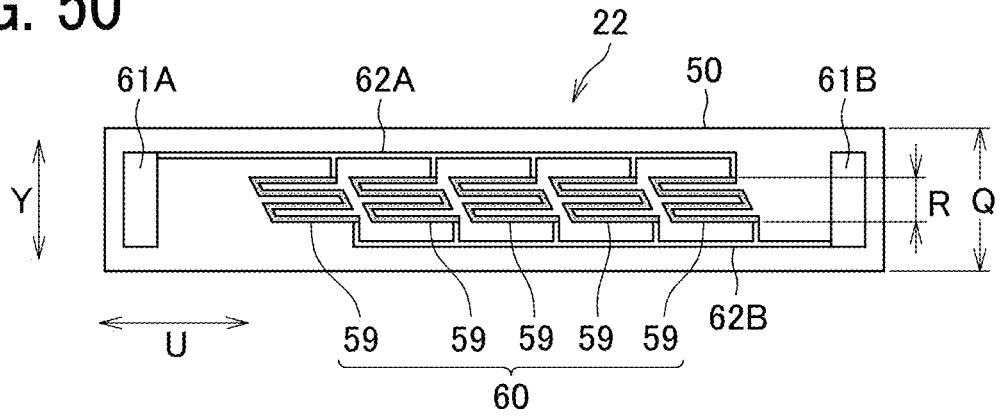
FIG. 50 is a plan view of the heater illustrated in FIG. 38, illustrating a short-side dimension of the heater and a short-side dimension of resistive heat generators.

The embodiments of the present disclosure may be applied to the fixing device 9 including the heater 22 that includes two electrodes as described above and has a ratio (R/Q) of the short-side dimension R of the resistive heat generators 59 to the short-side dimension Q of the heater 22 of 25% or more as illustrated in FIG. 50, and a greater advantage can be attained. Note that the short-side dimension R of the resistive heat generators 59 refers to a short-side dimension of the entire resistive heat generator 59, not to a thickness of the straight-line portion of the resistive heat generator 59 folded back. In a case in which the embodiments are applied to the heater 22 having a ratio (R/Q) of not less than 40% in the short-side dimension, an even greater advantage can be attained.

Figure 51:
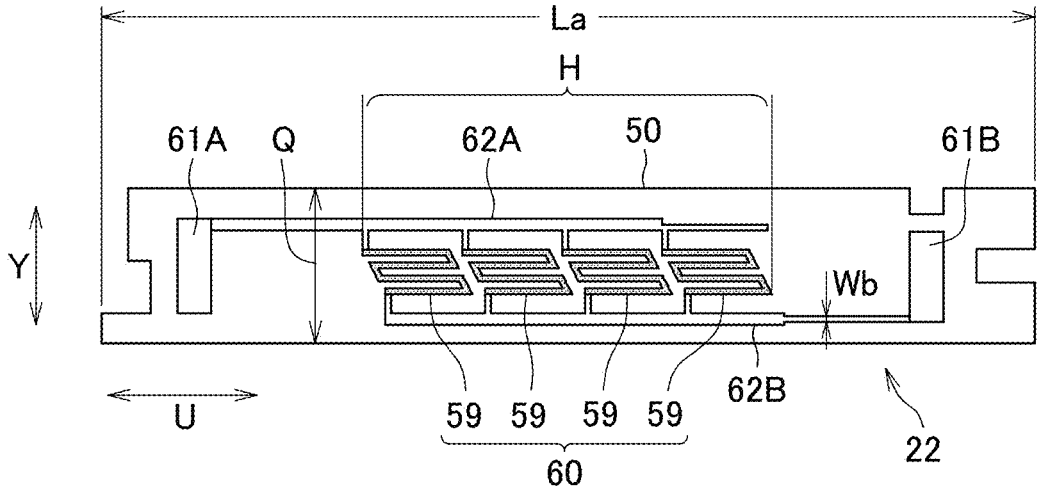
FIG. 51 is a plan view of a variation of the heater, illustrating a longitudinal dimension of the variation of the heater, a short-side dimension of the variation of the heater, and a short-side dimension of the power supply lines.

In the embodiment illustrated in FIG. 50, the base 50 of the heater 22 is a rectangle and therefore the short-side dimension Q of the heater 22 remains unchanged at any longitudinal position of the heater 22. By contrast, in a case in which the base 50 has an uneven edge as illustrated in FIG. 51, the short-side dimension Q changes depending on the longitudinal position of the heater 22. In such a case, the short-side dimension Q of the heater 22 is a smallest dimension of the heater 22 in the short-side direction Y within the heat generation span H of the heater 22 over which all the resistive heat generators 59 are disposed.

The embodiments of the present disclosure are applicable to the heater 22 in which a ratio (Q/La) of the short-side dimension Q of the heater 22 to the longitudinal dimension La of the heater 22 is greater than 1.5% and less than 6%. The embodiments of the present disclosure are also applicable to the heater 22 in which a ratio (Wb/Q) of the short-side dimension Wb of one of the first power supply line 62A and the second power supply line 62B to the short-side dimension Q of the heater 22 is greater than 2% and less than 20%. Note that, in a case in which a longitudinal dimension of the base 50 changes depending on the portion, the longitudinal dimension La of the heater 22 is a largest dimension of the heater 22 in the longitudinal direction U. For example, as illustrated in FIG. 51, a longitudinal dimension of the base 50 changes depending on the portion and therefore the longitudinal dimension La of the heater 22 is a largest dimension of the heater 22 in the longitudinal direction U. The short-side dimension Wb of the one of the first power supply line 62A and the second power supply line 62B refers to the thickness of the straight-line portion of the one of the first power supply line 62A and the second power supply line 62B extending in the longitudinal direction U of the heater 22, excluding a portion of the one of the first power supply line 62A and the second power supply line 62B bent in the short-side direction Y of the heater 22 to join the resistive heat generator 59. In a case in which the thickness of the one of the first power supply line 62A and the second power supply line 62B changes depending on the longitudinal position of the heater 22 as illustrated in FIG. 51, the short-side dimension Wb of the one of the first power supply line 62A and the second power supply line 62B refers to a smallest short-side dimension of the one of the first power supply line 62A and the second power supply line 62B within the heat generation span H.

As described above, the embodiments of the present disclosure prevent the disadvantage caused by the temperature difference between the one portion and the other portion of the heater 22 in the longitudinal direction of the heater 22 in which power supply lines are connected to a resistive heat generator on the same side in the longitudinal direction of the heater 22. Accordingly, such a heater can be positively adopted with the connection positions of the power supply lines and the resistive heat generator located on the same side in the longitudinal direction of the heater. As a consequence, the following advantages can be attained.

In general, a fixing device having a planar heater includes a heater temperature detector to detect a temperature of the heater. In the embodiment illustrated in FIG. 52, the temperature sensor 44 serves as the heater temperature detector that detects the temperature of the heater 22. The temperature sensor 44 is, e.g., a thermistor. The temperature sensor 44 contacts, e.g., a back surface of the heater 22 opposite the surface on which the heat generator 60 is disposed, to detect the temperature of the heater 22. According to the detected temperature of the heater 22, the temperature of the heater 22 or the fixing belt 20 is controlled. In general, the heater 22 has a higher temperature on a center portion of the heat generator 60 in the short-side direction Y of the heater 22 than a temperature on an end portion of the heat generator 60 in the short-side direction Y of the heater 22. In order to prevent overheating of the heater 22 in advance, the temperature sensor 44 is disposed at a position corresponding to a center K of the heat generator 60 in the short-side direction Y of the heater 22. Hereinafter, the position corresponding to the center K is simply referred to as a "short-side center position".

Figure 52:
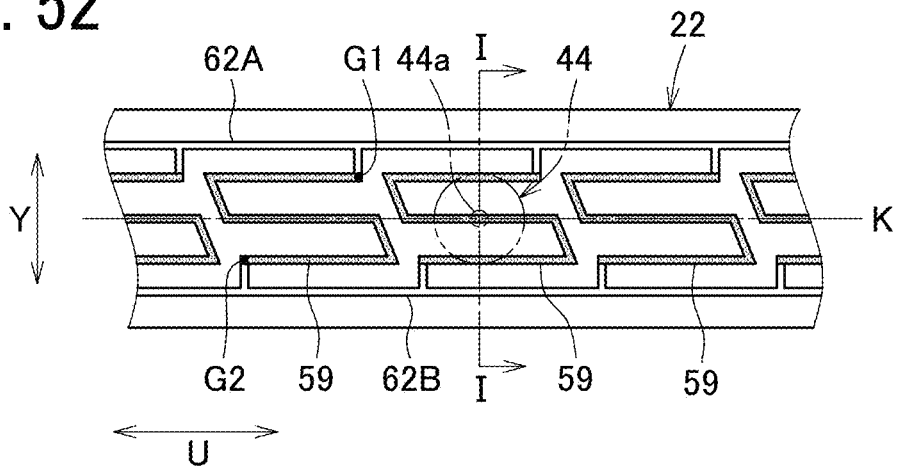
FIG. 52 is a schematic view of the comparative heater of FIG. 10A, illustrating the power supply lines connected to each resistive heat generator on the opposite sides of each resistive heat generator in the longitudinal direction of the comparative heater, with a location of the heater temperature sensor in the short-side direction of the comparative heater.

In the heater 22 according to the embodiment illustrated in FIG. 52, the connection position G1 connecting the power supply line 62A and the resistive heat generator 59 is on the opposite side of the connection position G2 connecting the power supply line 62B and the resistive heat generator 59 from the center of the resistive heat generator 59, and one of folded straight-line portions of each of the resistive heat generators 59 is located at the short-side center position K of the heat generator 60. Therefore, a temperature detection part 44*a* of the temperature sensor 44 disposed at the short-side center position K of the heat generator 60 as described above is located on the resistive heat generator 59 at the short-side center position K of the heat generator 60. Note that the term "on the resistive heat generator" as used herein refers to a position overlapping the resistive heat generator 59 in a thickness direction, which is a direction intersecting the longitudinal direction U and the short-side direction Y of the heater 22.

Figure 53:
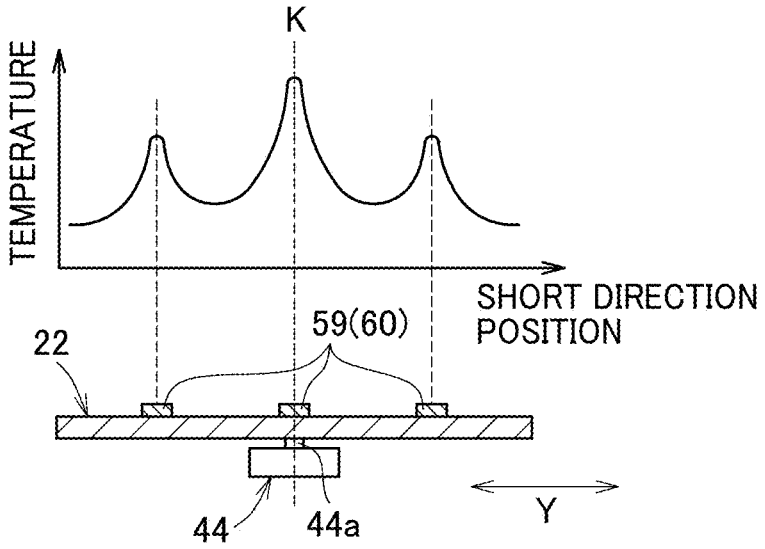
FIG. 53 is a graph of a temperature distribution of the comparative heater in a I-I cross section of FIG. 52, with a cross-sectional view of the comparative heater along a line I.

In this case, as illustrated in FIG. 53, a highest peak value is a temperature at the short-side center position K of the heat generator 60 at which the resistive heat generator 59 is located. The temperature sensor 44 detects the temperature of the peak value. However, since the temperature of the heater 22 greatly changes in a very narrow range near the peak value, the detected temperature might greatly change if the temperature sensor 44 is slightly displaced in the short-side direction Y of the heater 22, hampering an appropriate detection of the temperature of the heater 22.

Figure 54:
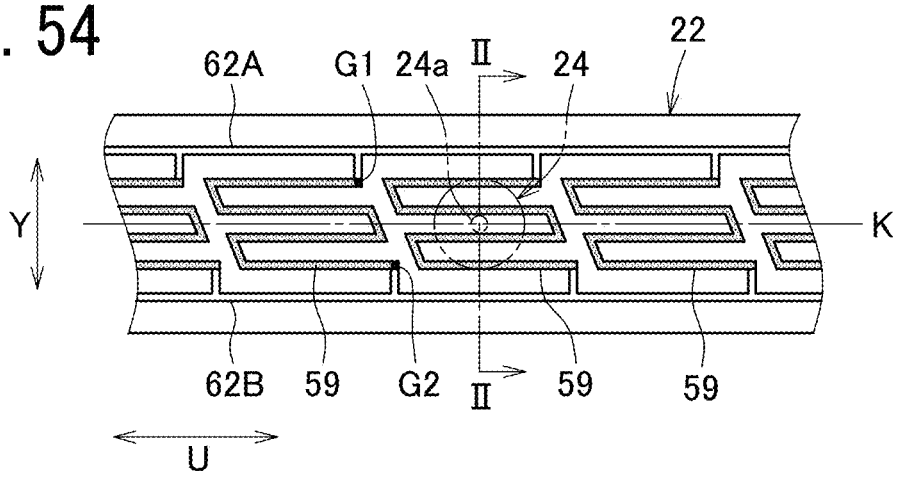
FIG. 54 is a schematic view of the heater of FIG. 7, illustrating the power supply lines connected to each resistive heat generator on one side in the longitudinal direction of the heater, with a location of the heater temperature sensor in the short-side direction of the heater.

Contrary to the heater 22 described above with reference to FIGS. 52 and 53, when the connection positions G1 and G2 of the power supply lines 62A and 62B for each resistive heat generator 59 are arranged on the same side in the heater 22 as illustrated in FIG. 54, the temperature detection part 44*a* is located not on the resistive heat generator 59 but at a position corresponding to an interval between longitudinal portions of the resistive heat generator 59 extending in the longitudinal direction U of the heater 22. In other words, the temperature detection part 44*a* is located at a position corresponding to a portion of the heater 22 without the resistive heat generator 59. Note that the term "position corresponding to an interval between longitudinal portions of the resistive heat generator 59 extending in the longitudinal direction U of the heater 22" as used herein refers to a position overlapping, in the thickness direction of the heater 22, a position in an interval between the longitudinal portions of the resistive heat generator 59 extending in the longitudinal direction U of the heater 22.

Figure 55:
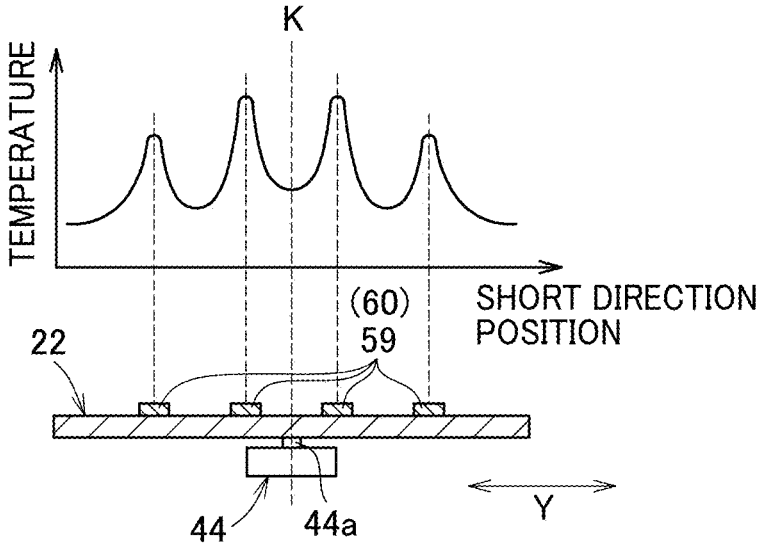
FIG. 55 is a graph of a temperature distribution of the heater in a II-II cross section of FIG. 54, with a cross-sectional view of the heater along a line II.

In this case, as illustrated in FIG. 55, the temperature sensor 44 detects a temperature between adjacent peak values of the heater 22. Since the temperature changes gently in a relatively wide range between the adjacent peak values, the detected temperature is unlikely to change even if the temperature sensor 44 is displaced in the short-side direction Y of the heater 22. Therefore, this case has an advantage in reducing differences in detected temperature caused by the displacement of the temperature sensor 44. Since the displacement of the temperature sensor 44 unlikely causes the differences in detected temperature, the temperature sensor 44 does not have to be installed with high accuracy. That is, the workability of installing the temperature sensor 44 is enhanced.

Note that, as in the heater 22 illustrated in FIG. 54, the temperature detection part 44*a* may be located between adjacent peak values in the heater 22 illustrated in FIG. 52. However, in such a case, the adjacent peak values of temperatures are different from each other as illustrated in FIG. 53. Therefore, the amount of change in detected temperatures depends on which peak value the temperature sensor 44 is displaced to.

From the viewpoint of reducing the differences in detected temperature, the configuration in which the connection positions of the power supply lines and the resistive heat generator are located on the same side in the longitudinal direction of the heater is preferable to the configuration in which the connection positions of the power supply lines and the resistive heat generator are located on the opposite sides in the longitudinal direction of the heater.

Compared to the heater 22 in which the first power supply line 62A and the second power supply line 62B are connected to the resistive heat generator 59 on the opposite sides in the longitudinal direction of the heater 22, the heater 22 in which the first power supply line 62A and the second power supply line 62B are connected to the resistive heat generator 59 on the same side in the longitudinal direction of the heater 22 has an advantage in arrangement of the temperature sensor 44 in the short-side direction Y of the heater 22.

Moreover, it is desirable to pay attention to the following points when disposing the temperature sensor 44 in the longitudinal direction U of the heater 22.

Figure 56:
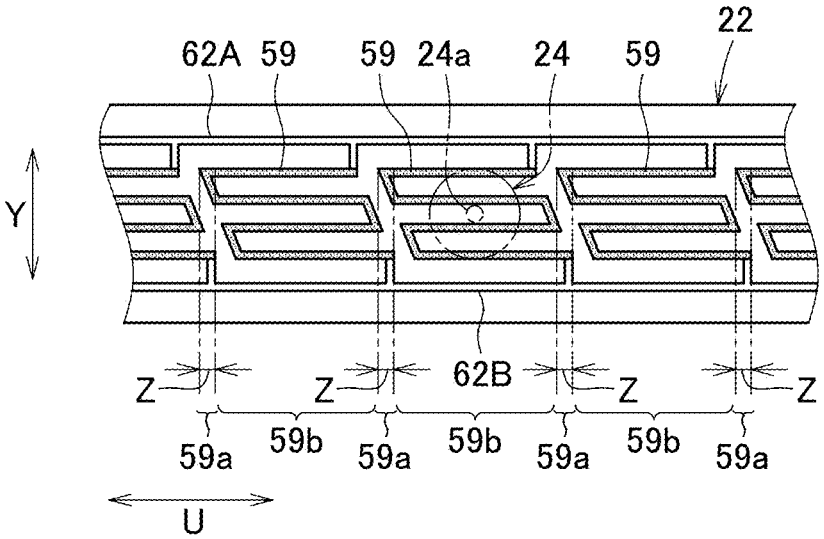
FIG. 56 is a schematic view of the heater, illustrating a location of the heater temperature sensor in the longitudinal direction of the heater.

FIG. 56 is a schematic view of the heater 22, illustrating a location of the temperature sensor 44 (i.e., heater temperature sensor) in the longitudinal direction U of the heater 22. As illustrated in FIG. 56, in the present embodiment, opposed end portions of each of the resistive heat generators 59 in the longitudinal direction U of the heater 22 are inclined with respect to a sheet conveyance direction (i.e., vertical direction in FIG. 56), which is a direction in which the sheet P is conveyed. At least part of the respective end portions of the adjacent resistive heat generators 59 overlap each other in the longitudinal direction U of the heater 22. That is, at least part of the end portions of the adjacent resistive heat generators 59 are located in a common area Z in the longitudinal direction U of the heater 22. Specifically, the resistive heat generator 59 includes an overlapping portion 59*a* and a non-overlapping portion 59*b*. The overlapping portion 59*a* is located in the common area Z shared with the adjacent resistive heat generator 59 in the longitudinal direction U of the heater 22. By contrast, the non-overlapping portion 59*b* is not located in the common area Z shared with the adjacent resistive heat generator 59 in the longitudinal direction U of the heater 22.

The overlapping portion 59*a* reduces a temperature decrease between the adjacent resistive heat generators 59. However, compared to the non-overlapping portion 59*b*, the overlapping portion 59*a* tends to have greater temperature differences determined by position. Therefore, as illustrated in FIG. 56, the temperature detection part 44*a* of the temperature sensor 44 is preferably located at a position corresponding to the non-overlapping portion 59*b*, not to the overlapping portion 59*a*. Note that the term "position corresponding to the non-overlapping portion 59*b*" herein refers to a position overlapping the non-overlapping portion 59*b* in the thickness direction of the heater 22.

A heating device according to the present disclosure is not limited to the fixing device described in the above embodiments. The heating device according to the present disclosure is also applicable to, for example, a heating device such as a dryer to dry ink applied to the sheet, a coating device (a laminator) that heats, under pressure, a film serving as a covering member onto the surface of the sheet such as paper, and a thermocompression device such as a heat sealer that seals a seal portion of a packaging material with heat and pressure. Applying the present disclosure to the above heating device can reduce the temperature difference between the one end portion and the other end portion in the longitudinal direction of the heating device.

The sheets P as recording media may be thick paper, postcards, envelopes, plain paper, thin paper, coated paper, art paper, tracing paper, overhead projector (OHP) transparencies, plastic film, prepreg, copper foil, and the like.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. Further, features of components of the embodiments, such as the number, the position, and the shape are not limited the embodiments and thus may be preferably set.

What is claimed is:

1. A heating device comprising:

an endless belt;

an opposed rotator configured to contact the endless belt to form a nip between the endless belt and the opposed rotator;

a heater including a plurality of resistive heat generators configured to heat the endless belt, the heater being configured to generate a larger amount of heat on a first side of the heater than a second side of the heater in a longitudinal direction of the heater, the first side being opposite to the second side with respect to a center position of a heating span of all the plurality of resistive heat generators energized in the longitudinal direction of the heater; and a heat transfer portion disposed on the first side to release heat from the heating span, wherein a length of the endless belt on the first side is longer than a length of the endless belt on the second side with respect to the center position in the longitudinal direction of the heater.

2. The heating device according to claim 1, wherein the heater includes a first heat generator group including at least one resistive heat generator, a second heat generator group including resistive heat generators arranged at both sides of the first heat generator group, a first electrode arranged on a longitudinal end side of the heater and coupled to the first heat generator group via a conductor, a second electrode coupled to the first heat generator group and the second heat generator group via a conductor, and a third electrode coupled to the second heat generator group via a conductor.

3. The heating device according to claim 1, wherein the heater includes a first electrode, a second electrode, a first conductor electrically coupled to the first electrode and the plurality of resistive heat generators, and a second conductor electrically coupled to the second electrode and the plurality of resistive heat generators, wherein a connection position of the first conductor and one of the plurality of resistive heat generators and a connection position of the second conductor and the one of the plurality of resistive heat generators are on a same side in the longitudinal direction of the heater with respect to a center position of the one of the plurality of resistive heat generators.

4. The heating device according to claim 1, further comprising a discharger configured to discharge at least one of the endless belt and the opposed rotator, wherein the discharger is disposed on the first side of the at least one of the endless belt and the opposed rotator in the longitudinal direction of the heater.

5. The heating device according to claim 4, wherein the discharger faces an end portion of the at least one of the endless belt and the opposed rotator on the first side and is disposed outside the heating span in the longitudinal direction of the heater.

6. The heating device according to claim 1, further comprising a drive transmitter coupled to an end of the opposed rotator on the first side in the longitudinal direction of the heater and configured to transmit driving force to the opposed rotator.

7. The heating device according to claim 1, further comprising a temperature detector disposed on the first side and configured to detect a temperature of at least one of the endless belt and the opposed rotator.

8. The heating device according to claim 1, further comprising a holder holding the heater, wherein a length of the holder on the first side is longer than a length of the holder on the second side with respect to the center position in the longitudinal direction of the heater.

9. The heating device according to claim 1, wherein a ratio of a short-side dimension of each of the resistive heat generators to a short-side dimension of the heater is not less than 25%, and wherein a short-side direction of each of the heater and the resistive heat generators intersects the longitudinal direction of the heater along a surface of the heater on which the resistive heat generators are disposed.

10. The heating device according to claim 1, wherein a ratio of a short-side dimension of each of the resistive heat generators to a short-side dimension of the heater is not less than 40%, and wherein a short-side direction of each of the heater and the resistive heat generators intersects the longitudinal direction of the heater along a surface of the heater on which the resistive heat generators are disposed.

11. The heating device according to claim 1, wherein the heater has an overlapping portion in which the plurality of resistive heat generators overlap in a short-side direction of the heater, and wherein the short-side direction of the heater and a short-side direction of each of the resistive heat generators intersect the longitudinal direction of the heater along a surface of the heater on which the resistive heat generators are disposed.

12. The heating device according to claim 11, further comprising a heater temperature detector configured to detect a temperature of the heater, wherein the heater has a non-overlapping portion in which the plurality of resistive heat generators does not overlap in the short-side direction, wherein one of the resistive heat generators is disposed on the non-overlapping portion, and wherein the heater temperature detector is disposed at a position overlapping the non-overlapping portion in a thickness direction of the heater.

13. A fixing device comprising the heating device according to claim 1.

14. An image forming apparatus comprising the heating device according to claim 1.

15. A heating device comprising:

an endless belt;

an opposed rotator configured to contact the endless belt to form a nip between the endless belt and the opposed rotator;

a heater configured to heat the endless belt, the heater including a first heat generator group including at least one resistive heat generator, a second heat generator group including resistive heat generators outside the first heat generator group at both end portions of the heater in a longitudinal direction of the heater, a first electrode coupled to the first heat generator group, a second electrode coupled to the first heat generator group and the second heat generator group, and a third electrode coupled to the second heat generator group; and a heat transfer portion disposed on an opposite side of the first electrode with respect to a center position of a heating span of all the resistive heat generators energized in the longitudinal direction of the heater, wherein a ratio of a short-side dimension of each of the resistive heat generators to a short-side dimension of the heater is not less than 40%, and wherein a short-side direction of each of the heater and the resistive heat generators intersects the longitudinal direction of the heater along a surface of the heater on which the resistive heat generators are disposed.

16. A fixing device comprising the heating device according to claim 15.

17. An image forming apparatus comprising the heating device according to claim 15.

18. A heating device comprising:

an endless belt;

an opposed rotator configured to contact the endless belt to form a nip between the endless belt and the opposed rotator;

a heater including a plurality of resistive heat generators configured to heat the endless belt, the heater being configured to generate a larger amount of heat on a first side of the heater than a second side of the heater in a longitudinal direction of the heater, the first side being opposite to the second side with respect to a center position of a heating span of all the plurality of resistive heat generators energized in the longitudinal direction of the heater; and a heat transfer portion disposed on the first side to release heat from the heating span, wherein the heater has an overlapping portion in which the plurality of resistive heat generators overlap in a short-side direction of the heater, and wherein the short-side direction of the heater and a short-side direction of each of the resistive heat generators intersect the longitudinal direction of the heater along a surface of the heater on which the resistive heat generators are disposed.

* * * * *